US005474883A

United States Patent [19]

Mihayashi et al.

[11] Patent Number: 5,474,883

[45] Date of Patent: Dec. 12, 1995

[54] SILVER HALIDE COLOR PHOTOGRAPHIC MATERIAL

[75] Inventors: Keiji Mihayashi; Kiyoshi Nakazyo, both of Kanagawa, Japan

[73] Assignee: Fuji Photo Film Co., Ltd., Kanagawa, Japan

[21] Appl. No.: 249,909

[22] Filed: May 26, 1994

[30] Foreign Application Priority Data

May 28, 1993 [JP] Japan ..... 5-148270

[51] Int. Cl.[6] ..... G03C 1/795; G03C 7/36

[52] U.S. Cl. ..... 430/523; 430/533; 430/556; 430/557

[58] Field of Search ..... 430/556, 557, 430/558, 523, 533, 634, 635

[56] References Cited

U.S. PATENT DOCUMENTS

| | | | |
|---|---|---|---|
| 4,141,735 | 2/1979 | Schrader et al. | 430/553 |
| 5,118,599 | 6/1992 | Lau et al. | 430/556 |
| 5,194,369 | 3/1993 | Mihayashi et al. | 430/557 |
| 5,213,958 | 5/1993 | Motoki et al. | 430/557 |
| 5,238,803 | 8/1993 | Ichijima et al. | 430/557 |
| 5,314,797 | 5/1994 | Yoshioka et al. | 430/557 |
| 5,326,668 | 7/1994 | Waki | 430/250 |
| 5,326,689 | 7/1994 | Murayama | 430/533 |
| 5,359,080 | 10/1994 | Shimura et al. | 548/317.5 |
| 5,427,902 | 6/1995 | Shimura et al. | 430/556 |

FOREIGN PATENT DOCUMENTS

| | | | |
|---|---|---|---|
| 0572275 | 12/1993 | European Pat. Off. | 430/533 |
| 2280141 | 11/1990 | Japan | 430/533 |

OTHER PUBLICATIONS

RD 24108, May 1984, pp. 189–193.

Research Disclosure No. 307,105 (Nov., 1989), Item XVII.

*Primary Examiner*—Lee C. Wright

*Attorney, Agent, or Firm*—Sughrue, Mion, Zinn, Macpeak & Seas

[57] ABSTRACT

A silver halide color photographic material comprising a support having provided thereon a layer containing an acylacetamide-type coupler having an acyl group represented by the following formula (YI) and/or a coupler represented by the following formula (1) or (2), wherein the support is made of a poly(alkylene aromatic dicarboxylate) and has a glass transition point of from 50° C. to 200° C. and is heat-treated at a temperature falling within the range from 40° C. to lower than the glass transition point before or after having been coated with a subbing layer and before being coated with silver halide light-sensitive layers, (YI)

wherein $R_1$ represents a substituent; and Q represents a non-metallic atomic group necessary for forming, along with C in the formula, a 3-membered to 5-membered hydrocarbon ring or a 3-membered to 6-membered hetero ring having in the ring structure at least one hetero atom selected from among N, O, S and P, (1)

(2)

wherein $X_1$ and $X_2$ each represents an alkyl group, an aryl group or a heterocyclic group; $X_3$ represents an organic residue for forming a nitrogen-containing heterocyclic group along with >N— in the formula; Y represents an aryl group or a heterocyclic group; and Z represents a group which splits off from the formula when the coupler represented by the formula reacts with an oxidation product of a developing agent.

7 Claims, 1 Drawing Sheet

SILVER HALIDE COLOR PHOTOGRAPHIC MATERIAL

FIELD OF THE INVENTION

The present invention relates to a silver halide color photographic material having improved color reproducibility and color image fastness and having improved storage stability. The color photographic material of the present invention has been improved not to have the habit of curling when it is in the form of a roll film so that the operation of drawing the tongue of the film from a patrone has been made easy. Accordingly, during its development, the color photographic material of the present invention is free from the problem of uneven development and is not scratched or bent.

BACKGROUND OF THE INVENTION

In general, a silver halide color photographic material (hereinafter simply referred to as a "photographic material") is produced by coating at least one light-sensitive silver halide emulsion layer on a plastic film support. As the plastic film support, generally employed are a cellulosic polymer such as typically tri(acetyl cellulose) (hereinafter referred to as "TAC") and a polyester polymer such as typically poly-(ethylene terephthalate) (hereinafter referred to as "PET") . These are described in, for example, *Research Disclosure No.* 307,105 (November, 1989), Item XVII.

A photographic material having the plastic film support is generally grouped into two groups; one being in the form of a sheet film such as a cut film, and the other being in the form of a roll film such as typically a picture-taking film having a width of 35 m/m or so. The latter is generally housed in a patrone and is charged in a camera for picture-taking.

As a support for a roll film, TAC is predominantly used. The most characteristic feature of this is that TAC has no optical anisotropy and has a high transparency. Another excellent characteristic of this is that TAC has an excellent property of easily smoothing the curl of a developed photographic material having it as a support. Specifically, since a TAC film has a relatively high water-absorbing property, though being a plastic film, because of its characteristic molecular structure, the molecular chain of the film comes to be fluid after the support film of TAC has absorbed water during development of a curled roll film so that the molecular chain as fixed in the curled roll film is to be rearranged. As a result, TAC displays an excellent property of easily smoothing the curl of the roll film having it as a support.

However, a photographic material having a support not having such an easily curl-smoothing property unlike TAC involves various problems, if used in the form of a roll film. For example, during its development, the photographic material is often "developed unevenly" or "scratched" or "bent". In addition, in the printing step where the developed film is printed in printing papers, the film is often scratched or causes out-of-focusing or is jammed during its feeding.

On the other hand, since TAC have a relatively large water absorption, it is gradually decomposed when stored for a long period of time to release an acid (acetic acid) therefrom. Cyan, magenta and yellow dye-forming couplers to be used in photographic materials and the dyes to be derived from such couplers are affected by the released acid, whereby the coloring capacity of the couplers is lowered and the formed dyes are faded. Above all, yellow dye-forming couplers and the dyes derived from them are affected more by the acid than other cyan and magenta dye-forming couplers and the dyes derived from them. Of yellow dye-forming couplers, the couplers to be used in the present invention have a higher coupling activity than conventional pivaloylacetanilide-type couplers, and the dyes derived from the former have a larger molecular extinction coefficient than those derived from the latter. The couplers to be used in the present invention are comparable to benzoylacetanilide-type couplers with respect to their coloring properties. Regarding the color image fastness, the couplers to be used in the present invention are almost similar to pivaloylacetanilide-type couplers. Regarding the spectral absorption characteristics of the dyes to be derived from the couplers to be used in the present invention, their absorption of green light in a longer wavelength range is small and the couplers have excellent color reproducibility. Therefore, if the couplers having such excellent coloring properties, color image fastness and color reproducibility may be incorporated into photographic materials having the TAC support, without lowering the storage stability of themselves and also the storage stability of the color images derived from them, these excellent characteristics of the couplers may further be improved and, additionally, the yellow dye-forming couplers themselves may be improved greatly. Given these situation, it has heretofore been desired to attain the technical means capable of satisfying the request.

The use of photographic materials has been diversified widely in these days, and the technologies for rapid feeding of a photographic film in a camera during picture-taking with it, elevation of the image magnification and reduction of the size of camera have advanced noticeably. Under the advanced technologies, the supports of photographic materials are needed to have high strength and high dimension stability and to be thin as much as possible. In addition, with much reduction of the size of camera, the demand for reducing the size of patrone has also become great.

Reduction of the size of a patrone involves two problems.

The first problem is that the reduction of the thickness of the roll film to be in the patrone is often accompanied by lowering of the mechanical strength of the film itself. In particular, the bending elasticity of a roll film decreases in proportion to the third power of the thickness thereof. Photographic materials generally have gelatin coated on the support, and the gelatin layer is shrunk under a low humidity condition to be curled in the widthwise direction to a gutter-like (U-shaped) form. The support is therefore needed to have a bending elasticity to be resistant to the shrinking stress.

The second problem is that the roll film in a small-sized patrone with a small-sized spool is strongly curled during storage of the film. In the conventional 135 system device, the smallest diameter of a roll film of 36 exposures as housed in the patrone is 14 mm. If the patrone is desired to be more small-sized so that the diameter may be 12 mm or less or further 9 mm or less, the hardly smoothable curl of the roll film as housed in the patrone would be much greater to cause various troubles in handling the exposed film. For instance, if the exposed film taken out from such a small-sized patrone is developed in a mini-laboratory automatic developing machine, the film would be curled up during handling it since only one edge of the film is fixed to the leader but the other one is not, so that feeding of a processing solution to the curled-up area would be delayed to cause so-called "uneven development". In addition, the curled-up film would be crushed by the rollers in the machine and the film being processed would then be "bent or scratched".

When an long-size unexposed film (for 36 exposures) that has been drawn out from its patrone is charged into a supply room by winding it into a roll form (this operation is referred to as "core-setting"), the number of winding times thereof is larger than that of films for 12 exposures or 24 exposures so that it is wound tightly (namely, it is wound so tightly that the wound roll is hardly loosened). In addition, in this case, the diameter of the wound innermost layer of the roll film in the supply room is naturally small. Therefore, the leading side (tongue) of the long-size film is tightly curled when rolled into a roll film. For these reasons, the exposed film that is cased in the patrone is still tightly curled and the tightly-curled tongue of the roll film is to firmly adhere to the inner wall of the patrone. As a result, it is extremely difficult to take out the tongue of the exposed film with a drawing tool before its development.

In order to attain the above-mentioned two themes in a roll film, one being the strong mechanical strength and the other being the easily-smoothable property, there are two methods. The first method is to modify a TAC support having an easily-smoothable property to thereby enhance the mechanical strength thereof. The second method is to improve a polyester support having a high mechanical strength, such as typically a poly(ethylene terephthalate) (PET) support to be employed in the present invention, in order that it hardly has the habit of curling.

The achievement of the themes in question by the former method is extremely difficult. This is because the thickness of the TAC support in the current photographic materials is 122 μm, and if the thickness of the support is reduced to 100 μm, because the modulus of bending elasticity is generally proportional to the third power of the thickness, the modulus of bending elasticity of the 100 μm-thick support becomes about 50% that of the 122 μm-thick support. For this reason, the support must be modified in such a manner that the modified 100 μm-thick support has the modulus of elasticity of about two times as large as the non-modified 100 μm-thick one in order to attain the purpose. On the other hand, if the spool diameter is reduced to 10 mm or less, even the uncurlable TAC could not sufficiently uncurl during development with the result that the still curled photographic material is to involve the above-mentioned "uneven development" and "bending or scratching" troubles. In addition, the operation of drawing the tongue of the roll film out of the patrone is difficult. It is therefore considered extremely difficult to satisfy the three themes of the "two times elevation of the modulus of elasticity", the "improvement of the uncurling property" and the "improvement of the easy drawability of the tongue of the roll film from its patrone".

On the other hand, where the achievement of the themes is attained by the latter method of, for example, employing PET, a 100 μm-thick PET support or even a 90 μm-thick PET support may have the same bending elasticity as a 122 μm-thick TAC support because PET naturally has a high modulus of elasticity. In addition, from the present inventor's investigations, it has been clarified that the use of polyester supports such as PET is preferred to the use of the above-mentioned TAC supports, since the former is almost free from the deterioration of photographic materials during their storage and the deterioration of the color images formed though the latter is not free.

It has heretofore been considered that polyester supports which are inexpensive and are suitable for mass-production and which have high mechanical strength and dimension stability, such as typically PET, may be substitutable for TAC in order to attain the above-mentioned objects. However, when photographic materials having such polyester supports are used as roll films which are popular in this technical field, they are strongly curled and the curled films are hardly uncurled or smoothed. Accordingly, the handlability of the developed films is bad. For these reasons, the use of polyester supports in photographic materials has heretofore been limited, though they have the above-mentioned excellent properties.

SUMMARY OF THE INVENTION

Accordingly, the object of the present invention is to provide a photographic material which may be core-set with no troubles, which may easily be handled when the tongue of the core-set film of the photographic material is drawn out from the patrone, which may be developed uniformly without being bent at the trail edge thereof and without being scratched, which has improved storage stability, which may form a color image with good storability and which has excellent color reproducibility.

The above-mentioned object of the present invention has been attained by the following silver halide color photographic materials:

① A silver halide color photographic material comprising a support having provided thereon a layer containing an acylacetamide-type coupler having an acyl group represented by the following formula (YI) and/or a coupler represented by the following formula (1) or (2), wherein the support is made of a poly(alkylene aromatic dicarboxylate) and has a glass transition point of from 50° C. to 200° C. and is heat-treated at a temperature falling within the range from 40° C. to lower than the glass transition point before or after having been coated with a subbing layer and before being coated with silver halide light-sensitive layers,

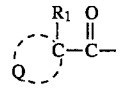

(YI)

wherein $R_1$ represents a substituent; and Q represents a non-metallic atomic group necessary for forming, along with C in the formula, a 3-membered to 5-membered hydrocarbon ring or a 3-membered to 6-membered hetero ring having in the ring structure at least one hetero atom selected from among N, O, S and P, wherein $X_1$ and $X_2$ each represents an alkyl group, an aryl group or a heterocyclic group; $X_3$ represents an organic residue for forming a nitrogen-containing heterocyclic group along with >N— in the formula; Y represents an aryl group or a heterocyclic group; and Z represents a group which splits off from the formula when the coupler represented by the formula reacts with an oxidation product of a developing agent.

① The silver halide color photographic material as stated in ①, wherein the poly(alkylene aromatic dicarboxylate) support is made of a polyester consisting essentially of a benzene dicarboxylic acid or naphthalene dicarboxylic acid component and a diol component.

③ The silver halide color photographic material as stated in ① or ②, wherein the polyester of the polyester support is a poly(ethylene terephthalate) or a poly(ethylene naphthalate).

④ The silver halide color photographic material as stated in anyone of ① to ③, wherein the thickness of the poly(alkylene aromatic dicarboxylate) support is from 50 μm to 100 μm.

⑤ The silver halide color photographic material as stated in anyone of ① to ④, which is used in the form of a roll wound around a spool or vacant core having a core diameter of from 3 mm to 10 mm.

DETAILED DESCRIPTION OF THE INVENTION

Figure 1:
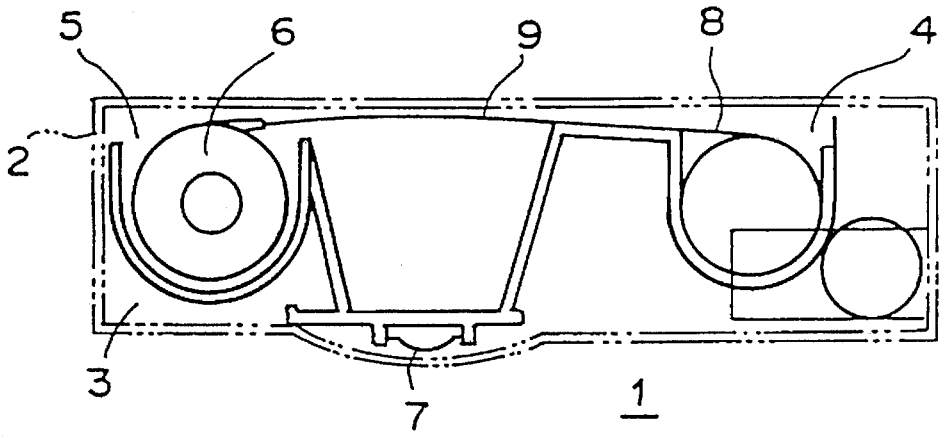
FIG. 1 is a top plan view, showing the inner structure of a film-combined camera as one mode to which the present invention is applied.

The present invention will be explained in detail hereunder.

First, the polyesters for use in the present invention will be mentioned.

There are various kinds of polyesters usable in the present invention. In view of the balance of the hardly curling property, the high mechanical strength and the low cost, preferred are polyesters predominantly comprising a benzenedicarboxylic acid or naphthalenedicarboxylic acid component and a diol component. Of these, especially preferred are polyethylene terephthalate (PET) and polyethylene naphthalate type polyesters. The term "naphthalate" as referred to herein means "naphthalenedicarboxylate".

The polyesters for use in the present invention are made from an aromatic dicarboxylic acid component and a diol component as the essential components.

The aromatic dicarboxylic acid is a dicarboxylic acid having at least one benzene nucleus. Specific examples of the compounds include terephthalic acid, isophthalic acid, phthalic acid, phthalic anhydride, 1,4-or 1,5- or 2,6- or 2,7-naphthalenedicarboxylic acid, biphenyl-4,4'-dicarboxylic acid, tetrachlorophthalic anhydride, and the following acids:

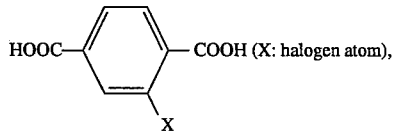

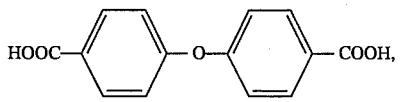

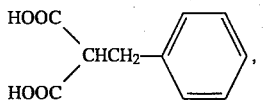

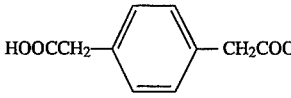

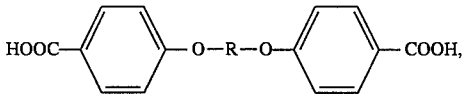

(R: $C_1$~$C_5$ alkylene)

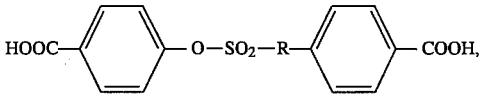

(R: $C_1$~$C_5$ alkylene)

-continued

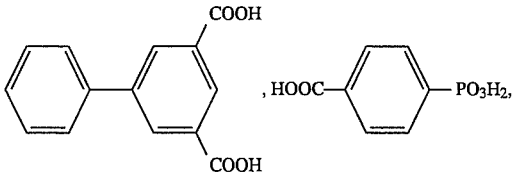

As other usable dibasic acids than the essential aromatic dicarboxylic acids, mentioned are succinic acid, glutaric acid, adipic acid, sebacic acid, succinic anhydride, maleic acid, fumaric acid, maleic anhydride, itaconic acid, citraconic anhydride, tetrahydrophthalic anhydride, 3,6-endomethylenetetrahydrophthalic anhydride, 1,4-cyclohexanedicarboxylic acid, and the following acids:

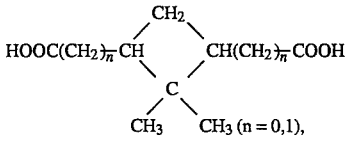

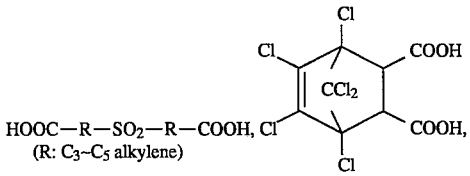

(R: $C_3$~$C_5$ alkylene)

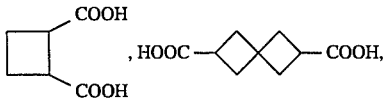

As usable diols, are mentioned ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcinol, hydroquinone, 1,4-benzenedimethanol, and the following diols:

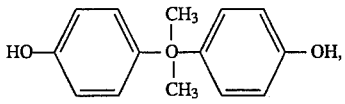

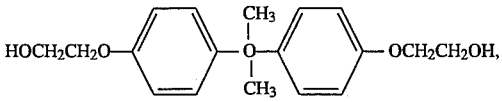

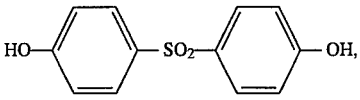

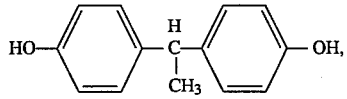

-continued

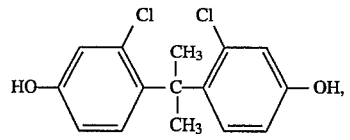

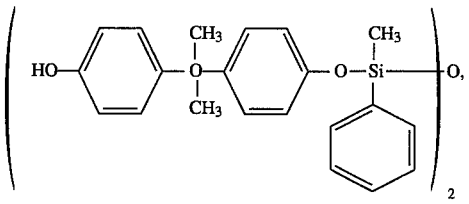

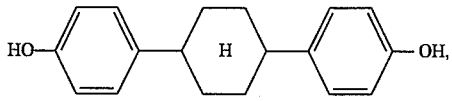

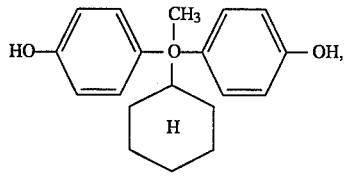

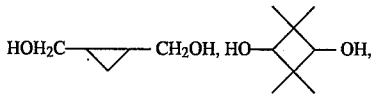

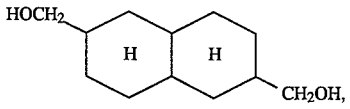

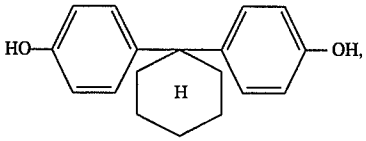

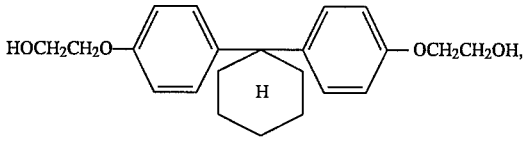

If desired, copolyesters containing additional comonomers of mono-functional or tri- or more poly-functional hydroxyl group-containing compounds or acid-containing compounds may also be used in the present invention. Again, also usable in the present invention are copolyesters containing additional comonomers of compounds having both hydroxyl group(s) and carboxyl (or its ester) group(s) in the molecule. As examples of such comonomers, the following compounds are mentioned.

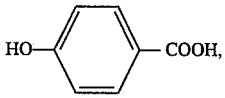

-continued

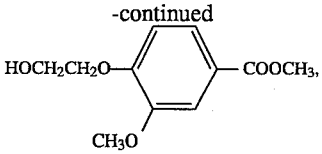

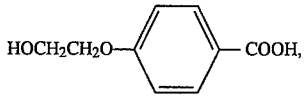

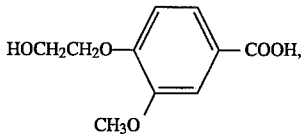

Of the polyesters composed of the above-mentioned diols and dicarboxylic acids, more preferred are homopolymers such as poly (ethylene terephthalate), poly(ethylene naphthalate), poly (cyclohexanedimethanol terephthalate) (PCT), etc. Of the essential aromatic dicarboxylic acids, especially preferred are 2,6-naphthalenedicarboxylic acid (NDCA), terephthalic acid (TPA), isophthalic acid (IPA), orthophthalic acid (OPA), and biphenyl-4,4'-dicarboxylic acid (PPDC). Of the diols, especially preferred are ethylene glycol (EG), cyclohexanedimethanol (CHDM), neopentyl glycol (NPG), bisphenol A (BPA), and biphenol (BP). Preferred are copolymers composed of such essential aromatic dicarboxylic acid(s) and diol(s), and additional copolymerizable hydroxycarboxylic acid (s) such as parahydroxybenzoic acid (PHBA) and 6-hydroxy-2-naphthalene-carboxylic acid (HNCA).

Of these, especially preferred are copolymers of terephthalic acid, naphthalenedicarboxylic acid and ethylene glycol (in which the molar ratio of terephthalic acid to naphthalenedicarboxylic acid is preferably from 0.9/0.1 to 0.1/0.9, more preferably from 0.8/0.2 to 0.2/0.8); copolymers of terephthalic acid, ethylene glycol and bisphenol A (in which the molar ratio of ethylene glycol to bisphenol A is preferably from 0.6/0.4 to 0/1, more preferably 0.5/0.5 to 0.1/0.9); copolymers of isophthalic acid, biphenyl-4,4'-dicarboxylic acid, terephthalic acid and ethylene glycol (in which the molar ratio of isophthalic acid to terephthalic acid and that of biphenyl-4,4'-dicarboxylic acid to the same are preferably from 0.1/1 to 0.5/1 and from 0.1/1 to 0.5/1, respectively, more preferably from 0.2/1 to 0.3/1 and from 0.2/1 to 0.3/1, respectively); copolymers of terephthalic acid, neopentyl glycol and ethylene glycol (in which the molar ratio of neopentyl glycol to ethylene glycol is preferably from 1/0 to 0.7/0.3, more preferably from 0.9/0.1 to 0.6/0.4); copolymers of terephthalic acid, ethylene glycol and biphenol (in which the molar ratio of ethylene glycol to biphenol is preferably from 0/1 to 0.8/0.2, more preferably from 0.1/0.9 to 0.7/0.3); and copolymers of parahydroxybenzoic acid, ethylene glycol and terephthalic acid (in which the molar ratio of parahydroxybenzoic acid to ethylene glycol is preferably from 1/0 to 0.1/0.9, more preferably from 0.9/0.1 to 0.2/0.8).

These homopolymers and copolymers may be produced by conventional known methods of producing ordinary polyesters. For instance, an acid component and a glycol component are directly esterified; or if a dialkyl ester is used as an acid component, it is first interesterified with a glycol component and the resulting product is then heated under reduced pressure to remove the excess glycol component.

Alternatively, an acid halide is used as an acid component and this may be reacted with a glycol component. In the case, interesterification, addition of a catalyst or polymerization catalyst or addition of a heat-resistant stabilizer may be employed, if desired. Regarding the polyester producing methods, for example, the descriptions of Studies of Polymer Experiments, Vol. 5 "Polycondensation and Addition Polymerization" (published by Kyoritsu Publishing Co., 1980), pp. 103–136; and Synthetic Polymers V (published by Asakura Shoten KK, 1971), pp. 187–286 may be referred to.

The polyesters for use in the present invention preferably have a weight average molecular weight of approximately from 10,000 to 500,000.

In order to improve the adhesiveness of these polyesters to other polyesters, these polyesters may be blended with other polyesters, or may be copolymerized with monomers constituting other polyesters, or may be copolymerized with monomers having unsaturated bond(s) for radical crosslinking.

Polymer blends of such polymers may easily be formed in accordance with the methods described in JP-A- 49-5482, JP-A-64-4325, JP-A-3-192718, and *Research Disclosure* 283739-41, 284779-82 and 294807-14. (The term "JP-A" as used herein means an "unexamined published Japanese patent application.)

The "glass transition point (Tg)" as referred to herein is defined as follows: Using a differential spectrophotometric colorimeter (DSC), when 10 mg of a sample film is heated in a helium/nitrogen stream at a rate of 20° C./min, a mathematical average temperature of the temperature at which the heated film begins to be shifted from its base line and the temperature at which it comes to return back to a new base line is obtained, or when an endothermic (heat-absorbing) peak has appeared, the temperature of the maximum endothermic peak is obtained. Either of the thus obtained data is defined to be Tg.

The polyesters for use in the present invention have Tg of 50° C. or higher. In general, however, they are not always handled with sufficient care but they are often exposed to high temperatures of up to even 40° C. especially in the outdoors in the summer season. In view of the fact, the polyesters for use in the present invention are desired to have Tg of 55° C. or higher by way of precaution. More preferably, they are desired to have Tg of 60° C. or higher, further preferably 70° C. or higher. This is because the effect of the heat treatment of the polyester film for removing its habit of curling is in vain when the heat-treated film is exposed to temperatures higher than the glass transition point of the film. Therefore, the polyesters for use in the present invention are desired to have a glass transition point higher than severe temperatures at which they are actually handled by users, for example, higher than the summer season temperature of 40° C.

The upper limit of the glass transition point of the polyesters for use in the present invention is 200° C. This is because polyesters having a glass transition point higher than 200° C. could not be formed into films with good transparency. For these reasons, the polyesters for use in the present invention must have Tg of from 50° C. to 200° C.

Preferred examples of the polyesters for use in the present invention are mentioned below, which, however, are not limitative. The numerals in the parentheses shown below represent molar ratio of monomers.

| | | |
|---|---|---|
| P-0: | [terephthalic acid (TPA)/ethylene glycol (EG) (100/100 by mole)] (PET) | Tg = 80° C. |
| P-1: | [2,6-naphthalenedicarboxylic acid (NDCA)/ethylene glycol (EG) (100/100)] (PEN) | Tg = 119° C. |
| P-2: | [terephthalic acid (TPA)/cyclohexane-dimethanol (CHDM) (100/100)] | Tg = 93° C. |
| P-3: | [TPA/bisphenol A (BPA) (100/100)] | Tg = 192° C. |
| P-4: | 2,6-NDCA/TPA/EG (50/50/100) | Tg = 92° C. |
| P-5: | 2,6-NDCA/TPA/EG (75/25/100) | Tg = 102° C. |
| P-6: | 2,6-NDCA/TPA/EG/BPA (50/50/75/25) | Tg = 112° C. |
| P-7: | TPA/EG/BPA (100/50/50) | Tg = 105° C. |
| P-8: | TPA/EG/BPA (100/25/75) | Tg = 135° C. |
| P-9: | TPA/EG/CHDM/BPA (100/25/25/50) | Tg = 115° C. |
| P-10: | IPA/PPDC/TPA/EG (20/50/30/100) | Tg = 95° C. |
| P-11: | NDCA/NPG/EG (100/70/30) | Tg = 105° C. |
| P-12: | TPA/EG/BP (100/20/80) | Tg = 115° C. |
| P-13: | PHBA/EG/TPA (200/100/100) | Tg = 125° C. |
| P-14: | PEN/PET (60/40) | Tg = 95° C. |
| P-15: | PEN/PET (80/20) | Tg = 104° C. |
| P-16: | PAr/PEN (50/50) | Tg = 142° C. |
| P-17: | PAr/PCT (50/50) | Tg = 118° C. |
| P-18: | PAr/PET (60/40) | Tg = 101° C. |
| P-19: | PEN/PET/PAr (50/25/25) | Tg = 108° C. |
| P-20: | TPA/5-sulfoisophthalic acid (SIP)/EG (95/5/100) | Tg = 65° C. |

These polyester supports (base films) are desired to have a thickness of from 50 μm to 100 μm. If the thickness is less than 50 μm, such a thin support could not be resistant to the shrinking stress of the photographic layers, which are coated thereover, during drying. On the other hand, if it is more than 100 μm, such a thick film would be against the object of reducing the thickness of the film to obtain small-sized compact photographic materials. However, if the photographic materials of the present invention are used as sheet films, the thickness may be larger than 100 μm but its uppermost limit is 300 μm.

All the above-mentioned polyesters of the present invention have a larger modulus of bending elasticity than TAC. Using these, therefore, the essential object of the present invention that is to reduce the thickness of the films of the photographic materials of the present invention has been realized. Of these, PET and PEN have a large modulus of bending elasticity. Therefore, when the two are used, the thickness of the films of the photographic materials may be lowered to 100 μm or less, though TAC needed a thickness of 122 μm.

The polyester supports of the present invention are characterized in that they are subjected to heat treatment. The heat treatment must be effected at a temperature falling within the range of from 40° C. to lower than the glass transition point of the polyesters for a period of from 0.1 to 1500 hours. The higher the heat treatment temperature, the more the effect advances. If, however, the heat treatment temperature is higher than the glass transition point of the polyester film, the molecules of the film as heat-treated under such a high temperature would rather move randomly to inversely increase the free volume of the film, with the result that the molecules of the thus heat-treated film would be more fluid and that the film would be more curlable. Because of the reasons, the heat treatment must be effected at a temperature lower than the glass transition point of the film.

Therefore, the heat treatment is desirably effected at a temperature somewhat lower than the glass transition point of the film for the purpose of shortening the time for the treatment. Specifically, the temperature for the heat treatment is preferably within the range of from 40° C. to lower than the glass transition point of the film, more preferably within the range of from a temperature lower than the glass transition point by 30° C. up to a temperature lower than the glass transition point.

Where the heat treatment is effected under the temperature condition mentioned above, the intended effect may be attained when the time for the treatment is 0.1 hour or more. However, if the time is more than 1500 hours, the effect would almost be saturated. Therefore, the time for the heat treatment is desired to fall within the range of from 0.1 hour to 1500 hours.

For further shortening the time for the heat treatment of the polyester support films of the present invention, the films may be pre-heated at a temperature of Tg or higher for a short period of time (for example, at a temperature higher than Tg by 20° C. to 100° C., for 5 minutes to 3 hours) and thereafter subjected to the essential heat treatment at a temperature of from 40° C. to lower than the glass transition point. For carrying out the heat treatment, the polyester film rolls may be put in a heating warehouse or, alternatively, may be moved in a heating zone. In view of the easiness of the operation, the latter is preferred. It is preferred that the roll cores to be used for the heat treatment, around which the polyester film to be heat-treated is wound, are hollow or have a built-in electric heater or have such a structure that a high-temperature fluid may be passed therethrough, in order to attain efficient thermal diffusion to the polyester film during the heat treatment. The materials of the roll cores are not specifically defined but are preferably such that the mechanical strength of the cores are not lowered and the cores themselves are not deformed due to heat. For instance, usable are stainless steels and glass fiber-reinforced resins.

It is preferred to add various additives to the polyesters for use in the present invention for the purpose of further improving the functions of the polyesters as photographic supports.

For instance, ultraviolet absorbents may be kneaded into the polyester films of the present invention for the purpose of anti-fluorescence and stabilization in storage. As the ultraviolet absorbents, preferred are those not absorbing visible rays. The amount of the absorbent to be in the polyester film is generally approximately from 0.01% by weight to 20% by weight, preferably approximately from 0.05% by weight to 10% by weight. If it is less than 0.01% by weight, the deterioration of the film due to the ultraviolet ray can not be inhibited. As preferred examples of the ultraviolet absorbent, mentioned are benzophenone compounds such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone, and 2,2'-dihydroxy-4,4'-dimethoxybenzophenones; benzotriazole compounds such as 2-(2'-hydroxy-5-methylphenyl)benzotriazole, 2-(2'-hydroxy-3',5'-di-t-butylphenyl)benzotriazole, and 2-(2'-hydroxy-3'-di-t-butyl-5'-methylphenyl)benzotriazole; salicylic acid compounds such as phenyl salicylate and methyl salicylate; and triazine compounds such as 2,4,6-tris[2'-hydroxy-4'-(2"-ethylhexyloxy)phenyl] triazine, and 2-phenyl-4,6-di[2'-hydroxy-4'-(2" -ethylhexyloxy)phenyltriazine.

Use of the polyester film of the present invention as the support of a photographic material involves one problem about its properties, which is that the support of the polyester film causes light-piping due to its high refractive index.

The polyesters of the present invention, especially aromatic polyesters, have a high refractive index of from 1.6 to 1.7; while gelatin, which is the essential component of the photographic emulsion layer to be coated over the polyester base film, has a lower refractive index of from 1.50 to 1.55. Therefore, where light has been introduced into the film from its edge, it easily reflects on the interface between the base and the emulsion layer. Because of the reason, the polyester film causes a so-called light-piping phenomenon.

For evading such a light-piping phenomenon, there are known a method of adding inactive inorganic grains or the like to the film and a method of adding dyes thereto.

The light-piping preventing method which is preferably employed in the present invention is to add dyes that do not greatly increase the film haze to the film.

The dyes to be used for coloring the film for this purpose are not specifically defined. Preferred are gray coloring dyes in view of the general properties of photographic materials. Also preferred are dyes having high heat resistance in the temperature range for filming the polyester film and having excellent compatibility with polyesters.

In view of the above-mentioned viewpoints, specifically mentioned are commercial dyes of Diaresin of Mitsubishi Kasei Corporation or Kayaset of Nippon Kayaku Co., Ltd., which are sold in the market as the dyes for polyesters. By adding these dyes to the polyesters of the present invention, the intended object may be attained.

The coloring density due to addition of such dyes is needed to be at least 0.01 or more, more preferably 0.03 or more, as a color density measured at the visible light region with a Mackbeth's color densitometer.

The polyester films of the present invention may be treated to be lubricative in accordance with their use. The means for making the films lubricative is not specifically defined. For instance, generally employable is a method of kneading an inactive inorganic compound into the film or a method of coating a surfactant over the film.

As inactive inorganic grains usable for this purpose, mentioned are, for example, $SiO_2$, $TiO_2$, $BaSO_4$, $CaCO_3$, talc, kaolin and the like. In addition to the above-mentioned method of making the polyester films lubricative by adding such external inactive grains thereto during the reaction of producing the polyesters, also employable is a method of making the polyester films lubricative by precipitated internal grains therein where grains of catalysts or the like as added during polymerization of the polyesters are precipitated out.

Anyhow, the means of making the polyester films lubricative are not specifically defined. However, since the supports of photographic materials must be transparent as their important factor, the external grains to be added to the polyesters by the former method are desired to be selectively $SiO_2$ grains which have a refractive index relatively near to that of the polyester film, and the internal grains to be precipitated in the polyester films by the latter method are desired to be selectively those having a relatively small grain size.

Where the polyester films are made lubricative by the means of introducing the external grains into the films by kneading, a method of laminating a functional layer over the film is also preferably employable so as to much elevate the transparency of the film. As examples of the method, mentioned are co-extrusion with plural extruders and feed blocks and also co-extrusion with multi-manifold dies.

Where the polymer films of the present invention are used as the supports of photographic materials, it is extremely difficult to firmly adhere photographic layers (such as light-sensitive silver halide emulsion layers, interlayers, filter layers, etc.) each comprising a protective colloid predominantly comprising gelatin to the supports, since the polymer films have hydrophobic surfaces. The conventional technology for overcoming the problem includes, for example, the following two means:

(1) A method of previously activating the surface of the film to be coated the photographic layers by chemical treatment, mechanical treatment, corona-discharging treatment, flame treatment, ultraviolet ray treatment, high frequency treatment, glow-discharging treatment, active plasma treatment, laser treatment, mixed acid treatment, ozone oxidation treatment or the like, followed by directly coating a photographic emulsion over the thus activated surface, whereby the adhesiveness between the surface of the support and the coated layer is elevated.

(2) A method of forming a subbing layer after the above-mentioned surface treatment or without the treatment, followed by coating a photographic emulsion layer over the subbing layer. (For instance, refer to U.S. Pat. Nos. 2,698,241, 2,764,520, 2,864,755, 3,462,335, 3,475,193, 3,143,421, 3,501,301, 3,460,944 and 3,674,531, British Patents 788,365, 804,005 and 891,469, JP-B-48-43122, and JP-B-51-446; the term "JP-B" as used herein means an "examined Japanese patent publication".)

The surface treatment of the support is considered to create much or less polar groups on its surface which has been originally hydrophobic or to increase the crosslinking density of its surface. As a result of the surface treatment, it is also considered that the affinity of the film for the polar groups of the components to be contained in the subbing layer increases or the fastness of the adhesive surface of the film increases.

In addition, various modifications of the constitution of the subbing layer have been made. For instance, a first layer which well adheres to the support (hereinafter referred to as a first subbing layer) is provided and a second hydrophilic resin layer which well adheres to a photographic layer (hereinafter referred to as a second subbing layer) is then coated over the first layer by a so-called multi-layer lamination method. Alternatively, only one resin layer having both hydrophobic groups and hydrophilic groups is coated on the support by a single layer coating method.

Of the surface treatments of the method (1), corona-discharging treatment is the most popular method, which may be effected by any known means such as those disclosed in JP-B-48-5043, JP-B-47-51905, JP-A-47-20867, JP-A-49-83767, JP-A-51-41770, JP-A-51-131576, etc. The discharging frequency for the treatment may be from 50 Hz to 5000 kHz, preferably from 5 kHz to several hundreds kHz. If the discharging frequency is too small, stable discharging could not be attained so that the treated surface is to have pin holes unfavorably. If, however, it is too large, the treatment needs a particular expensive device for impedance matching also unfavorably. The strength of the treatment is suitably from 0.001 KV·A·min/$m^2$ to 5 KV·A·min/$m^2$, preferably from 0.01 KV·A·min/$m^2$ to 1 KV·A·min/$m^2$, for improving the wettability of general plastic films such as polyester or polyolefin films. The gap clearance between the electrode and the dielectric roll may be from 0.5 to 2.5 mm, preferably from 1.0 to 2.0 mm.

Glow-discharging treatment is the most effective surface treatment for many supports and it may be effected by any known means such as those described in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307, 3,761,299, British Patent 997,093, and JP-A-53-129262.

Regarding the condition for glow-discharging treatment, the pressure may be generally from 0.005 to 20 Torr, preferably from 0.02 to 2 Torr. If the pressure is too low, the surface-treating effect by the treatment would lower. However, if it is too high, such a high pressure would yield a too large current flow to cause sparking dangerously and the treated support would be destroyed. The discharging is yielded by applying a high voltage to a pair or more of metal plates or metal rots as disposed with a distance therebetween in a vacuum tank. The voltage may be varied, depending upon the composition and pressure of the ambient vapor. In general, it may be between 500 V and 5000 V to yield stable constant glow discharging under the pressure of falling within the above-mentioned range. The especially preferred voltage range for improving the adhesiveness of the surface of he support is between 2000 V and 4000 V.

The discharging frequency may be from a direct current to several thousands MHZ, preferably from 50 Hz to 20 MHz, as is so taught by the prior art. The discharging strength may be from 0.01 KV·A·min/$m^2$ to 5 KV·A·min/$m^2$, preferably from 0.15 KV·A·min/$m^2$ to 1 KV·A·min/$m^2$, so as to obtain the intended adhesiveness.

Next, the subbing layer coating methods (2) will be explained below. The two methods have been studied well. For the first subbing layer to be formed in the multi-layer coating method, the characteristics of many polymers such as copolymers composed of, for example, monomers to be selected from vinyl chloride, vinylidene chloride, butadiene, methacrylic acid, acrylic acid, itaconic acid and maleic anhydride, as well as polyethylene-imine, epoxy resins, grafted gelatins, nitrocellulose and other polymers have been studied; and for the second subbing layer to be formed in the same, those of gelatin have been studied essentially.

In many cases of the single layer coating method, the support is first swollen and thereafter a hydrophilic polymer for the subbing layer is applied to the swollen support for interfacial mixing, whereby the adhesiveness of the support is elevated mostly.

As examples of the hydrophilic polymer for the subbing layer employable in the present invention, mentioned are water-soluble polymers, cellulose esters, latex polymers and water-soluble polyesters. As water-soluble polymers, usable are, for example, gelatin, gelatin derivatives, casein, agar, sodium alginate, starch, polyvinyl alcohol, polyacrylic acid copolymers, maleic anhydride copolymers and others. As cellulose esters, usable are, for example, carboxymethyl cellulose, hydroxyethyl cellulose and others. As latex polymers, usable are, for example, vinyl chloride-containing copolymers, vinylidene chloride-containing copolymers, acrylate-containing copolymers, vinyl acetate-containing copolymers, butadiene-containing copolymers and others. Of them, gelatin is the most preferred one.

As compounds to be used for swelling the support in the present invention, mentioned are, for example, resorcinol, chlororesorcinol, methylresorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid, chloral hydrate and others. Of them, preferred are resorcinol and p-chlorophenol.

The subbing layer of the present invention may contain various gelatin hardening agents.

As usable gelatin hardening agents, mentioned are, for example, chromium salts (chromium alum, etc.), aldehydes (formaldehyde, glutaraldehyde, etc.), isocyanates, epichlorohydrin resins, cyanuric chloride compounds (such as those described in JP-B-47-6151, JP-B-47-33380, JP-B-54-25411, JP-A-56-130740), vinylsulfone or sulfonyl compounds (such as those described in JP-B-47-24259, JP-B-50-35807, JP-A-49-24435, JP-A-53-41221, JP-A-59-18944), carbamoylammonium salt compounds (such as those described in JP-B-56-12853, JP-B-58-32699, JP-A-49-51945, JP-A-51-59625, JP-A-61-9641), amidinium salt compounds (such as those described in JP-A-60-225148), carbodiimide compounds (such as those described in JP-A-51-126125, JP-A-52-48311), pyridinium salt compounds (such as those described in JP-B-58-50699, JP-A-52-54427, JP-A-57-44140, JP-A-57-46538), and other compounds described in Belgian Patent 825,726, U.S. Pat. No. 3,321,313, JP-A-50-38540, JP-A-52-93470, JP-A-56-43353, JP-A-58-113929.

The subbing layer of the present invention may also contain fine inorganic or organic grains, as the mat agent, to such a degree that the grains do not detract from the transparency and the graininess of the images to be formed in the photographic material.

As the mat agent comprising fine inorganic grains, usable are silica ($SiO_2$), titanium dioxide ($TiO_2$), calcium carbonate, magnesium carbonate, etc.

As the mat agent comprising fine organic grains, usable are polymethyl methacrylate, cellulose acetate propionate, polystyrene, compounds soluble in processing solutions such as those described in U.S. Pat. No. 4,142,894, and polymers described in U.S. Pat. No. 4,396,706.

As the fine grains for the mat agent, those having a mean grain size of from 1 to 10 μm are preferred.

In addition to them, other various additives may be added to the subbing layer, if desired. For instance, the layer may contain a surfactant, an antistatic agent, an anti-halation agent, a coloring dye, a pigment, a coating aid, an anti-foggant and others. Where a first subbing layer is formed on the support of the present invention, it is quite unnecessary to incorporate an etching agent such as resorcinol, chloral hydrate or chlorophenol to the coating liquid. If desired, however, such an etching agent may of course be incorporated into the subbing layer coating liquid with no problem.

The subbing layer coating liquid may be coated on the support by any well-known method, for example, by dip-coating, air knife-coating, curtain-coating, roller-coating, wire bar-coating, gravure-coating, or by the extrusion coating method of using a hopper as described in U.S. Pat. No. 2,681,294. If desired, two or more layers may be coated simultaneously by the methods described in U.S. Pat. Nos. 2,761,791, 3,508,947, 2,941,898 and 3,526,528 and in Yuji. Harazaki, *Coating Engineering*, page 253 (published by Asakura Shoten KK, 1973).

The binder of the backing layer to be optionally coated on the support of the present invention may be either a hydrophobic polymer or a hydrophilic polymer such as that to be in the subbing layer.

The backing layer in the photographic material of the present invention may contain an antistatic agent, a lubricant agent, a mat agent, a surfactant, a dye and others. The antistatic agent to be in the backing layer is not specifically defined. For instance, it includes anionic polyelectrolytes of polymers containing carboxylic acids, carboxylic acid salts or sulfonic acid salts, such as those described in JP-A-48-22017, JP-B-46-24159, JP-A-51-30725, JP-A-51-129216 and JP-A-55-95942; and cationic polymers such as those described in JP-A-49-121523, JP-A-48-91165 and JP-B-49-24582. The ionic surfactant to be in the layer may be either anionic one or cationic one. For instance, usable are compounds as described in JP-A-49-85826, JP-A-49-33630, U.S. Pat. No. 2,992,108 and 3,206,312, JP-A-48-87826, JP-B-49-11567, JP-B-49-11568 and JP-A-55-70837.

The most preferred antistatic agent to be in the backing layer of the present invention is composed of fine grains of at least one crystalline metal oxide selected from ZnO, $TiO_2$, $SnO_2$, $Al_2O_3$, $In_2O_3$, $SiO_2$, MgO, BaO, $MoO_3$ and $V_2O_5$ or a composite oxide of them.

The fine grains of the conductive crystalline oxide or composite oxide to be usable in the present invention have a volume resistivity of $10^7$ Ωcm or less, more preferably $10^5$ Ωcm or less. The grain size of them is desirably from 0.002 to 0.7 μm, especially preferably from 0.005 to 0.3 μm.

The silver halide color photographic material of the present invention may have a magnetic recording layer for recording various informations therein. The magnetic recording layer may contain any and every known ferromagnetic substance. The magnetic recording layer is preferably formed on the back surface of the support, for example, by coating or printing. The photographic material may also have therein a space in which various informations are optically recorded.

Where the unexposed photographic material of the present invention is loaded in a camera in its use as a roll film, the diameter of the hollow area in the center of the roll film or the diameter of the spool around which the film is wound in the camera is desired to be smaller. However, if it is smaller than 3 mm, the photographic properties of the roll film are noticeably deteriorated due to the pressure of the self weight so that such a small diameter is not practical. Therefore, the diameter is preferably 3 mm or more, and the uppermost limit thereof is preferably 12 mm. More preferably, it is from 3 mm to 10 mm, especially preferably from 4 mm to 9 mm.

The diameter of the spool around which the exposed film is wound is also desired to be smaller. However, if it is smaller than 5 mm, the photographic properties of the roll film are also noticeably deteriorated due to the winding pressure. On the other hand, if it is larger than 15 mm, a film having a large number of frames for exposure cannot be loaded in a camera. Anyway, such a small diameter or such a large diameter of the spool is not practical. Therefore, the diameter is preferably 5 mm or more, and the uppermost limit thereof is preferably 15 mm or less. More preferably, it is from 6 mm to 13.5 mm, especially preferably from 7 mm to 13.5 mm, further preferably from 7 mm to 13 mm.

Next, the acylacetamide-type yellow couplers having the acyl group represented by formula (YI), which are used in the present invention, are mentioned below in detail.

The acylacetamide-type yellow couplers for use in the present invention are preferably those represented by the following formula (YII):

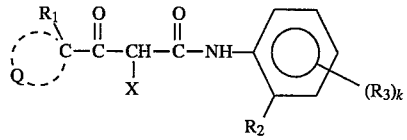

(YII)

wherein $R_1$ represents a substituent except hydrogen; Q represents a non-metallic atomic group necessary for forming, along with C in the formula, a 3-membered to 5-membered hydrocarbon ring or a 3-membered to 6-membered hetero ring having at least one hetero atom selected from among N, S, O and P in the ring; $R_2$ represents a hydrogen atom, a halogen atom (e.g., F, Cl, Br, I), an alkoxy group, an aryloxy group, an alkyl group or an amino group; $R_3$ represents a group substitutable on the benzene ring of the formula; X represents a hydrogen atom or a group which may split off from the formula by the coupling reaction with an oxidation product of an aromatic primary amine developing agent (hereinafter referred to as a "split-off group"); and k represents an integer of from 0 to 4; and when k is a plural number, plural $R_3$'s may be the same or different.

$R_1$ is preferably an organic residue having no metal atom, more preferably a substituted or unsubstituted hydrocarbon group. In the acylacetamide-type yellow couplers for use in the present invention, which are explained hereunder, the halogen atom means F, Cl, Br or I.

As examples of $R_3$, mentioned are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonylamino group, an alkoxysulfonyl group, an aryloxysulfonyl group, an acyloxy group, a nitro group, a heterocyclic group, a cyano group, an acyl group, an acyloxy group, an alkylsulfonyloxy group and an arylsulfonyloxy group. As examples of the split-off group, mentioned are a heterocyclic group that is bonded to the coupling-active position in the formula via its nitrogen atom, and also an aryloxy group, an arylthio group, an alkylsulfonyloxy group, an acyloxy group, an arylsulfonyloxy group, a heterocyclic-oxy group, a heterocyclic-thio group and a halogen atom.

When formula (YII) has alkyl group(s) as the substituent(s) or has substituent(s) containing alkyl moiety/moieties, the alkyl group or alkyl moiety means, unless otherwise specifically defined, a linear, branched or cyclic alkyl group or moiety which may be optionally substituted and which may optionally have unsaturated bond(s) (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, phenoxyethyl).

When formula (YII) has aryl group(s) as the substituent(s) or has substituent(s) containing aryl moiety/moieties, the aryl group or aryl moiety means, unless otherwise specifically defined, a substituted or unsubstituted mono-cyclic or condensed aryl group or moiety (e.g., phenyl, 1-naphthyl, p-tolyl, o-tolyl, p-chlorophenyl, 4-methoxyphenyl , 8-quinolyl, p-4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, 3,4-dichlorophenyl).

When formula (YII) has heterocyclic group(s) as the substituent(s) or has substituent(s) containing heterocyclic moiety/moieties, the heterocyclic group or heterocyclic moiety means, unless otherwise specifically defined, a substituted or unsubstituted, mono-cyclic or condensed heterocyclic group or moiety composed of one or more 3-membered to 8-membered hetero rings each having at least one hetero atom selected from among O, N, S, P, Se and Te in the ring (e.g., 2-furyl, 2-pyridyl, 4-pyridyl, 1-pyrazolyl, 1-imidazolyl, 1-benzotriazolyl, 2-benzotriazolyl, succinimido, phthalimido, 1-benzyl-2,4-imidazolidindion-3-yl).

Substituents which are preferably in formula (YII) are mentioned below.

In formula (YII), $R_1$ is preferably a halogen atom, a cyano group, or a substituted or unsubstituted mono-valent group having from 1 to 30 carbon atoms (C atoms) in total (e.g., an alkyl group, an alkoxy group, an alkylthio group), or a substituted or unsubstituted mono-valent group having from 6 to 30 C atoms (e.g., an aryl group, an aryloxy group, an arylthio group). As the substituents for the groups, for example, mentioned are a halogen atom, an alkyl group, an alkoxy group, a nitro group, an amino group, a carbonamido group, a sulfonamido group, and an acyl group. $R_1$ may also be a so-called ballast group. $R_1$ may be bonded to Q in the formula to form a bicyclic ring.

In formula (YII), Q is preferably a non-metallic atomic group necessary for forming, along with C in the formula, a substituted or unsubstituted, 3-membered to 5-membered hydrocarbon ring having from 3 to 30 C atoms in total, or forming, along with the same, a substituted or unsubstituted hetero ring having from 2 to 30 C atoms in total and having at least one hetero atom selected from among N, S, O and P in the ring. The ring to be formed by Q along with C in the formula may have unsaturated bond(s) in the ring or may be either substituted or unsubstituted. As examples of the ring to be formed by Q along with C in the formula, mentioned are cyclopropane rings, cyclobutane rings, cyclopentane rings, cyclopropene rings, cyclobutene rings, cyclopentene rings, oxetane rings, oxolane rings, oxane rings, 1,3-dioxolane rings, dioxane (1,3- or 1,4-) rings, thiethane rings, thiolane rings, thiane rings, 1,3-dithiolane rings, dithiane (1,3- or 1,4-) rings, 1,4-oxathiane rings, and pyrrolidine rings. As examples of the substituents for the rings, mentioned are those that have been mentioned for $R_3$ hereinabove. In addition, the rings may be substituted by oxo (=O) group(s) or two or more substituents in the ring, if any, may be bonded to one another to form additional ring(s).

In formula (YII), $R_2$ is preferably a halogen atom, a substituted or unsubstituted alkoxy group having from 1 to 30 C atoms in total, a substituted or unsubstituted aryloxy group having from 6 to 30 C atoms in total, a substituted or unsubstituted alkyl group having from 1 to 30 C atoms in total, or a substituted or unsubstituted amino group having from 0 to 30 C atoms in total. As the substituents for the groups, for example, mentioned are a halogen atom, an alkyl group, an alkoxy group, and an aryloxy group.

In formula (YII), $R_3$ is preferably a halogen atom, a substituted or unsubstituted alkyl group having from 1 to 30 C atoms in total, a substituted or unsubstituted aryl group having from 6 to 30 C atoms in total, a substituted or unsubstituted alkoxy group having from 1 to 30 C atoms in total, a substituted or unsubstituted alkoxycarbonyl group having from 2 to 30 C atoms in total, a substituted or unsubstituted aryloxycarbonyl group having from 7 to 30 C atoms in total, a substituted or unsubstituted carbonamido group having from 1 to 30 C atoms in total, a substituted or unsubstituted sulfonamido group having from 1 to 30 C atoms in total, a substituted or unsubstituted carbamoyl group having from 1 to 30 C atoms in total, a substituted or unsubstituted sulfamoyl group having from 0 to 30 C atoms in total, a substituted or unsubstituted alkylsulfonyl group having from 1 to 30 C atoms in total, a substituted or unsubstituted arylsulfonyl group having from 6 to 30 C atoms in total, a substituted or unsubstituted ureido group having from 1 to 30 C atoms in total, a substituted or unsubstituted sulfamoylamino group having from 0 to 30 C atoms in total, a substituted or unsubstituted alkoxycarbonylamino group having from 2 to 30 C atoms in total, a substituted or unsubstituted heterocyclic group having from 1 to 30 C atoms in total, a substituted or unsubstituted acyl group having from 1 to 30 C atoms in total, a substituted or unsubstituted alkylsulfonyloxy group having from 1 to 30 C atoms in total, or a substituted or unsubstituted arylsulfonyloxy group having from 6 to 30 C atoms in total. As the substituents for the groups, for example, mentioned are a halogen atom, an alkyl group, an aryl group, a heterocyclic group, an alkoxy group, an aryloxy group, a heterocyclic-oxy group, an alkylthio group, an arylthio group, a heterocyclic-thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, an ureido group, a cyano group, a nitro group, an acyloxy group, an alkoxycarbonyl group, an aryloxycarbonyl group, an alkylsulfonyloxy group, and an arylsulfonyloxy group.

In formula (YII), k is preferably an integer of 1 or 2, and the position of $R_3$ is preferably the meta- or para-position relative to the acylacetamido group.

In formula (YII), X is preferably a heterocyclic group which is bonded to the coupling-active position in the formula via its nitrogen atom or is an aryloxy group.

When X is such a heterocyclic group, it is preferably a group of a substituted or unsubstituted, 5-membered to 7-membered, mono-cyclic or condensed hetero ring. As examples of the ring, mentioned are succinimides, maleinimides, phthalimide, diglycolimides, pyrroles, pyrazoles, imidazoles, 1,2,4-triazoles, tetrazoles, indoles, indazoles, benzimidazoles, benzotriazoles, imidazolidine-2,4-diones, oxazolidine-2,4-diones, thiazolidine-2,4-diones, imidazolidin-2-ones, oxazolidin-2-ones, thiazolidin-2-ones, benzimidazolin-2-ones, benzoxazolin-2-ones, benzothiazolin-2-ones,2-pyrrolin-5-ones, 2-imidazolin-5-ones, indoline-2,3-diones, 2,6-dioxypurines, parabanic acids, 1,2,4-triazolidine-3,5-diones, 2-pyridones,4-pyridones,2-pyrimidones, 6-pyridazones, 2-pyrazones,2-amino-1,2,4-thiazolidines, and 2-imino-1,3,4-thiazolidin-4-ones. These hetero rings may optionally be substituted.

As examples of the substituents for these hetero rings, mentioned are a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, an ureido group, an alkoxycarbonylamino group, and a sulfamoylamino group.

When X is an aryloxy group, it preferably has from 6 to 30 C atoms in total. It may be substituted by substituent(s) selected from among the substituents mentioned hereinabove for the hetero ring for X. As the substituents for the aryloxy group, preferred are a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, and a cyano group.

Especially preferred substituents to be in formula (YII) are mentioned below.

$R_1$ is especially preferably an alkyl group having from 1 to 30 C atoms in total (e.g., methyl, ethyl, n-propyl, n-butyl, isobutyl, n-octyl, n-dodecyl, phenoxymethyl, phenylthiomethyl, p-toluenesulfonylmethyl, benzyl, cyclohexylmethyl, methoxymethyl), and is most preferably an alkyl group having from 1 to 4 C atoms in total.

Q is especially preferably a non-metallic atomic group necessary for forming, along with C in the formula, a 3-membered to 5-membered hydrocarbon ring. For example, it is a substituted or unsubstituted ethylene, trimethylene or tetramethylene group. As the substituents for the groups, for example, mentioned are an alkyl group, an alkoxy group, an aryl group, and a halogen atom.

Q is most preferably a substituted or unsubstituted ethylene group.

$R_2$ is especially preferably a chlorine atom, a fluorine atom, an alkyl group having from 1 to 6 C atoms in total (e.g., methyl, trifluoromethyl, ethyl, isopropyl, t-butyl), an alkoxy group having from 1 to 30 C atoms in total (e.g., methoxy, ethoxy, methoxyethoxy, butoxy, hexadecyloxy), or an aryloxy group having from 6 to 24 C atoms in total (e.g., phenoxy, p-tolyloxy, p-methoxyphenoxy). It is most preferably a chlorine atom, a methoxy group or a trifluoromethyl group.

$R_3$ is especially preferably a halogen atom, a cyano group, a trifluoromethyl group, an alkoxy group, an alkoxycarbonyl group, an aryloxycarbonyl group, a carbonamido group, a sulfonamido group, a carbamoyl group, or a sulfamoyl group. It is most preferably a chlorine atom, an alkoxy group, an alkoxycarbonyl group, a sulfamoyl group, a carbonamido group, or a sulfonamido group.

X is especially preferably a group represented by the following formula (Y-1), (Y-2) or (Y-3):

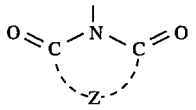
(Y-1)

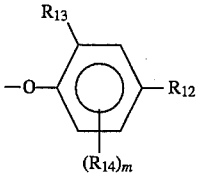
(Y-2)

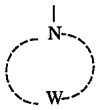
(Y-3)

In formula (Y-1), Z represents —O—$CR_4(R_5)$—, —S—$CR_4(R_5)$—, —$NR_6$—$CR_4(R_5)$—, —$NR_6$—$NR_7$—, —$NR_6$—C(=O)—,—$CR_4(R_5)$— $CR_8(R_9)$— or —$CR_{10}$=$CR_{11}$—.

$R_4$, $R_5$, $R_8$ and $R_9$ each represents a hydrogen atom, an alkyl group, an aryl group, an alkoxy group, an aryloxy group, an alkylthio group, an arylthio group, an alkylsulfonyl group, an arylsulfonyl group or an amino group. $R_6$ and $R_7$ each represents a hydrogen atom, an alkyl group, an aryl group, an alkylsulfonyl group, an arylsulfonyl group or an alkoxycarbonyl group. $R_{10}$ and $R_{11}$ each represents a hydrogen atom, an alkyl group or an aryl group. $R_{10}$ and $R_{11}$ may be bonded to each other to form a benzene ring. $R_4$ and $R_5$; $R_5$ and $R_6$; $R_6$ and $R_7$; or $R_4$ and $R_8$ may be bonded to each other to form a ring (e.g., cyclobutane, cyclohexane, cycloheptane, cyclohexene, pyrrolidine, piperidine)

Of the heterocyclic groups represented by formula (Y-1) , especially preferred are those of formula (Y-1) where Z is —O—$CR_4(R_5)$—, —$NR_6$—$CR_4(R_5)$— or —$NR_6$—$NR_7$—. The heterocyclic group represented by formula (Y-1) has from 2 to 30, preferably from 4 to 20, more preferably from 5 to 16, C atoms in total.

In formula (Y-2), at least one of $R_{12}$ and $R_{13}$ is selected from among a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group and an acyl group, while the other may be a hydrogen atom, an alkyl group or an alkoxy group. $R_{14}$ has the same meaning as $R_{12}$ or $R_{13}$, and m is 0, 1 or 2. The aryloxy group represented by formula (Y-2) has from 6 to 30, preferably from 6 to 24, more preferably from 6 to 15, C atoms in total.

In formula (Y-3), W represents a non-metallic atomic group necessary for forming, along with N in the formula, a pyrrole ring, a pyrazole ring, an imidazole ring or a triazole ring. The ring to be formed by W and N in the formula (Y-3) may have substituent(s). As preferred examples of the substituents, mentioned are a halogen atom, a nitro group, a cyano group, an alkoxycarbonyl group, an alkyl group, an aryl group, an amino group, an alkoxy group, an aryloxy group and a carbamoyl group. The number of C atoms in the heterocyclic group represented by formula (Y-3) is from 2 to 30, preferably from 2 to 24, more preferably from 2 to 16, in total.

X is most preferably the group represented by formula (Y-1).

The coupler represented by formula (YII) may form a dimer or a higher polymer, in which the substituent(s) $R_1$, $R_2$, $R_3$, Q and/or X is/are bonded to the other one(s) via a chemical bond or a di-valent or higher poly-valent group. To such dimers or higher polymers, the above-mentioned definition for the number of the carbon atoms in the substituents therein shall not apply.

Specific examples of yellow couplers represented by formula (YII) are mentioned below, which, however, are not limitative.

(Y-1)

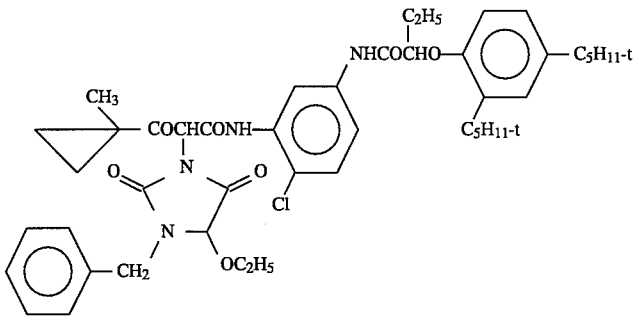

(Y-2)

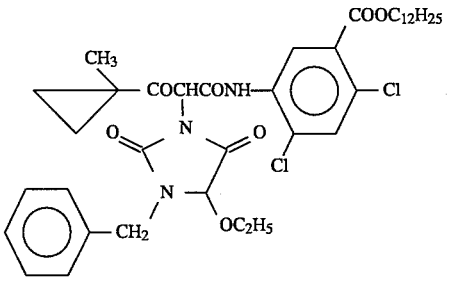

(Y-3)

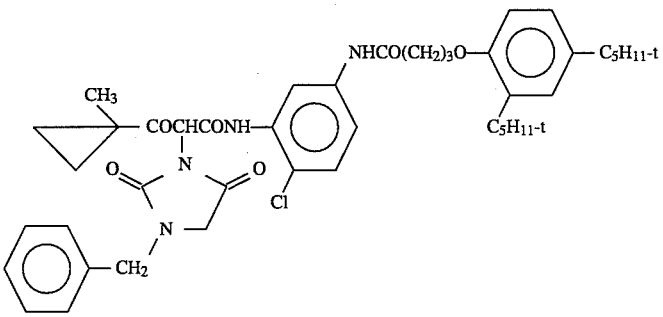

(Y-4)

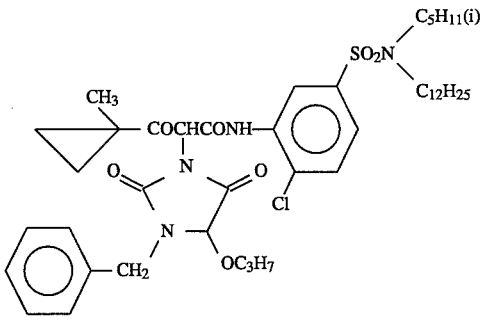

(Y-5)

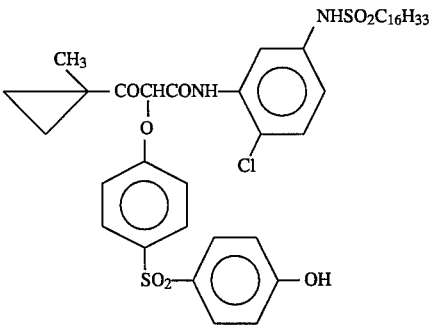

-continued
(Y-6)
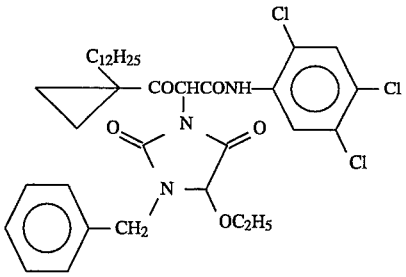
(Y-7)
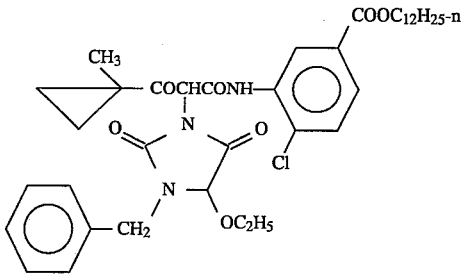
(Y-8)
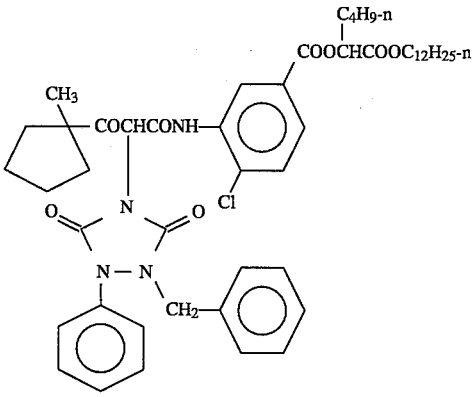
(Y-9)
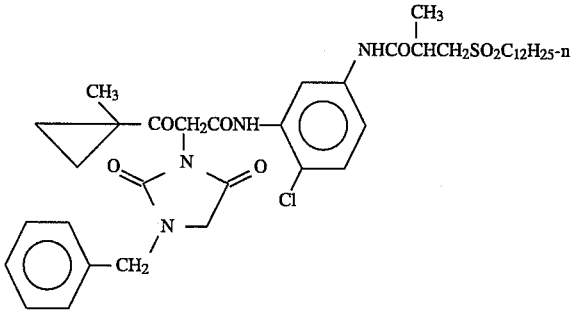
(Y-10)
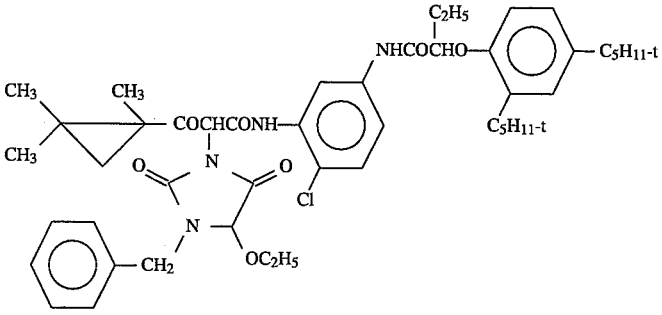
(Y-11)
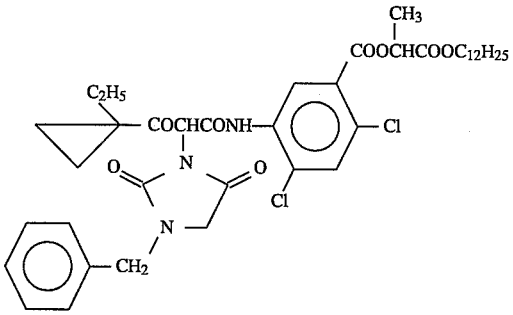
(Y-12)
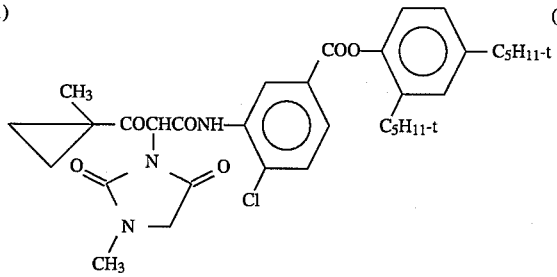

-continued
(Y-13)
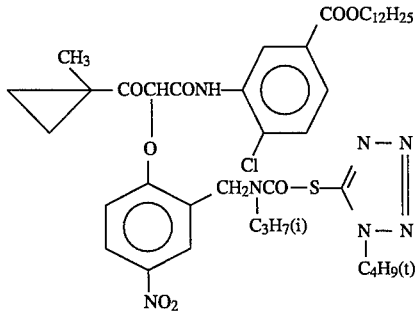
(Y-14)
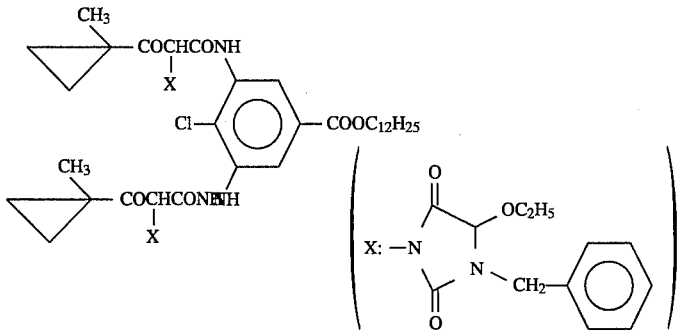
(Y-15)
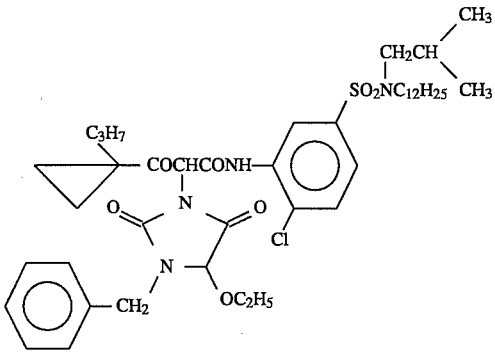
(Y-16)
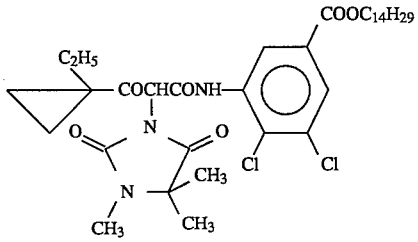
(Y-17)
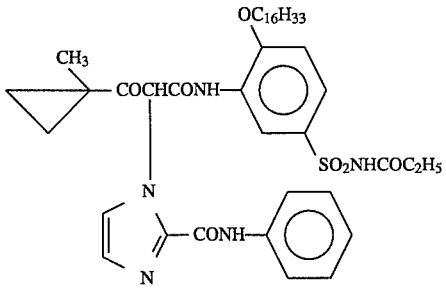
(Y-18)
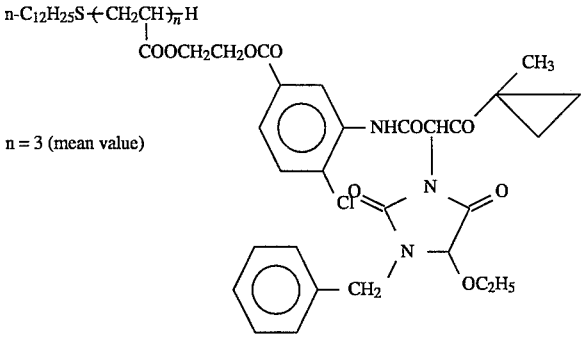
n = 3 (mean value)

-continued
(Y-19)
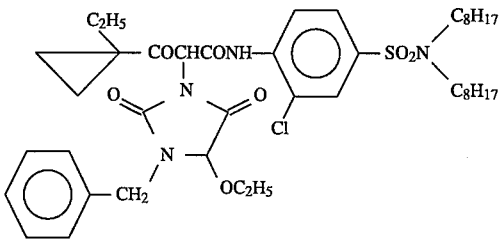
(Y-20)
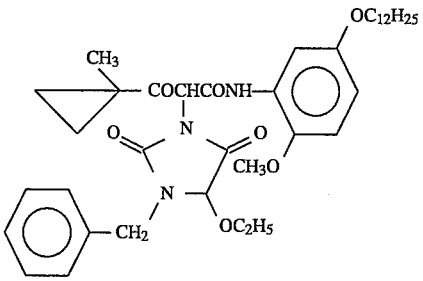
(Y-21)
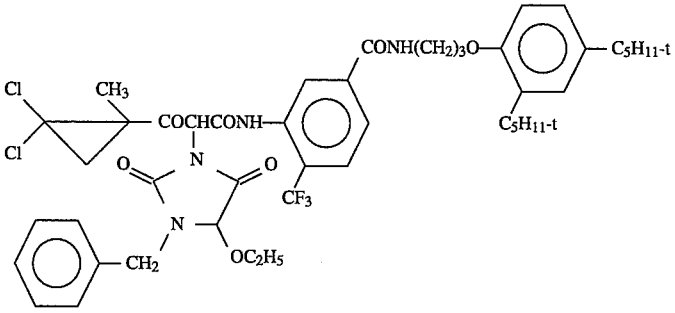
(Y-22)
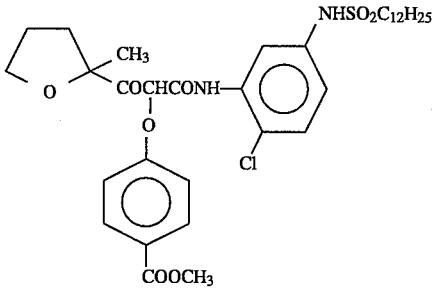
(Y-23)
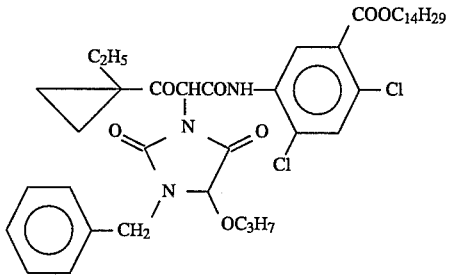
(Y-24)
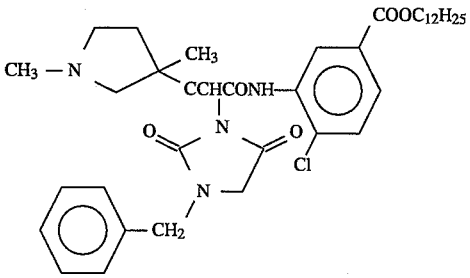
(Y-25)
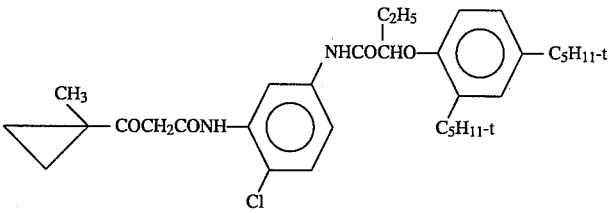

-continued
(Y-26)
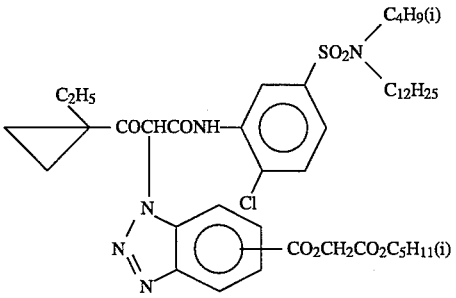
(Y-27)
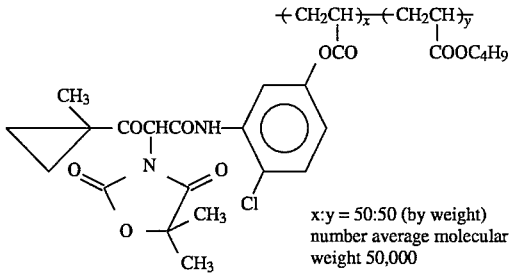
(Y-28)
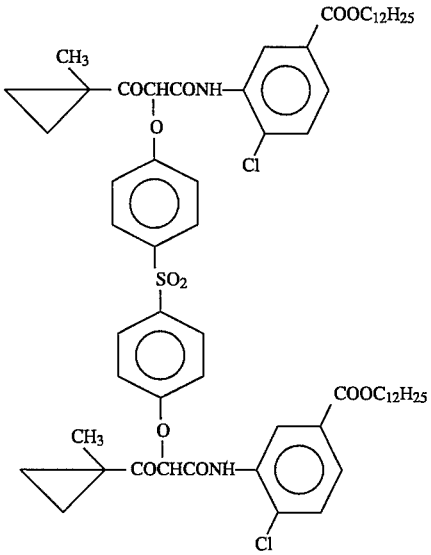
(Y-29)
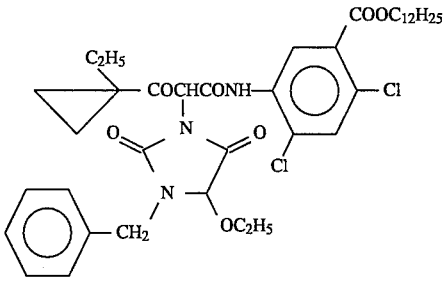
(Y-30)
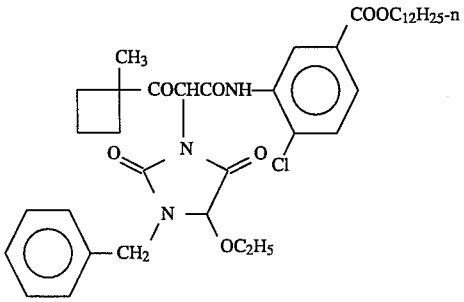
(Y-31)
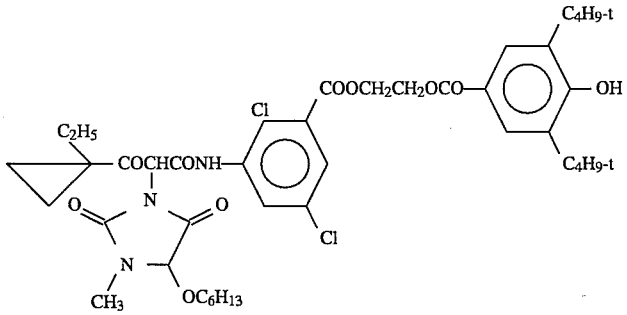

-continued
(Y-32)
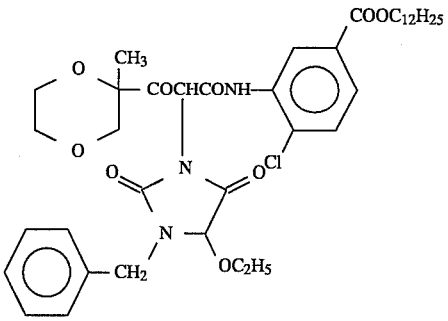
(Y-33)
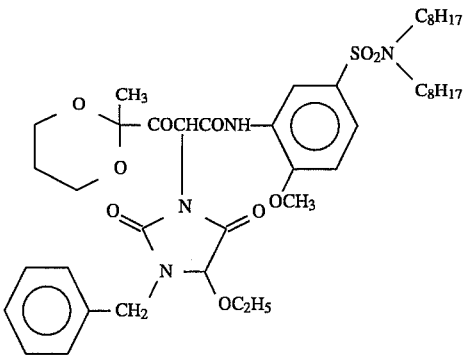
(Y-34)
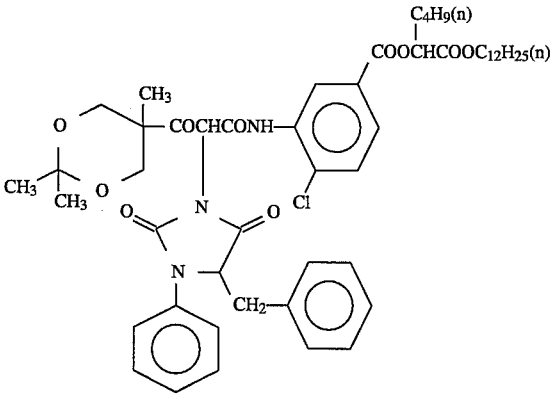
(Y-35)
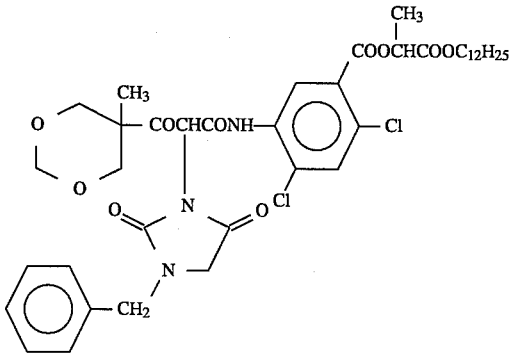
(Y-36)
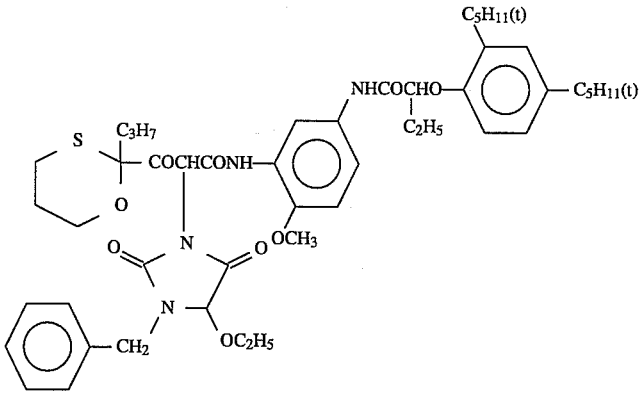

-continued
(Y-37)
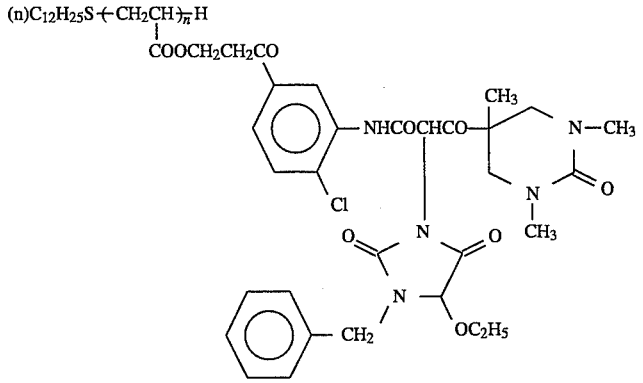
(Y-38)
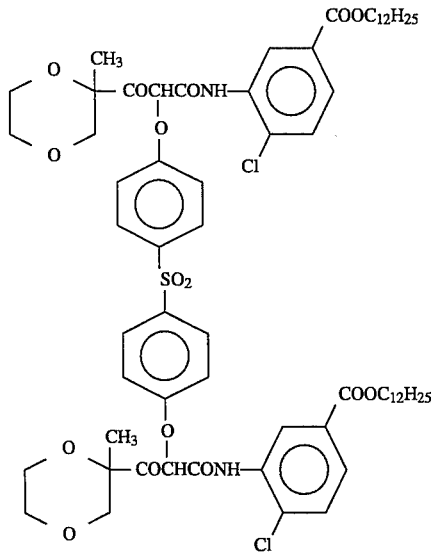
(Y-39)
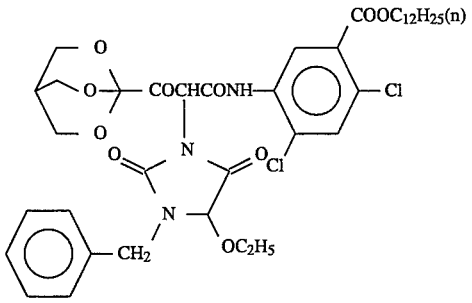
(Y-40)
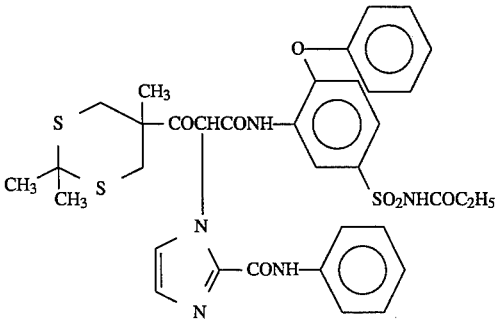
(Y-41)
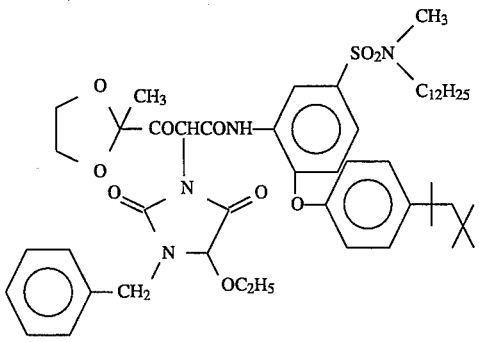
(Y-42)
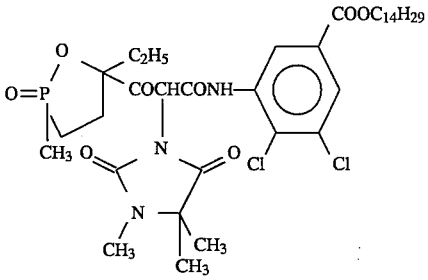
(Y-43)
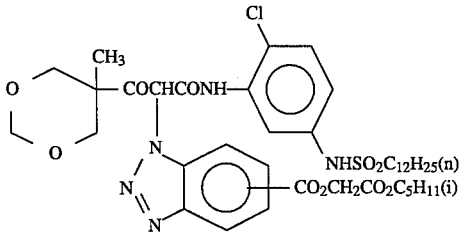

-continued (Y-44)

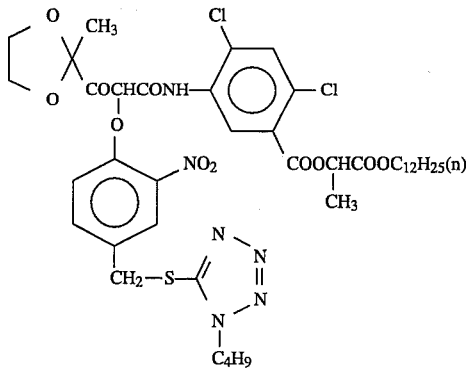

(Y-45)

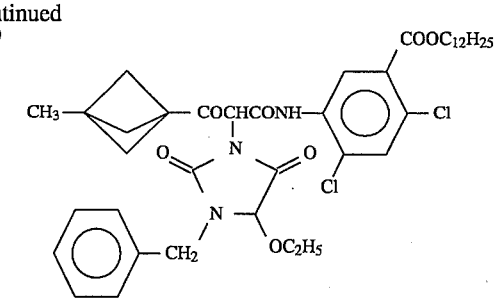

(Y-46)

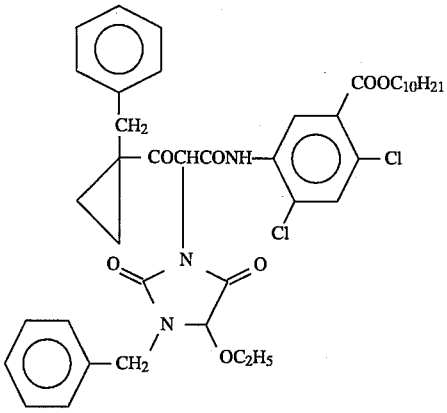

The yellow couplers represented by formula (YII) may be produced by known methods, for example, by the methods described in EP-A-447969 and U.S. Pat. No. 5,118,599.

The couplers represented by formula (YII) may be incorporated into any layers constituting the photographic material of the present invention. For instance, they may be incorporated into any of the light-sensitive layers (blue-sensitive emulsion layers, green-sensitive emulsion layers, red-sensitive emulsion layer) and the light-insensitive layers (e.g., protective layers, yellow filter layers, interlayers, antihalation layers) of the photographic material. Especially preferably, they are incorporated into the blue-sensitive emulsion layers or the adjacent light-insensitive layers.

The preferred amount of the coupler represented by formula (YII) to be in the photographic material is from 0.001 to 5.0 mmol/m$^2$, more preferably from 0.01 to 2.0 mmol/m$^2$.

Where the couplers represented by formula (YII) are incorporated into the light-sensitive layers of the photographic material, the preferred molar ratio of the coupler to the silver halide in the layer may be from 1:0.1 to 1:200, more preferably from 1:2 to 1:150. Where they are incorporated into the light-insensitive layers of the photographic material, the preferred amount of the coupler in the layer may be from 0.001 to 1.0 mmol/m$^2$, more preferably from 0.005 to 0.5 mmol/m$^2$.

The couplers represented by formula (YII) may of course be employed singly, but they are preferably employed along with the couplers represented by formula (1) or (2) which will be mentioned hereinafter. In addition, they may also be employed along with other known yellow couplers (for example, benzoylacetanilide-type yellow couplers, pivaloylacetanilide-type yellow couplers).

The couplers represented by formula (YII) of the present invention have a high coloring property and may form color images with high fastness. In particular, since they have an excellent spectral absorption characteristic in that their spectral absorption in the long wavelength range (the green light region) is small, their color reproducibility is excellent and the sharpness of the color images to be derived from them is excellent. As the couplers represented by formula (YII) are incorporated into the photographic material having the particular polyester support of the present invention, the color image fastness of the photographic material is much improved and the stability of the photographic material during its storage is also improved.

Where the couplers represented by formula (YII) are incorporated into the photographic material of the present invention in the form of a dispersion of their fine emulsion that is formed by an oil-in-water dispersion method using high boiling point organic solvents which will be mentioned hereinafter, the amount of the high boiling point organic solvent to be used may be reduced, relative to the amount of the coupler, still maintaining the excellent characteristics, such as the high coloring property, of the couplers. For these reasons, the couplers represented by formula (YII) are preferably incorporated into the blue-sensitive layer which is positioned in the side remoter from the support of the photographic material for taking pictures (that is, in the side nearer to the incident rays), whereby the thickness of the photographic material may be reduced and the sharpness of the light-sensitive layers nearer to the support is advantageously improved.

Next, the couplers represented by the above-mentioned formulae (1) and (2) will be mentioned in detail hereunder.

Where $X_1$ and $X_2$ each is an alkyl group, the alkyl group is a linear, branched or cyclic, saturated or unsaturated, substituted or unsubstituted alkyl group having from 1 to 30, preferably from 1 to 20, carbon atoms. As examples of the alkyl group, mentioned are a methyl group, an ethyl group, a propyl group, a butyl group, a cyclopropyl group, an allyl group, a t-octyl group, an i-butyl group, a dodecyl group, and a 2-hexyldecyl group.

Where $X_1$ and $X_2$ each is a heterocyclic group, the heterocyclic group is a saturated or unsaturated, substituted or unsubstituted, mono-cyclic or condensed heterocyclic group composed of 3-membered to12-membered, preferably 5-membered or 6-membered, ring(s) having from 1 to 20, preferably from 1 to 10, carbon atoms and having at least one hetero atom, for example, selected from among nitrogen, oxygen and sulfur atoms. As examples of the heterocyclic group, mentioned are a 3-pyrrolidinyl group, a 1,2,4-triazol-3-yl group, a2-pyridyl group, a 4-pyrimidinyl group, a 3-pyrazolyl group, a 2-pyrrolyl group, a 2,4-dioxo-1,3-imidazolidin-5-yl group and a pyranyl group.

Where $X_1$ and $X_2$ each is an aryl group, the aryl group is a substituted or unsubstituted aryl group having from 6 to 20, preferably from 6 to 10, carbon atoms. As examples of the aryl group, typically mentioned are a phenyl group and a naphthyl group.

Where $X_3$ forms a nitrogen-containing heterocyclic group along with >N— in the formula, the heterocyclic group is a substituted or unsubstituted, saturated or unsaturated, monocyclic or condensed heterocyclic group composed of 3-membered to 12-membered, preferably 5-membered or 6-membered, ring(s) having from 1 to 20, preferably from 1 to 15, carbon atoms and optionally having hetero atom(s), for example, selected from among oxygen and sulfur atoms in addition to the nitrogen atom in the formula. As examples of the heterocyclic group, mentioned are a pyrrolidino group, a piperidino group, a morpholino group, a 1-piperazinyl group, a 1-indolinyl group, a 1,2,3,4-tetrahydroquinolin-1-yl group, a 1-imidazolidinyl group, a 1-pyrazolyl group, a 1-pyrolinyl group, a 1-pyrazolidinyl group, a 2,3-dihydro-1-indazoline group, a 2-isoindolinyl group, a 1-indolyl group, a 1-pyrrolyl group, a 4-thiazine-S,S-dioxo-4-yl group and a benzoxazin-4-yl group.

Where $X_1$ and $X_2$ each is a substituted alkyl, aryl or heterocyclic group and where the nitrogen-containing heterocyclic group to be formed by $X_3$ and >N— has substituent(s), the substituents for the groups include, for example, a halogen atom (e.g., fluorine, chlorine), an alkoxycarbonyl group (having from 2 to 30, preferably from 2 to 20, carbon atoms; such as methoxycarbonyl, hexadecyloxycarbonyl), an acylamino group (having from 2 to 30, preferably from 2 to 20, carbon atoms; such as acetamido, tetradecanamido, 2-(2,4-di-t-amylphenoxy)butanamido, benzamido), a sulfonamido group (having from 1 to 30, preferably from 1 to 20, carbon atoms; such as methanesulfonamido, hexadecylsulfonamido, benzenesulfonamido), a carbamoyl group (having from 1 to 30, preferably from 1 to 20, carbon atoms; such as N-butylcarbamoyl, N,N-diethylcarbamoyl), an N-sulfonylcarbamoyl group (having from 1 to 30, preferably from 1 to 20, carbon atoms; such as N-mesylcarbamoyl, N-dodecylsulfonylcarbamoyl), a sulfamoyl group (having from 0 to 30, preferably from 1 to 20, carbon atoms; such as N-butylsulfamoyl, N-hexadecylsulfamoyl, N-3-(2,4-di-t-amylphenoxy)butylsulfamoyl, N,N-diethylsulfamoyl), an alkoxy group (having from 1 to 30, preferably from 1 to 20, carbon atoms; such as methoxy, hexadecyloxy, isopropoxy), an aryloxy group (having from 6 to 20, preferably from 6 to 10, carbon atoms; such as phenoxy, 4-methoxyphenoxy, 3-t-butyl-4-hydroxyphenoxy, naphthoxy), an aryloxycarbonyl group (having from 7 to 21, preferably from 7 to 11, carbon atoms; such as phenoxycarbonyl), an N-acylsulfamoyl group (having from 2 to 30, preferably from 2 to 20, carbon atoms; such as N-propanoylsulfamoyl, N-tetradecanoylsulfamoyl), a sulfonyl group (having from 1 to 30, preferably from 1 to 20, carbon atoms; such as methanesulfonyl, 4-hydroxyphenylsulfonyl, dodecanesulfonyl), an alkoxycarbonylamino group (having from 2 to 30, preferably from 2 to 20, carbon atoms; such as ethoxycarbonylamino), a cyano group, a nitro group, a carboxyl group, a hydroxyl group, a sulfo group, an alkylthio group (having from 1 to 30, preferably from 1 to 20, carbon atoms; such as methylthio, dodecylthio, dodecylcarbamoylmethylthio), an ureido group (having from 1 to 30, preferably from 1 to 20, carbon atoms; such as N-phenylureido, N-hexadecylureido), an aryl group (having from 6 to 20, preferably from 6 to 10, carbon atoms; such as phenyl, naphthyl, 4-methoxyphenyl), a heterocyclic group (having from 1 to 20, preferably from 1 to 10, carbon atoms and composed of 3-membered to 12-membered, preferably 5-membered or 6-membered, mono-cyclic or condensed hetero rings each having at least one hetero atom selected from, for example, nitrogen, oxygen and sulfur atoms; such as 2-pyridyl, 3-pyrazolyl, 1-pyrrolyl, 2,4-dioxo-1,3-imidazolidin-1-yl ,2-benzoxazolyl, morpholino, indolyl), an alkyl group (linear, branched or cyclic, saturated or unsaturated alkyl group having from 1 to 30, preferably from 1 to 20, carbon atoms; such as methyl, isopropyl, cyclopropyl, t-octyl, cyclopentyl, s-butyl, 2-hexyldecyl), an acyl group (having from 2 to 30, preferably from 2 to 20, carbon atoms; such as acetyl, benzoyl), an acyloxy group (having from 2 to 30, preferably from 2 to 20, carbon atoms; such as propanoyloxy, tetradecanoyloxy), an arylthio group (having from 6 to 20, preferably from 6 to 10, carbon atoms; such as phenylthio, naphthylthio), a sulfamoylamino group (having from 0 to 30, preferably from 0 to 20, carbon atoms; such as N-butylsulfamoylamino, N-dodecylsulfamoylamino, N-phenylsulfamoylamino) and an N-sulfonylsulfamoyl group (having from 1 to 30, preferably from 1 to 20, carbon atoms; such as N-mesylsulfamoyl, N-ethanesulfonylsulfamoyl, N-docecanesulfonylsulfamoyl, N-hexadecanesulfonylsulfamoyl). These substituents may be substituted by substituent(s). As examples of the substituents, those now mentioned herein are referred to.

Of the above-mentioned substituents, preferred are an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group and an aryl group.

Where Y in formulae (1) and (2) is an aryl group, it is a substituted or unsubstituted aryl group having from 6 to 20, preferably from 6 to 10, carbon atoms. As specific examples thereof, mentioned are a phenyl group and a naphthyl group.

Where Y in formulae (1) and (2) is a heterocyclic group, it may have the same meaning as the above-mentioned heterocyclic group of $X_1$ and $X_2$.

Y may be a substituted aryl or heterocyclic group. As examples of the substituents, those mentioned for the substituted groups of $X_1$ hereinabove are referred to. As preferred examples of the substituents for Y, one of them is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

Y is especially preferably a phenyl group having at least one substituent at its ortho-position.

Z in formulae (1) and (2) may be any of known coupling-split-off groups. Preferably, Z is a nitrogen-containing heterocyclic group that is bonded to the coupling position of the formula via its nitrogen atom, or is an aryloxy group, an arylthio group, a heterocyclic-oxy group, a heterocyclic-thio group, an acyloxy group, a carbamoyloxy group, an alkylthio group or a halogen atom.

The split-off group may be any of non-photographically useful groups and photographically useful groups and their precursors (e.g., residues of development inhibitors, development accelerators, desilvering accelerators, foggants, dyes, hardening agents, couplers, scavengers for oxidation products of developing agents, fluorescent dyes, developing agents, electron transferring agents).

Where Z is a photographically useful group, it may be any known one. For instance, it may be selected from among known photographically useful groups or split-off groups for releasing them (e.g., timing groups) such as those described in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, EP-A-193389, EP-A-348139, and EP-A-272573.

Where Z is a nitrogen-containing heterocyclic group that is bonded to the coupling position of the formula via its nitrogen atom, the nitrogen-containing heterocyclic group is preferably a substituted or unsubstituted, saturated or unsaturated, mono-cyclic or condensed heterocyclic group composed of 5-membered or 6-membered ring(s) having from 1 to 15, preferably from 1 to 10, carbon atoms. The group may have, as the hetero atoms, oxygen and/or sulfur atom(s) in addition to the nitrogen atom(s). As preferred examples of the heterocyclic group, mentioned are a 1-pyrazolyl group, a 1-imidazolyl group, a pyrrolino group, a 1,2,4-triazol-2-yl group, a 1,2,3-triazol-1-yl group, a benzotriazolyl group, a benzimidazolyl group, an imidazolidine-2,4-dion-3-yl group, an oxazolidine-2,4-dion-3-yl group, a 1,2,4-triazolidine-3,5-dion-4-yl group, an imidazolidine-2,4,5-trion- 3-yl group, a 2-imidazolinon-1-yl group, a 3,5-dioxomorpholino group and a1-indazoline group. The heterocyclic group may have substituent(s). As examples of the substituents, those mentioned for $X_1$ hereinabove are referred to. As preferred examples of the substituents for the substituted heterocyclic group of Z, one of them is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, a cyano group or a sulfonyl group.

Where Z is an aryloxy group, it is preferably a substituted or unsubstituted aryloxy group having from 6 to 10 carbon atoms. Especially preferably, it is a substituted or unsubstituted phenoxy group. For the substituents for the substituted aryloxy group, those mentioned for $X_1$ hereinabove are referred to. Above all, it is preferred that at least one substituent aryloxy for the group is an electron-attracting substituent. As examples of the substituent, mentioned are a sulfonyl group, an alkoxycarbonyl group, a sulfamoyl group, a halogen atom, a carbamoyl group, a nitro group, a cyano group and an acyl group.

Where Z is an arylthio group, it is preferably a substituted or unsubstituted arylthio group having from 6 to 10 carbon atoms. Especially preferably, it is a substituted or unsubstituted phenylthio group. For the substituents for the substituted arylthio group of Z, those mentioned for $X_1$ hereinabove are referred to. As preferred examples of the substituents for the substituted arylthio group, one of them is an alkyl group, an alkoxy group, a sulfonyl group, an alkoxycarbonyl group, a sulfamoyl group, a halogen atom, a carbamoyl group or a nitro group.

Where Z is a heterocyclic-oxy group, the heterocyclic moiety in the group is a substituted or unsubstituted, saturated or unsaturated, mono-cyclic or condensed heterocyclic group composed of 3-membered to 12-membered, preferably 5-membered or 6-membered, hetero ring(s) having from 1 to 20, preferably from 1 to 10, carbon atoms and having at least one hetero atoms selected from among, for example, nitrogen, oxygen and sulfur atoms. As examples of the heterocyclic-oxy group, mentioned are a pyridyloxy group, a pyrazolyloxy group and a furyloxy group. For the substituents for the substituted heterocyclic-oxy group of Z, those mentioned for $X_1$ hereinabove are referred to. As preferred examples of the substituents for the substituted heterocyclic-oxy group, one of them is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group.

Where Z is a heterocyclic-thio group, the heterocyclic moiety in the group is a substituted or unsubstituted, saturated or unsaturated, mono-cyclic or condensed heterocyclic group composed of 3-membered to 12-membered, preferably 5-membered or 6-membered, hetero ring(s) having from 1 to 20, preferably from 1 to 10, carbon atoms and having at least one hetero atoms selected from among, for example, nitrogen, oxygen and sulfur atoms. As examples of the heterocyclic-thio group, mentioned are a tetrazolylthio group, a 1,3,4-thiadiazolylthio group, a 1,3,4-oxadiazolylthio group, a 1,3,4-triazolylthio group, a benzimidazolylthio group, a benzothiazolylthio group and a 2-pyridylthio group. For the substituents for the substituted heterocyclic-thio group of Z, those mentioned for $X_1$ hereinabove are referred to. As preferred examples of the substituents for the substituted heterocyclic-thio group, one of them is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group or a sulfonyl group.

Where Z is an acyloxy group, it is preferably a monocyclic or condensed, substituted or unsubstituted arylacyloxy group having from 6 to 10 carbon atoms, or is a substituted or unsubstituted alkylacyloxy group having from 2 to 30, preferably from 2 to 20, carbon atoms. For the substituents for the substituted acyloxy group of Z, those mentioned for $X_1$ hereinabove are referred to.

Where Z is a carbamoyloxy group, it is a substituted or unsubstituted, alkyl-, aryl- or heterocyclic-carbamoyloxy group having from 1 to 30, preferably from 1 to 20, carbon atoms. For instance, it includes an N,N-diethylcarbamoyloxy group, an N-phenylcarbamoyloxy group, a 1-imidazolylcarbonyloxy group or a 1-pyrrolocarbonyloxy group. For the substituents for the substituted carbamoyloxy group of Z, those mentioned for $X_1$ hereinabove are referred to.

Where Z is an alkylthio group, it is linear, branched or cyclic, saturated or unsaturated, substituted or unsubstituted alkylthio group having from 1 to 30, preferably from 1 to 20, carbon atoms. For the substituents for the substituted alkylthio group of Z, those mentioned for $X_1$ hereinabove are referred to.

Especially preferred ranges of the couplers represented by formulae (1) and (2) are mentioned below.

In formula (1), $X_1$ is preferably an alkyl group, especially preferably an alkyl group having from 1 to 10 carbon atoms.

In formulae (1) and (2), Y is preferably an aryl group, especially preferably a phenyl group having at least one substituent at its ortho-position. As examples of the substituents for the group, those mentioned for Y of being a substituted aryl group are referred to. The same shall apply also to the preferred examples of the substituents.

In formulae (1) and (2), Z is preferably a 5-membered or 6-membered, nitrogen-containing heterocyclic group that is bonded to the coupling position in the formula via its nitrogen atom, or is an aryloxy group, a 5-membered or 6-membered heterocyclic-oxy group, or a 5-membered or 6-membered heterocyclic-thio group.

Of the couplers represented by formula (1) or (2), preferred are those of the following formula (3), (4) or (5):

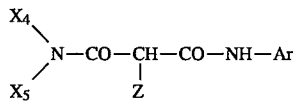

(3)

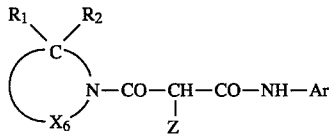

(4)

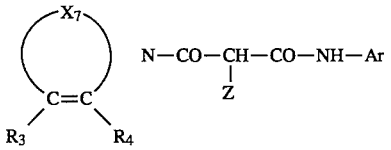

(5)

In these formulae, Z has the same meaning as that in formula (1); $X_4$ represents an alkyl group; $X_5$ represents an alkyl group or an aryl group; Ar represents a phenyl group having at least one substituent at its ortho-position; $X_6$ represents an organic residue for forming, along with —C($R_1R_2$)—N< in the formula, a mono-cyclic or condensed, nitrogen-containing heterocyclic group; $X_7$ represents an organic residue for forming, along with —C($R_3$)=C($R_4$)—N< in the formula, a mono-cyclic or condensed, nitrogen-containing heterocyclic group; and $R_1$, $R_2$, $R_3$ and $R_4$ each represents a hydrogen atom or a substituent.

For the detailed explanations and preferred ranges of $X_4$ to $X_7$ and Z in formulae (3) to (5), the corresponding parts in those of the substituents in formulae (1) and (2) are referred to. Where $R_1$ to $R_4$ have substituent(s), the substituents for $X_1$ mentioned hereinabove are referred to.

Of the couplers of the above-mentioned formulae, those represented by formulae (4) and (5) are preferred.

The coupler represented by each of formulae (1) to (5) may form a bis-form or a dimer or a higher polymer (e.g., teromer, etc.), in which the substituent(s) $X_1$ to $X_7$, Y, Ar, $R_1$ to $R_4$ and Z is/are bonded to the other one(s) via a chemical bond or a di-valent or higher poly-valent group. To such bis-forms, dimers or higher polymers, the above-mentioned definition for the number of the carbon atoms in the substituents therein shall not apply.

The couplers represented by each of formulae (1) to (5) are preferably non-diffusive couplers. Non-diffusive couplers are such that they contain, in their molecules, group(s) (non-diffusive group(s)) capable of making the molecular weight of the coupler sufficiently large so as to passivate the molecule of the coupler in the layer to which the coupler has been added. As such non-diffusive groups, generally employed are an alkyl group having from 8 to 30, preferably from 10 to 20 carbon atoms in total, and an aryl group having from 4 to 20 carbon atoms in total. These non-diffusive groups may be positioned at any sites in the molecule of the coupler, and one molecule of the coupler may have two or more of them.

Specific examples of the couplers represented by each of formulae (1) to (5) as well as those of other yellow couplers employable in the present invention are mentioned below, which, however, are not limitative.

YB-1

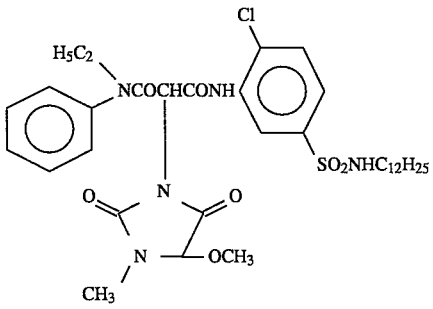

YB-2

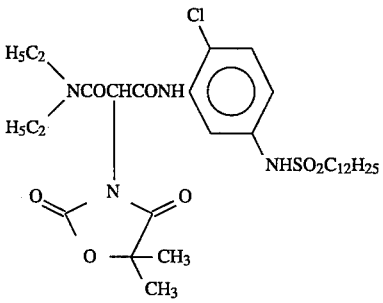

YB-3

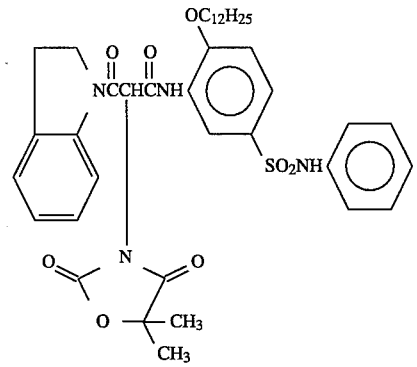

YB-4

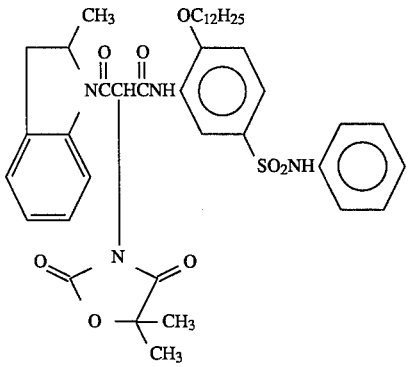

-continued
YB-5
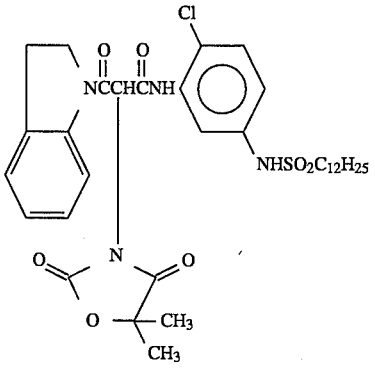
YB-6
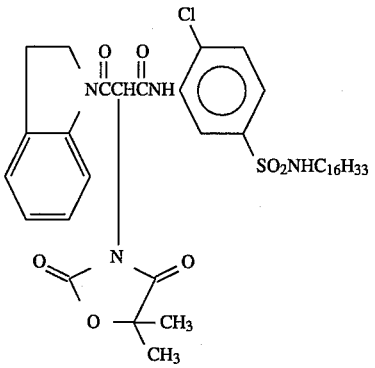
YB-7
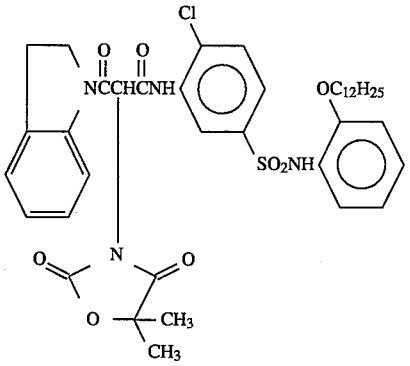
YB-8
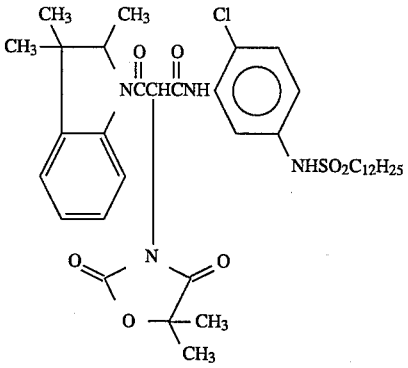
YB-9
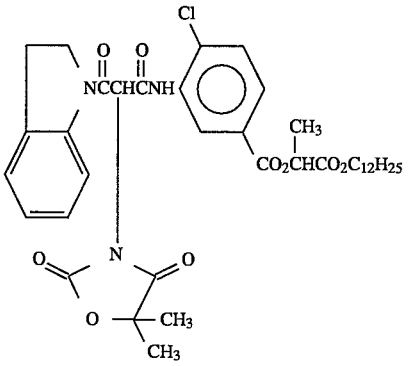
YB-10
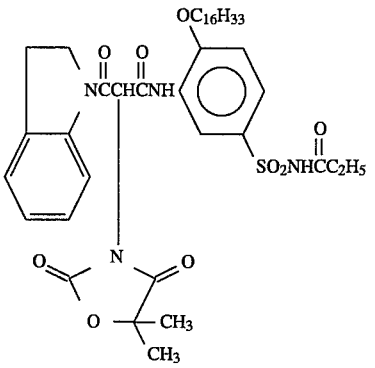
YB-11
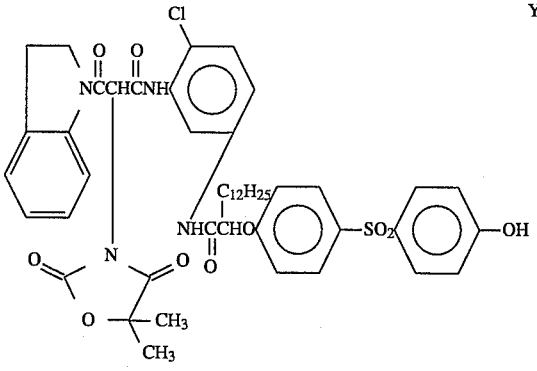
YB-12
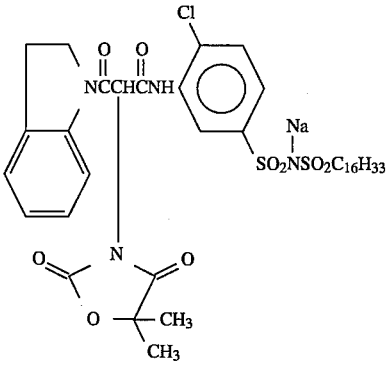

-continued
YB-13
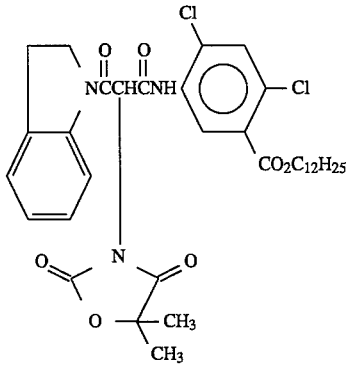
YB-14
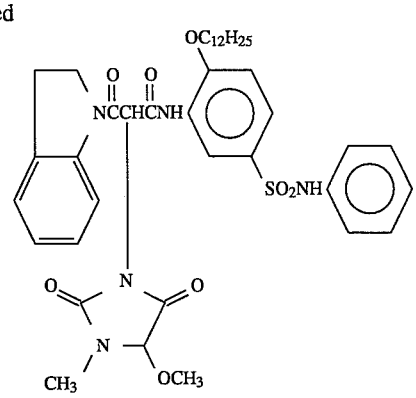
YB-15
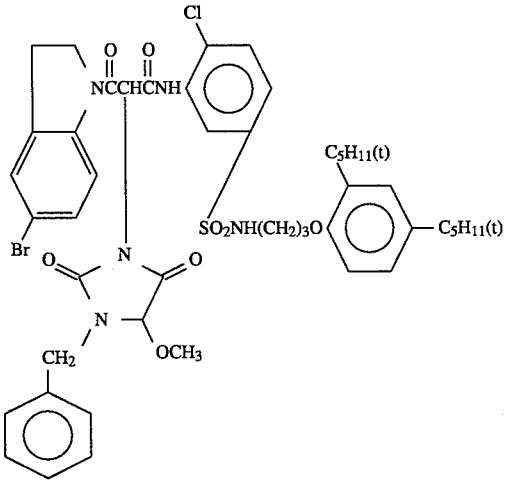
YB-16
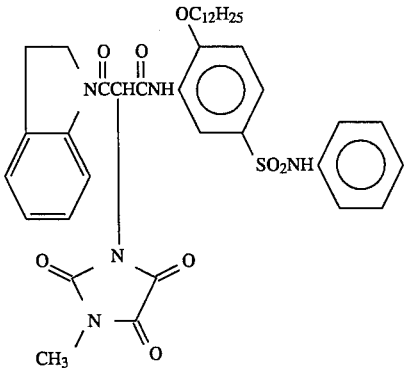
YB-17
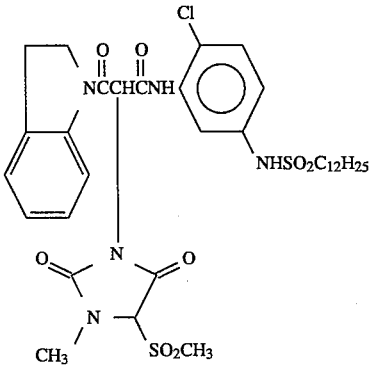
YB-18
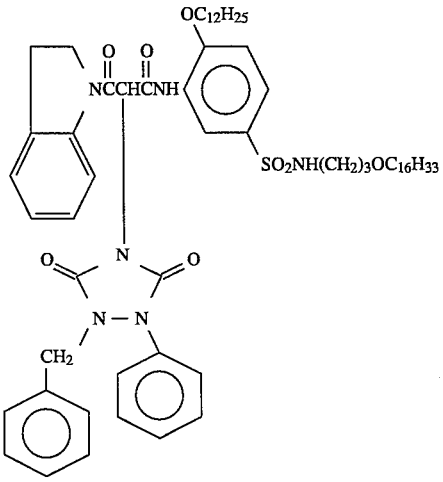
YB-19
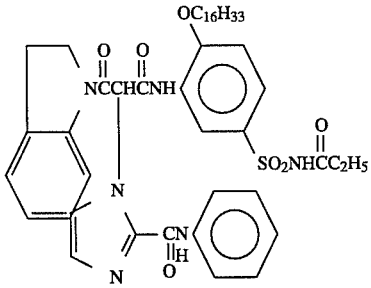

-continued
YB-20
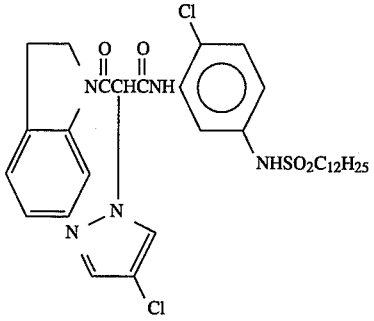
YB-21
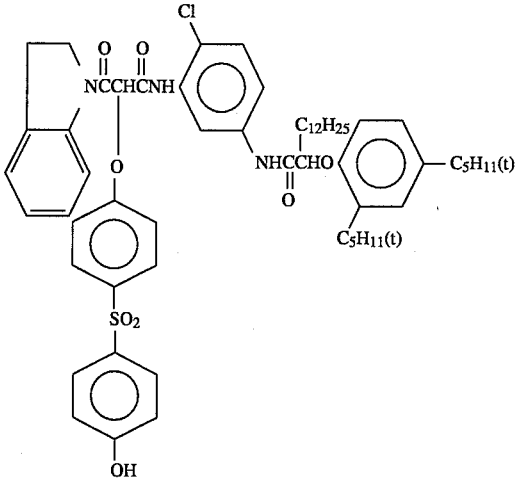
YB-22
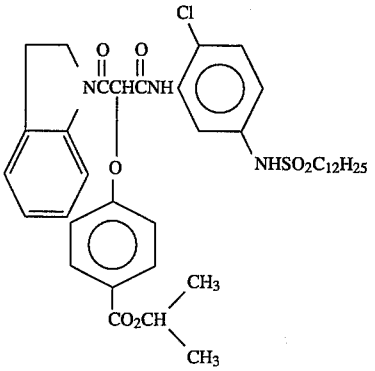
YB-23
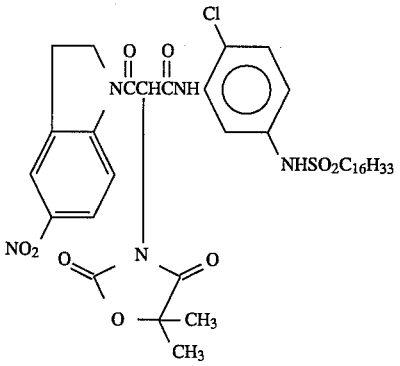

-continued
YB-24
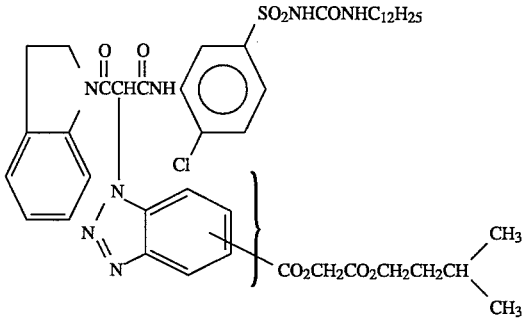
YB-25
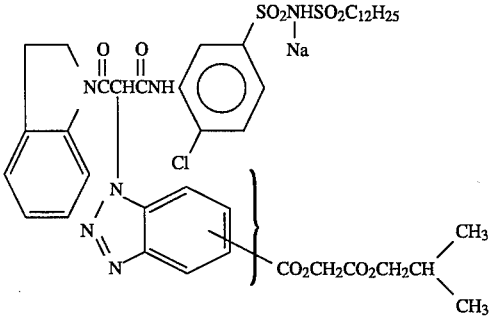
YB-26
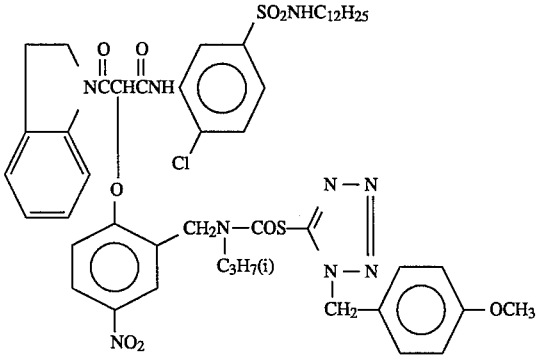
YB-27
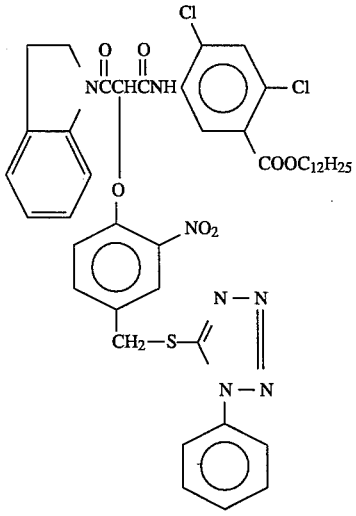

-continued
YB-28
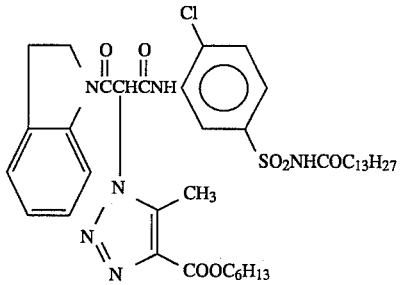
YB-29
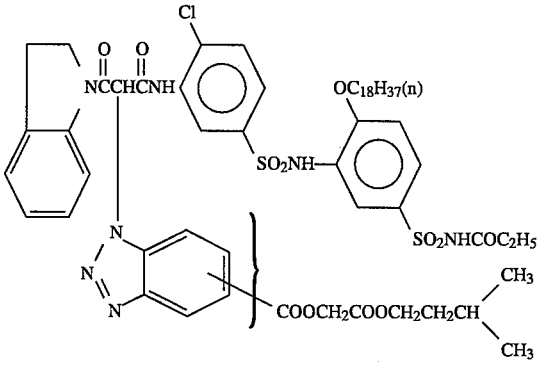
YB-30
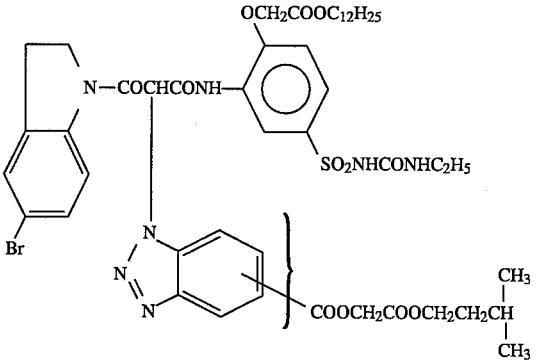
YB-31
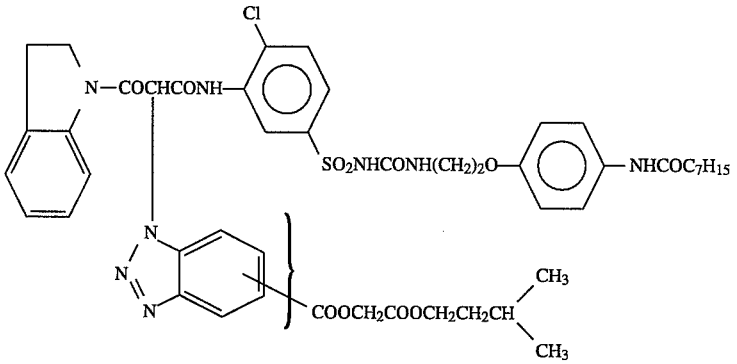

-continued

YB-32

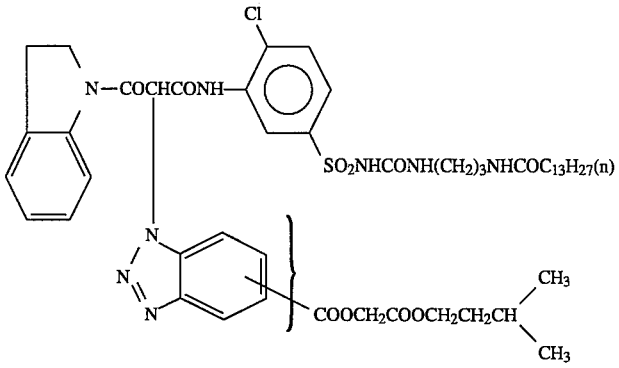

YB-33

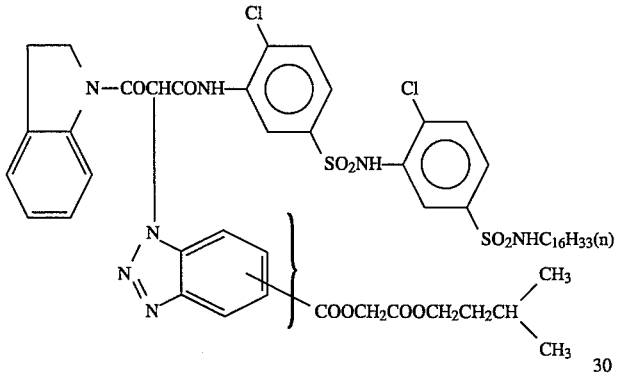

"}" in YB-24, YB-25, YB-29, YB-30, YB-31, YB-32 and YB-33 means that the substituent is positioned at either the 5-position or the 6-position of the benzotriazolyl group therein.

The yellow couplers represented by each of formulae (1) to (5) for use in the present invention may be produced in accordance with the methods described in EP-A-447920 and EP-A-482552.

The amount of the yellow coupler represented by each of formulae (1) to (5) to be incorporated into the photographic material of the present invention is from 0.001 to 5.0 mmol, preferably from 0.01 to 2.0 mmol, per $m^2$ of the photographic material. Even when it is used along with the coupler represented by formula (YI), the amount thereof does not overstep the defined range. The same shall apply to the case where the yellow coupler represented by each of formulae (1) to (5) is used along with other known yellow coupler(s).

Where the yellow couplers represented by each of formulae (1) to (5) are used as the main couplers in the photographic material of the present invention, it is preferred that they are added to the blue-sensitive silver halide emulsion layers or the adjacent light-insensitive layers in the photographic material. Where they release a photographically useful group, they may be added to the silver halide light-sensitive layers or the light-insensitive layers in the photographic material in accordance with their object.

In the present invention, the yellow couplers represented by each of formulae (1) to (5) may be used singly or two or more of them may be used as combined. It is preferred that they are combined with the above-mentioned couplers represented by formula (YI). They may also be combined with other known couplers. The photographic material of the present invention is characterized by having at least one layer containing the coupler(s) represented by formula (YI) and/or the coupler(s) represented by formula (1) or (2).

The couplers represented by each of formulae (1) to (5) may be incorporated into the color photographic material of the present invention by various known dispersion methods.

As one example of known dispersion methods employable in the present invention for this purpose, mentioned is an oil-in-water dispersion method in which a fine dispersion of the coupler is formed, using a low boiling point organic solvent (for example, ethyl acetate, butyl acetate, methyl ethyl ketone, isopropanol), and the fine dispersion is coated on the support and dried without substantially leaving the low boiling point organic solvent in the coated photographic material. If desired, high boiling point organic solvents may also be used for coating the couplers. In the case, any solvent having a boiling point of 175° C. or higher at normal pressure may be used. One or more of such solvents may be used as combined. The ratio of the high boiling point organic solvent to the coupler represented by each of formulae (1) to (5) may be varied widely, but it is preferred that the amount of the solvent is 5.0 g or less, preferably from 0 to 2.0 g, more preferably from 0.01 to 1.0 g, per gram of the coupler.

In addition, a latex dispersion method which will be mentioned hereinafter may also be used.

Further, the couplers may be mixed with other various couplers or compounds which will be mentioned hereinafter or may be used in the presence of them.

The couplers represented by each of formulae (1) to (5) of the present invention form color images with high fastness. In particular, they have an excellent spectral absorption characteristic in that their spectral absorption in the long wavelength range (the green light region) is small, and their color reproducibility is excellent. Where the couplers release a photographically useful group, especially a development inhibitor, or its precursor, they are extremely excellent as they may improve the sharpness of the images formed and may have excellent color reproducibility to improve the quality of the images formed.

The photographic material of the present invention having the particular polyester support and containing the particular coupler(s) may form an image with much improved color fastness, additionally having improved stability to long-term storage.

Regarding the technology and the inorganic and organic materials that may be applied to the photographic material of the present invention having the particular support, referred to are the descriptions of EP-A-436938 mentioned below and the descriptions of other patents also mentioned below.

| | |
|---|---|
| 1. Layer Constitutions | from page 146, line 34 to page 147, line 25 |
| 2. Silver Halide Emulsions | from page 147, line 26 to page 148, line 12 |
| 3. Yellow Couplers | Other couplers than couplers represented by each of formulae (YI), (1) and (2), which are usable in the present invention, are described from page 137, line 35 to page 146, line 33 and on page 149, lines 21 to 23. |
| 4. Magenta Couplers | page 149, lines 24 to 28; U.S. Pat. No. 4,595,650, Published unexamined International Applications W092/18901, W092/19802, W092/19803, W093/02392 |
| 5. Cyan Couplers | page 149, lines 29 to 33; EP-A-432804, from page 3, line 28 to page 40, line 2 |
| 6. Polymer Couplers | page 149, lines 34 to 38; EP-A-435334, from page 113, line 39 to page 123, line 37 |
| 7. Colored Couplers | from page 53, line 42 to page 137, line 34; on page 149, lines 39 to 45, EP-A-423727 |
| 8. Other Couplers | from page 7, line 1 to page 53, line 150, 41, from page 149 line 46 to page line 3; EP-A-435334, from page 3, line 1 to page 29, line 50; EP-A-520496, EP-A-522371, EP-A-525396 |
| 9. Antiseptic, Antifungal Agents | page 150, lines 25 to 28 |
| 10. Formalin Scavengers | page 149, lines 15 to 17; U.S. Pat. No. 4,414,309 |
| 11. Other Additives | page 153, lines 38 to 47; EP-A-421453, from page 75, line 21 to page 84, line 56, from page 27, line 40 to page 37, line 40 |
| 12. Dispersion | page 150, lines 4 to 24 |
| 13. Film | page 150, lines 35 to 49 |
| 14. Color Developing Steps | from page 150, line 50 to page 151, line 47; JP-A-5-72691 (developing agents) |
| 15. Desilvering Steps | from page 151, line 48 to page 152, line 53 |
| 16. Automatic Developing | from page 152, line 54 to page 153, line 2 |
| 17. Washing and Stabilizing Steps | page 153, lines 3 to 37 |

The present invention will be explained in more detail by means of the following examples, which, however, are not intended to restrict the scope of the present invention.

EXAMPLE 1

(1) Materials of Supports:

The supports used in this example were prepared by the following methods:

PEN: 100 parts by weight of a commercial polymer of polyethylene-2,6-naphthalate and 2 parts by weight of a commercial ultraviolet absorbent of Tinuvin P.326 (produced by Ciba-Geigy AG) were dried by an ordinary method, melted at 300° C., extruded through a T-die, stretched 3.3 times in the machine direction at 140° C. then stretched 3.3 times in the transverse direction at 130° C., and fixed under heat at 250° C. for 6 seconds.

PET: A commercial polymer of polyethylene terephthalate was biaxially stretched and fixed under heat by an ordinary method to obtain a film having a thickness of 90 μm.

TAC: Triacetyl cellulose was filmed by an ordinary solution spreading method (band method), where the ratio of methylene chloride/methanol was 82/8 by weight, the TAC concentration was 13% and the concentration of the plasticizer (TPP/BDP=2/1, TPP being triphenyl phosphate and BDP being biphenyldiphenyl phosphate) was 15% by weight.

PEN/PET=4/1 (by weight): PEN pellets and PET pellets were first dried in vacuum at 150° C. for 4 hours, kneaded and extruded through a double-screw kneading extruder at 280° C., and then pelletized. The resulting polyester pellets were filmed in the same manner as that for filming the above-mentioned PEN.

(2) Coating of Subbing Layer:

Both surfaces of each of the above-mentioned supports were subjected to corona-discharging treatment, and a coating liquid having the composition mentioned below was coated on one surface that had been heated at a higher temperature during the stretching step, to thereby form a subbing layer on the support. For the corona discharging, a solid state corona-discharging machine 6KVA Model (manufactured by Pillar) was used and the 30 cm-wide support was treated at a speed of 20 m/min. From the current and voltage values as read out, the strength of treating the support was 0.375 KV·A·min/m$^2$. The discharging frequency for the treatment was 9.6 KHz, and the gap clearance between the electrode and the dielectric roll was 1.6 mm.

| Composition of Subbing Layer: | |
|---|---|
| Gelatin | 3 g |
| Distilled Water | 250 cc |
| Sodium α-sulfo-di-2-ethylhexyl Succinate | 0.05 g |
| Formaldehyde | 0.02 g |

On the TAC support, a subbing layer having the composition mentioned below was coated.

| Composition of Subbing Layer for TAC: | |
|---|---|
| Gelatin | 0.2 g |
| Salicylic Acid | 0.1 g |
| Methanol | 15 cc |
| Acetone | 85 cc |
| Formaldehyde | 0.01 g |

(3) Coating of Backing Layer:

After the subbing layer was coated on one surface of each support sample, a backing layer having the composition mentioned below was coated on the other surface of it.

(3-1) Preparation of Dispersion of Fine Conductive Grains (dispersion of tin oxide-antimony oxide composite):

230 parts by weight of stannic chloride hydrate and 23 parts by weight of antimony trichloride were dissolved in 3000 parts by weight of ethanol to obtain a uniform solution. 1 N aqueous sodium hydroxide solution was dropwise added to the uniform solution until the latter had pH of 3, whereby co-precipitates of colloidal stannic oxide and antimony oxide were formed. The co-precipitates thus formed were allowed to stand as they were at 50° C. for 24 hours to obtain reddish brown colloidal precipitates.

The reddish brown colloidal precipitates were separated by centrifugation. In order to remove the excess ions, water was added to the co-precipitates for washing them by centrifugation. The operation was repeated three times whereby the excess ions were removed from the co-precipitates.

200 parts by weight of the colloidal precipitates from which the excess ions had been removed were again dispersed in 1500 parts by weight of water and the resulting dispersion was sprayed into a firing furnace of 600° C. to obtain a bluish powder of fine grains of tin oxide-antimony oxide composite having a mean grain size of 0.1 μm. The specific resistivity of the fine powdery grains were 25 Ω·cm.

A mixed liquid comprising 40 parts by weight of the fine powdery grains and 60 parts by weight of water was adjusted to have pH of 7.0 and roughly dispersed with a stirrer. This was then further dispersed in a horizontal sand mill (Dyno Mill, trade name by WILLYA. IBACHOFENAG) until the residence time became 30 minutes. (3-2) Formation of Backing Layer:

The following composition (A) was coated on the support sample and dried at 115° C. for 60 seconds to have a dry thickness of 0.3 μm. In addition, the following coating liquid (B) was coated over the layer and dried at 115° C. for 3 minutes to have a dry thickness of 1 μm.

| Composition (A): | |
|---|---|
| Dispersion of Conductive Fine Grains (prepared above) | 10 wt. pts. |
| Gelatin | 1 wt. pt. |
| Water | 27 wt. pts. |
| Methanol | 60 wt. pts. |
| Resorcinol | 2 wt. pts. |
| Polyoxyethylene Nonylphenyl Ether | 0.01 wt. pt. |
| Coating Liquid (B): | |
| Cellulose Triacetate | 1 wt. pt. |
| Acetone | 70 wt. pts. |
| Methanol | 15 wt. pts. |
| Dichloromethylene | 10 wt. pts. |
| P-chlorophenol | 4 wt. pts. |
| Silica Grains (mean grain size: 0.2 μm) | 0.01 wt. pts. |
| Polysiloxane | 0.005 wt. pts. |
| Dispersion of $C_{15}H_{31}COOC_{40}H_{81}$/ $C_{50}H_{101}O(CH_2CH_2O)_{16}H$ (8/2, by weight) (mean grain size: 20 nm) | 0.01 wt. pts. |

(4) Heat Treatment of Supports:

After having been coated with the above-mentioned subbing layer and backing layer, the supports were heat-treated under the condition as shown in Tables 3 to 6 below. The heat treatment was effected in such a way that each support film was wound around a reel core having a diameter of 30 cm with the subbing layer-coated surface facing outward. PEN, PET and PEN/PET (4/1 by weight) supports which had not been heat-treated were also prepared.

(5) Coating of Light-Sensitive Layers:

Each support as treated in the manner mentioned above was coated with plural photographic layers each having the composition mentioned below to form a multilayer color photographic material sample.

Compositions of Photographic Layers:

Essential components of constituting the photographic layers are grouped as follows:

ExC: Cyan Coupler
ExM: Magenta Coupler
ExY Yellow Coupler
ExS: Sensitizing Dye
UV: Ultraviolet Absorbent
HBS: High Boiling Point Organic Solvent
H: Gelatin Hardening Agent The amount coated was represented by g/m$^2$ of silver coated, for silver halides and colloidal silvers. For couplers, additives and gelatin, the amount coated was represented by g/m$^2$. For sensitizing dyes, the amount coated was represented by the number of mols relative to mol of the silver halide in the same layer.

| First Layer: Anti-halation Layer | |
|---|---|
| Black Colloidal Silver | 0.15 |
| Gelatin | 1.90 |
| ExM-1 | $2.0 \times 10^{-2}$ |
| HBS-1 | $3.0 \times 10^{-2}$ |
| Second Layer: Interlayer | |
| Gelatin | 2.10 |
| UV-1 | $3.0 \times 10^{-2}$ |
| UV-2 | $5.0 \times 10^{-2}$ |
| UV-3 | $5.0 \times 10^{-2}$ |
| UV-5 | $3.0 \times 10^{-2}$ |
| ExF-1 | $4.0 \times 10^{-2}$ |
| HBS-2 | $7.0 \times 10^{-2}$ |
| HBS-4 | $5.0 \times 10^{-2}$ |
| Third Layer: Low-sensitivity Red-sensitive Emulsion Layer | |
| Silver Iodobromide Emulsion A | 0.15 as Ag |
| Silver Iodobromide Emulsion B | 0.25 as Ag |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.11 |
| ExC-3 | 0.11 |
| ExC-4 | $3.0 \times 10^{-2}$ |
| ExC-7 | $1.0 \times 10^{-2}$ |
| HBS-1 | $7.0 \times 10^{-3}$ |
| HBS-3 | $3.0 \times 10^{-3}$ |
| Fourth Layer: Middle-sensitivity Red-sensitive Emulsion Layer | |
| Silver Iodobromide Emulsion C | 0.25 as Ag |
| Silver Iodobromide Emulsion D | 0.45 as Ag |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExC-8 | $1.8 \times 10^{-2}$ |
| ExY-2 | $1.0 \times 10^{-2}$ |
| Cpd-10 | $1.0 \times 10^{-4}$ |
| HBS-1 | 0.10 |
| Fifth Layer: High-sensitivity Red-sensitive Emulsion Layer | |
| Silver Iodobromide Emulsion E | 0.60 as Ag |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| ExC-7 | $1.5 \times 10^{-2}$ |
| ExC-8 | $1.2 \times 10^{-2}$ |
| HBS-1 | 0.15 |
| HBS-2 | $8.0 \times 10^{-2}$ |
| Sixth Layer: Interlayer | |
| Gelatin | 1.10 |
| P-2 | 0.17 |
| Cpd-1 | 0.10 |
| Cpd-4 | 0.17 |
| HBS-1 | $5.0 \times 10^{-2}$ |
| Seventh Layer: Low-sensitivity Green-sensitive Emulsion Layer | |
| Silver Iodobromide Emulsion F | 0.08 as Ag |
| Silver Iodobromide Emulsion G | 0.12 as Ag |
| Gelatin | 0.50 |

-continued

| | |
|---|---|
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-6 | 0.22 |
| ExY-1 | $1.0 \times 10^{-2}$ |
| ExC-9 | $2.0 \times 10^{-2}$ |
| Cpd-11 | 0.15 |
| HBS-1 | 0.10 |
| Eighth Layer: Middle-sensitivity Green-sensitive Emulsion Layer | |
| Silver Iodobromide Emulsion H | 0.55 as Ag |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.15 |
| ExM-3 | $1.5 \times 10^{-2}$ |
| ExM-7 | $7.0 \times 10^{-2}$ |
| ExY-1 | $2.0 \times 10^{-2}$ |
| ExC-9 | $2.0 \times 10^{-2}$ |
| HBS-1 | 0.20 |
| Ninth Layer: High-sensitivity Green-sensitive Emulsion Layer | |
| Silver Iodobromide Emulsion I | 0.45 as Ag |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| ExC-9 | $1.5 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| HBS-1 | 0.20 |
| HBS-2 | $5.0 \times 10^{-2}$ |
| Tenth Layer: Yellow Filter Layer | |
| Gelatin | 0.90 |
| Yellow Colloidal Silver | $5.0 \times 10^{-2}$ |
| Cpd-1 | 0.10 |
| Cpd-13 | 0.10 |
| HBS-1 | 0.20 |
| Eleventh Layer: Low-sensitivity Blue-sensitive Emulsion Layer | |
| Silver Iodobromide Emulsion J | 0.10 as Ag |
| Silver Iodobromide Emulsion K | 0.20 as Ag |
| Gelatin | 1.00 |
| ExS-8 | $2.0 \times 10^{-4}$ |
| ExY-1 | $3.0 \times 10^{-2}$ |
| ExY-3 | 0.40 |
| (Y-23) | 0.53 |
| YB-33 | $7.0 \times 10^{-2}$ |
| CPd-2 | $1.0 \times 10^{-2}$ |
| HBS-1 | 0.23 |
| Twelfth Layer: High-sensitivity Blue-sensitive Emulsion Layer | |
| Silver Iodobromide Emulsion L | 0.40 as Ag |

-continued

| | |
|---|---|
| Gelatin | 0.60 |
| ExS-8 | $1.0 \times 10^{-4}$ |
| ExY-3 | $8.0 \times 10^{-2}$ |
| (Y-23) | $4.2 \times 10^{-2}$ |
| YB-33 | $1.2 \times 10^{-2}$ |
| Cpd-2 | $1.0 \times 10^{-3}$ |
| HBS-1 | $4.0 \times 10^{-2}$ |
| Thirteenth Layer, First Protective Layer | |
| Fine Silver Iodobromide Grains (mean grain size: 0.07 μm, AgI: 1 mol %) | 0.20 |
| Gelatin | 1.00 |
| UV-2 | 0.10 |
| UV-3 | 0.10 |
| UV-4 | 0.10 |
| UV-5 | 0.10 |
| Cpd-12 | 0.20 |
| HBS-3 | $4.0 \times 10^{-2}$ |
| P-3 | $9.0 \times 10^{-2}$ |
| Fourteenth Layer: Second Protective Layer | |
| Gelatin | 0.70 |
| B-1 (diameter: 1.5 μm) | 0.10 |
| B-2 (diameter: 1.5 μm) | 0.10 |
| B-3 | $2.0 \times 10^{-2}$ |
| H-1 | 0.36 |

In addition, Cpd-3, Cpd-5, Cpd-6, Cpd-7, Cpd-8, P-1, P-2 and W-1 to W-4 mentioned below were added to the layers, in order to improve the storage stability, the processability, the pressure resistance, the anti-fungal and anti-bacterial property, the antistatic property and the coatability.

Further, the layers contained any of B-4, F-1 to F-13, iron salt, lead salt, gold salt, platinum salt, iridium salt and rhodium salt.

The emulsion used as well as the Structural formulae or the names of the compounds used are shown below.

TABLE 1

| Emulsion | Mean AgI Content (%) | Mean Grain Size (based on corresponding spheres) (μm) | Fluctuation Coefficient of Grain Size Distribution (%) | Ratio of Diameter/Thickness | Mean Diameter (based on corresponding circles of projected areas) (μm) | Mean Thickness (μm) |
|---|---|---|---|---|---|---|
| A | 2.0 | 0.15 | 12 | 1 | — | — |

TABLE 1-continued

| Emulsion | Mean AgI Content (%) | Mean Grain Size (based on corresponding spheres) (μm) | Fluctuation Coefficient of Grain Size Distribution (%) | Ratio of Diameter/Thickness | Mean Diameter (based on corresponding circles of projected areas) (μm) | Mean Thickness (μm) |
|---|---|---|---|---|---|---|
| B | 2.0 | 0.25 | 14 | 1 | — | — |
| C | 4.7 | 0.30 | 12 | 1 | — | — |
| D | 4.7 | 0.45 | 8 | 1 | — | — |
| E | 8.8 | 0.65 | 22 | 6.5 | 1.06 | 0.16 |
| F | 2.9 | 0.15 | 16 | 1 | — | — |
| G | 2.9 | 0.25 | 18 | 1 | — | — |
| H | 4.7 | 0.45 | 10 | 1 | — | — |
| I | 8.8 | 0.60 | 25 | 7.2 | 1.01 | 0.14 |
| J | 1.5 | 0.15 | 17 | 4.5 | 0.29 | 0.064 |
| K | 8.0 | 0.45 | 19 | 7.0 | 0.70 | 0.11 |
| L | 9.0 | 0.85 | 23 | 6.5 | 1.39 | 0.21 |

TABLE 2

| Emulsion | Structures of Grains (ratio of silver contents) (ratio of AgI contents) (%) |
|---|---|
| A | cubic grains with uniform structure |
| B | cubic grains with uniform structure |
| C | cubic grains with three-layered structure (4/1/5) (1/38/1) |
| D | cubic grains with three-layered structure (4/1/5) (1/38/1) |
| E | tabular grains with three-layered structure (12/59/29) (0/11/8) |
| F | octahedral grains with three-layered structure (45/5/50) (1/38/1) |
| G | octahedral grains with three-layered structure (45/5/50) (1/38/1) |
| H | octahedral grains with three-layered structure (4/1/5) (1/38/1) |
| I | tabular grains with three-layered structure (12/59/29) (0/11/8) |
| J | tabular grains with uniform structure |
| K | tabular grains with uniform structure |
| L | tabular grains with three-layered structure (8/59/33) (0/11/8) |

In Tables 1 and 2 above;

(1) the emulsions were subjected to reduction sensitization with thiourea dioxide and thiosulfonic acid during formation of the grains, in accordance with the example of JP-A-2-191938 (corresponding to U.S. Pat. No. 5,061,614);

(2) the emulsions were subjected to gold sensitization, sulfur sensitization and selenium sensitization in the presence of the color sensitizing dyes in the respective light-sensitive layers and sodium thiocyanate, in accordance with the example of JP-A-3-237450 (corresponding to EP-A-443453);

(3) for preparation of tabular grains, a low molecular gelatin was used in accordance with the example of JP-A-1158426 (corresponding to EP-A-447969); and (4) grains having the shapes and the structures shown in Tables 1 and 2 were observed to have dislocation lines such as those described in JP-A-3-237450, with a high-pressure electronic microscope.

UV-1
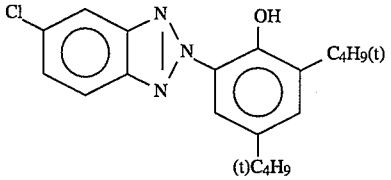
UV-2
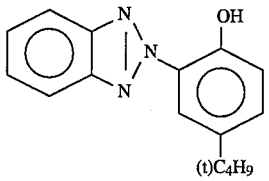
UV-3
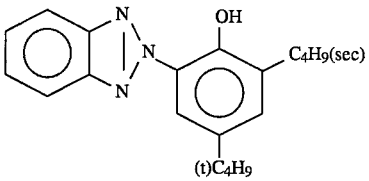
UV-4
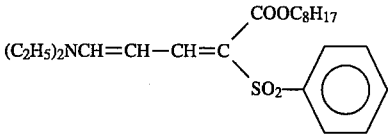
UV-5
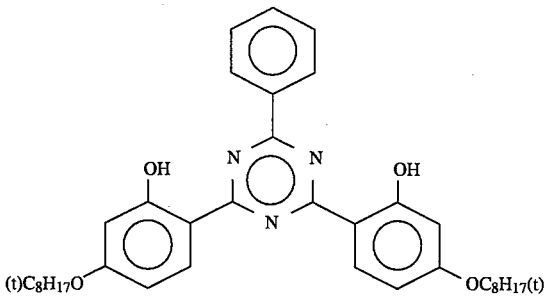
HBS-1 Tricresyl Phosphate
HBS-2 Dibutyl Phthalate
HBS-3 Tri(2-ethylhexyl) Phosphate
HBS-4 Di(2-ethylhexyl) Phthalate
ExF-1
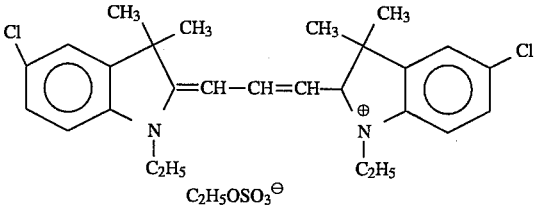
ExC-1
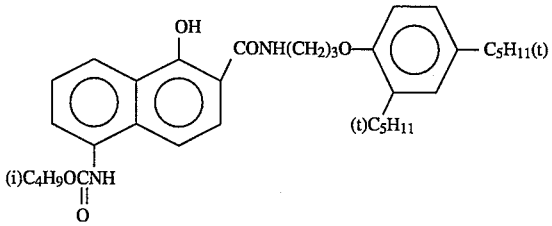
ExC-2
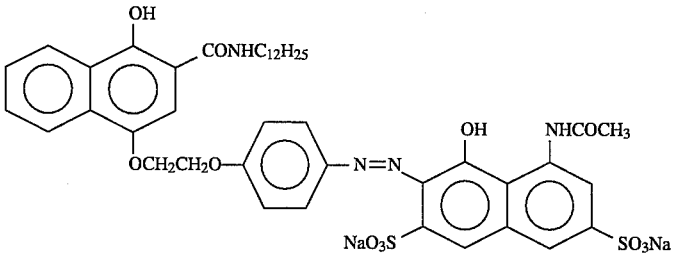

-continued
ExC-3
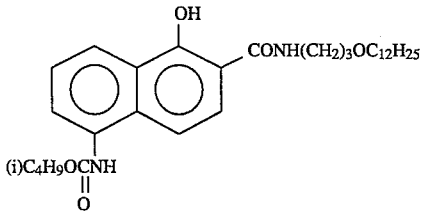
ExC-4
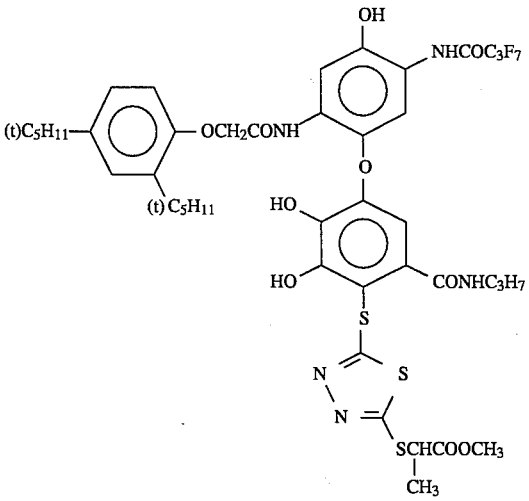
ExC-5
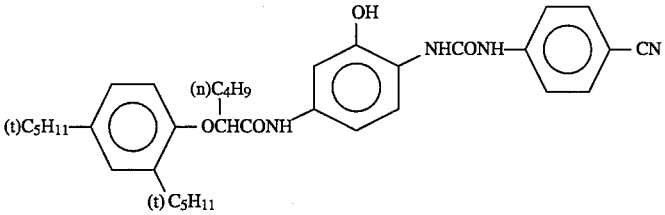
ExC-6
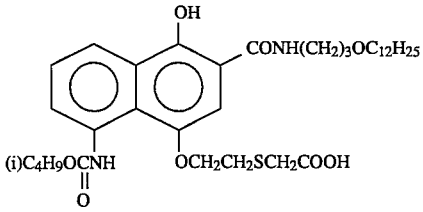
ExC-7
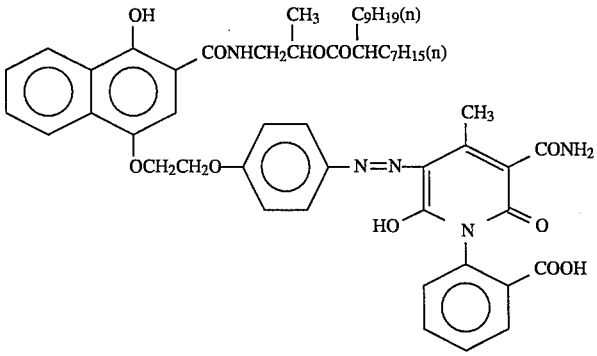

-continued
ExM-1
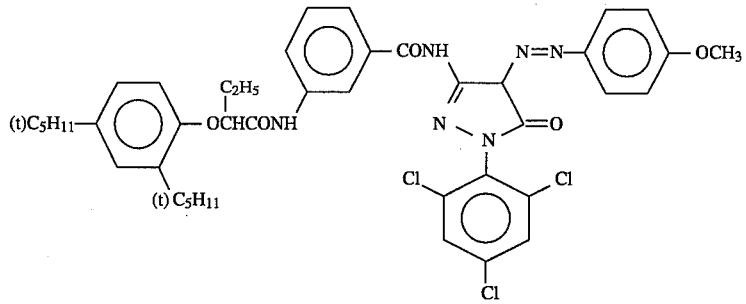
ExM-2
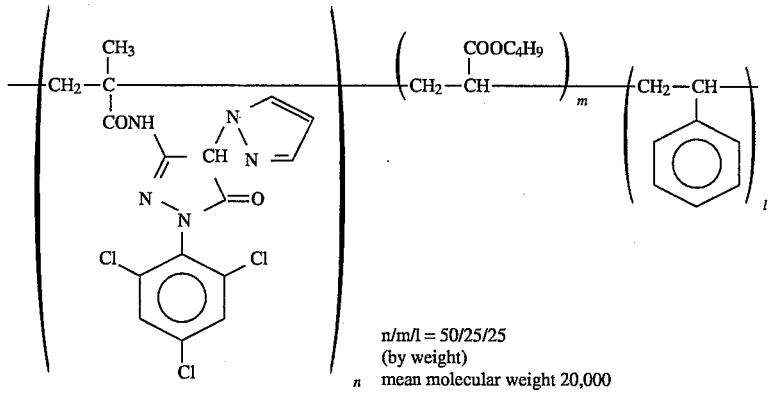
n/m/l = 50/25/25
(by weight)
mean molecular weight 20,000
ExM-3
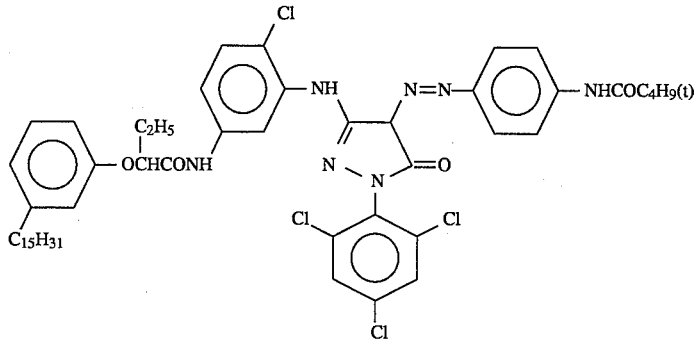
ExM-4
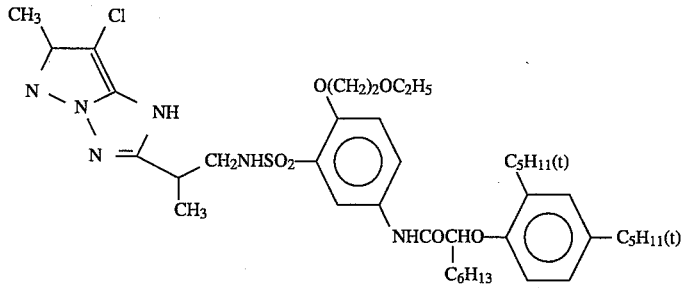

-continued
ExM-5
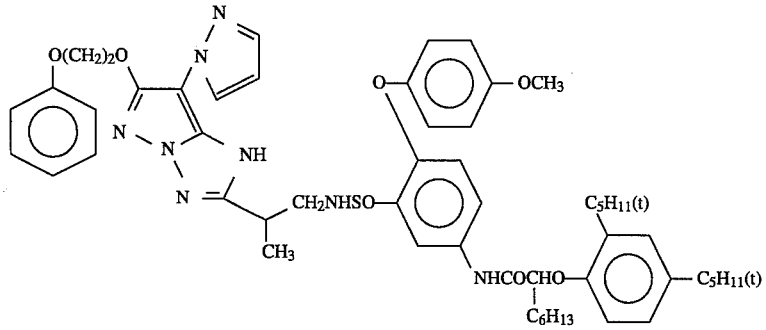
ExM-6
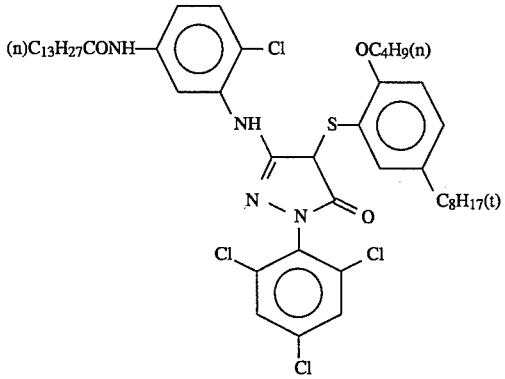
ExM-7
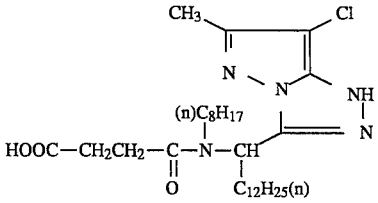
ExC-8
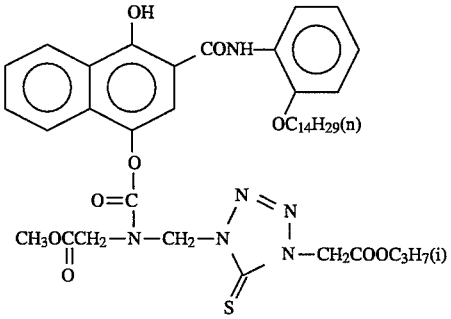
ExC-9
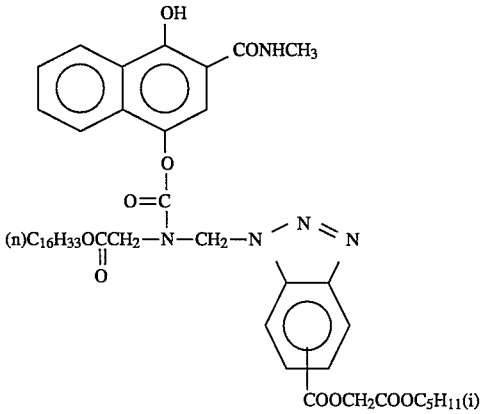
ExY-1
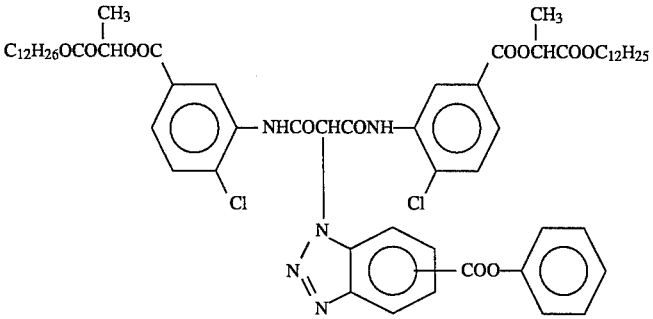

-continued
ExY-2
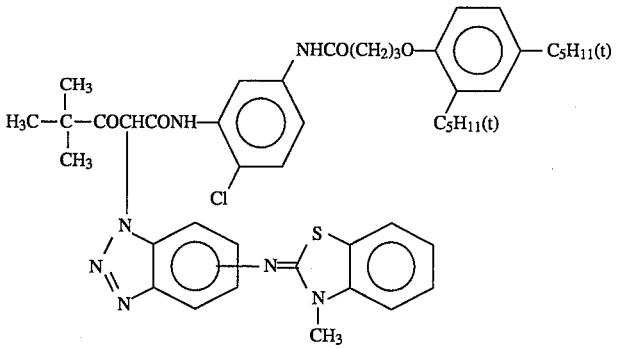
ExY-3
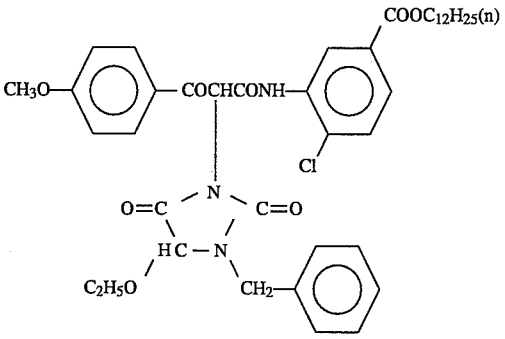
Cpd-1
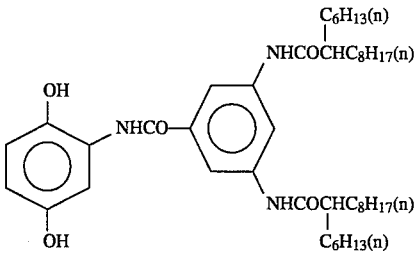
Cpd-2
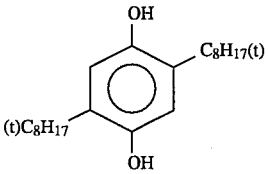
Cpd-3
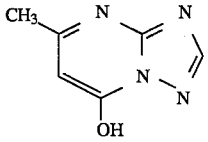
Cpd-4
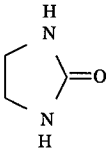
Cpd-5
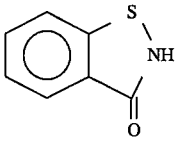
Cpd-6
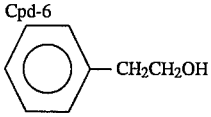
Cpd-7
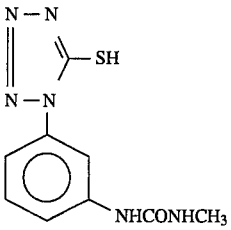

-continued
Cpd-8
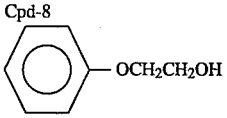
Cpd-9
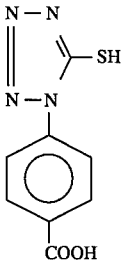
Cpd-10
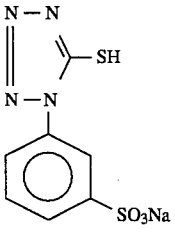
Cpd-11
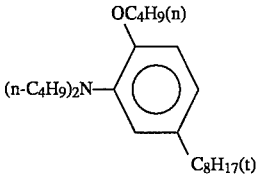
Cpd-12
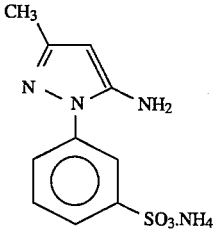
Cpd-13
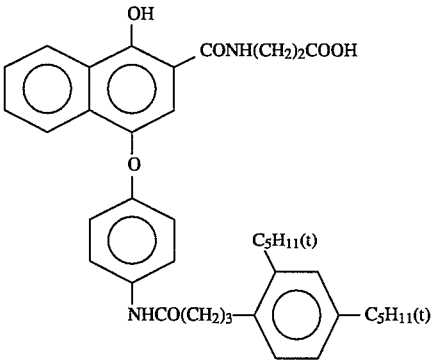
ExS-1
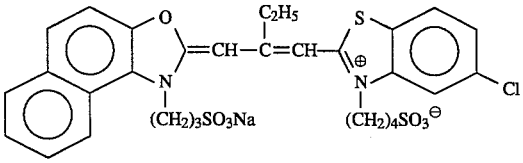
ExS-2
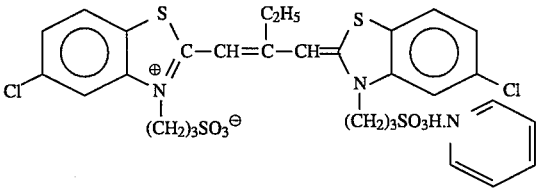
ExS-3
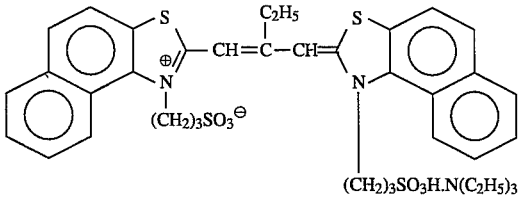
ExS-4
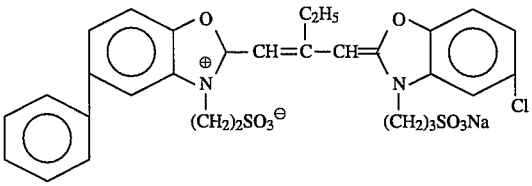
ExS-5
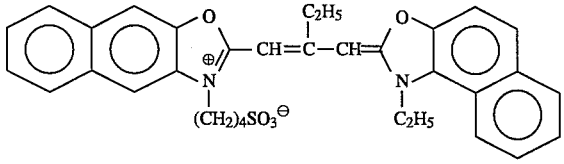
ExS-6
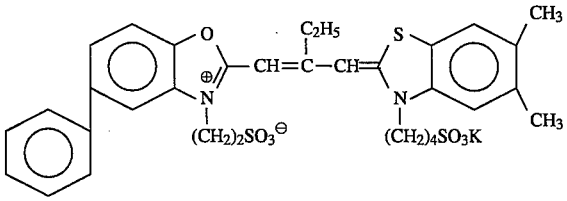

-continued

ExS-7

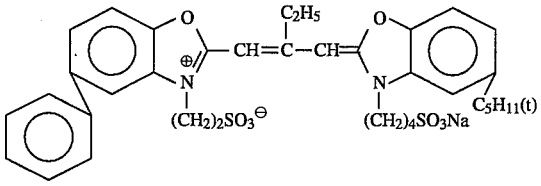

ExS-8

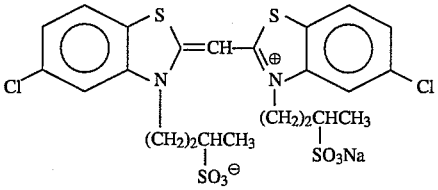

B-1

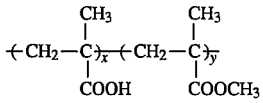

x/y = 10/90 (by weight)
mean molecular weight: ca. 35,000

B-2

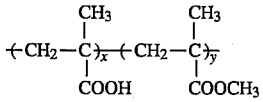

x/y = 40/60 (by weight)
mean molecular weight: ca. 20,000

B-3

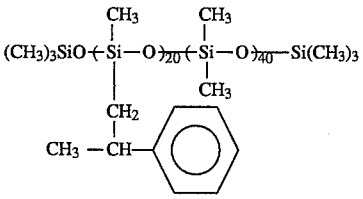

(by weight)
mean molecular weight: ca. 8,000

B-4

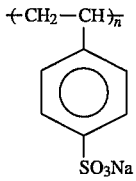

mean molecular weight: ca. 750,000

H-1

Mixture of
$CH_2=CH-SO_2-CH_2-CONH-CH_2$
$CH_2=CH-SO_2-CH_2-CONH-CH_2$ and
(2:1, by mol)

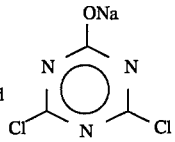

W-1

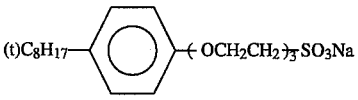

W-2

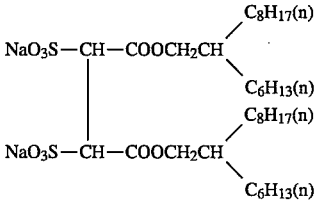

W-3
$C_8F_{17}SO_2N(C_3H_7)CH_2COOK$

W-4

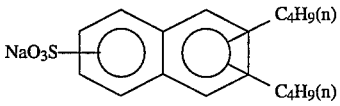

P-1
Copolymer of Vinylpyrrolidone and Vinyl Alcohol (70:30, by weight)

P-2
Polyvinyl Pyrrolidone (mean molecular weight, ca. 10,000)

P-3
Polyethyl Acrylate

F-1

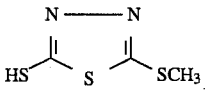

F-2

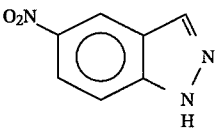

F-3

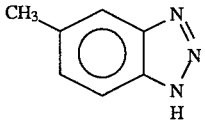

F-4

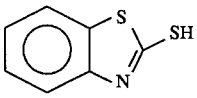

-continued

F-5

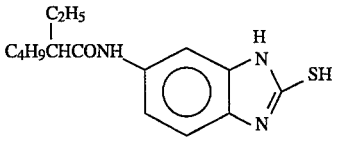

F-6

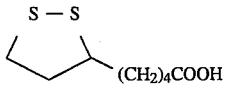

F-7

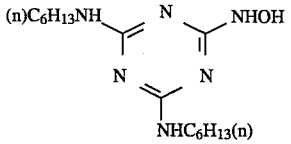

F-8

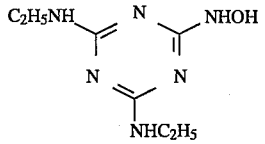

F-9

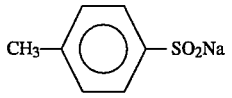

F-10

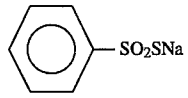

F-11

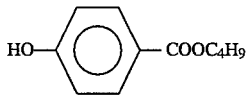

F-12

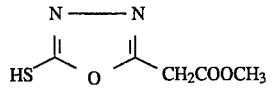

F-13

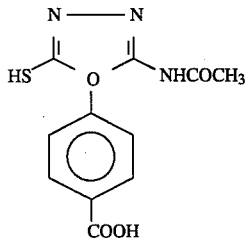

Figure 2:
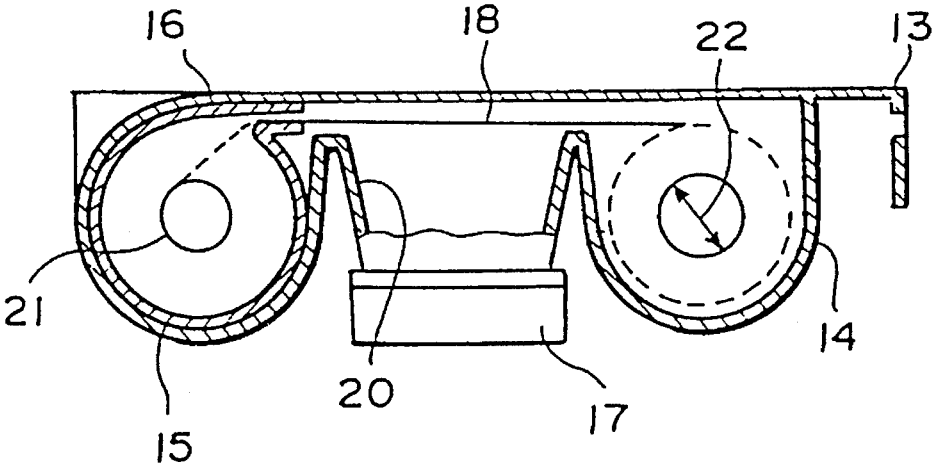
FIG. 2 is a partly-cut top plan view, showing the inner structure of a film-combined camera as another mode to which the present invention is applied.

(6) Formation of Film-combined Camera Samples:

Each of the thus-prepared photographic materials was slit into a film having a width of 35 mm and a length of 1.8 m, perforated and built into a camera unit shown in FIG. 1 or 2 to form a film-combined camera. These are referred to as Sample Nos. 101 to 138.

FIG. 1 is a top plan view, showing the internal structure of a film-combined camera which is one applicable mode of the present invention. The camera 1 of FIG. 1 has a unit 3 cased in the camera box 2. In the unit 3, an unexposed film 8 that has been drawn out from the patrone 6 has been wound up and loaded in the supply room 4. The patrone 6 is loaded in the winding-up room 5. For each exposure, the film is drawn out from the supply room 4 and is wound up in the patrone 6. 7 is an objective, and 9 is a film-supporting plane.

FIG. 2 shows only the part of the unit 13 of a film-combined camera which is another applicable mode of the present invention. In this mode, the supply room 14 also has a spool 22 therein, in addition to the spool 21 in the patrone 16 loaded in the winding-up room 15. (In FIG. 1, the explanation of the spool has been omitted.) The film 18 is for 36 exposures. 17 is a lens unit, and 20 is an exposure flame.

Comparative samples shown in Table 6 below were prepared, varying the temperature and the time for heat treatment of the support PEN and also the diameter of the spool or the diameter of the hollow area in the center of the roll film in the film-combined camera to those as indicated in Table 6. These are referred to as Comparative Sample Nos. 139 to 142.

(7) Core Setting:

The film-combined cameras thus formed in the above were heated at 40° C. for 24 hours, whereby the films therein were curled. The temperature condition was determined in consideration of the outdoor condition in the summer season.

(8) Drawing of the tongue of film, development, and measurement of the degree of curling of film:

The above-mentioned film-combined cameras where the films were curled under the condition mentioned above were cooled in a room at 25° C. overnight. Then, the tongue of each film was drawn out with a tool. The films were developed with an automatic developing machine (Minilabo FP-560B Model, manufactured by Fuji Photo Film Co., Ltd.), and immediately the degree of curling of each of the developed films was measured at 25° C. and 60% RH.

The conditions for the development are shown below. Prior to the development, other samples which had been imagewise exposed were processed with the automatic developing machine until the amount of the replenisher of the color developer became 3 times the amount of the tank capacity. The running solutions were used for the measurement of the samples.

Processing Steps

| Step | Time | Temperature | Amount of Replenisher (*) | Tank Capacity |
|---|---|---|---|---|
| Color Development | 3 min 5 sec | 38.0° C. | 300 ml | 5 liters |
| Bleaching | 50 sec | 38.0° C. | 140 ml | 5 liters |
| Bleach-Fixation | 50 sec | 38.0° C. | — | 5 liters |
| Fixation | 50 sec | 38.0° C. | 420 ml | 5 liters |
| Washing | 30 sec | 38.0° C. | 980 ml | 3.5 liters |
| Stabilization (1) | 20 sec | 38.0° C. | — | 3 liters |
| Stabilization (2) | 20 sec | 38.0° C. | 560 ml | 3 liters |
| Drying | 1 min 30 sec | 60° C. | | |

(*) This is per m2 of the sample being processed.

The stabilization was effected by a countercurrent cascade piping system from the tank (2) to the tank (1). All the overflow from the washing tank was returned back to the fixation bath. The top of the bleaching bath and that of the fixation bath of the automatic developing machine used in this example were both notched so that all the overflows from the bleaching bath and the fixation bath to be generated by replenishment to the both bathes were introduced into the bleach-fixation bath for replenishment thereto. The amount of the carryover from the developer bath to the bleaching bath, that of the carryover from the bleaching bath to the bleach-fixation bath, that of the carryover from the bleach-fixation bath to the fixation bath and that of the carryover from the fixation bath to the washing bath were 65 ml, 50 ml, 50 ml and 50 ml, respectively, per $m^2$ of the sample being processed. The cross-over time between the adjacent bathes was all 6 seconds, and the time was included in the processing time in the previous bath.

The compositions of the processing solutions used above are mentioned below.

| Color Developer: | Tank Solution | Replenisher |
|---|---|---|
| Diethylenetriaminepentaacetic Acid | 2.0 g | 3.2 g |
| 1-Hydroxyethylidene-1,1-diphosphonic Acid | 2.0 g | 2.0 g |
| Sodium Sulfite | 3.9 g | 5.2 g |
| Potassium Carbonate | 37.5 g | 39.0 g |
| Potassium Bromide | 1.7 g | — |
| Potassium Iodide | 1.3 mg | — |
| Hydroxylamine Sulfate | 2.4 g | 4.2 g |
| 2-Methyl-4-[N-ethyl-N-(β-hydroxyethyl)amino]aniline Sulfate | 4.7 g | 7.5 g |
| Water to make | 1.0 liter | 1.0 liter |
| pH (adjusted with potassium hydroxide and sulfuric acid) | 10.05 | 10.45 |

-continued

| Bleaching Solution: | Tank Solution | Replenisher |
|---|---|---|
| Ammonium 1,3-Diaminopropanetetraacetato Ferrate Monohydrate | 130 g | 195 g |
| Ammonium Bromide | 70 g | 105 g |
| Ammonium Nitrate | 14 g | 21 g |
| Hydroxyacetic Acid | 50 g | 75 g |
| Acetic Acid | 40 g | 60 g |
| Water to make | 1.0 liter | 1.0 liter |
| pH (adjusted with aqueous ammonia) | 4.4 | 4.4 |

Bleach-Fixation Tank Solution:

This is a mixture of 15/85 (by volume) of the above-mentioned bleaching tank solution and the following fixation tank solution. This had pH of 7.0.

| Fixing Solution: | Tank Solution | Replenisher |
|---|---|---|
| Ammonium Sulfite | 19 g | 57 g |
| Ammonium Thiosulfate Aqueous Solution (700 g/liter) | 280 ml | 840 ml |
| Imidazole | 15 g | 45 g |
| Ethylenediaminetetraacetic Acid | 15 g | 45 g |
| Water to make | 1.0 liter | 1.0 liter |
| pH (adjusted with aqueous ammonia and acetic acid) | 7.4 | 7.45 |

Washing Water:

A city water was passed through a mixed bed type column as filled with an H-type strong acidic cation-exchange resin (Amberlite IR-120B, produced by Rhom & Haas Co.) and an OH-type strong basic anion-exchange resin (Amberlite IR-400, produced by Rhom & Haas Co.) so that both the calcium ion concentration and the magnesium ion concentration in the water were reduced to 3 mg/liter or less, individually. Next, 20 mg/liter of sodium dichloroisocyanurate and 150 mg/liter of sodium sulfate were added to the resulting water, which had a pH value falling within the range of from 6.5 to 7.5. This was used as the washing water.

| Stabilizing Solution: | |
|---|---|
| Tank solution and replenisher were same. | |
| Sodium P-toluenesulfonate | 0.03 g |
| Polyoxyethylene p-monononylphenyl Ether (mean polymerization degree 10) | 0.2 g |
| Disodium Ethylenediaminetetraacetate | 0.05 g |
| 1,2,4-Triazole | 1.3 g |
| 1,4-Bis(1,2,4-triazol-1-ylmethyl)piperazine | 0.75 g |
| Water to make | 1.0 liter |
| pH | 8.5 |

The results obtained are shown in Tables 3 to 6 below.

TABLE 3

| Sample | Support Kind | Support Thickness (μm) | Support Tg (°C.) | Supply Room Diameter of Hollow Area in Center of Roll Film (mm) | Supply Room Diameter of Spool (mm) | Diameter of Spool in Patrone (mm) |
|---|---|---|---|---|---|---|
| 101 (comparative sample) | TAC | 115 | — | — | 9 | 11.5 |
| 102 (comparative sample) | TAC | 115 | — | — | 7 | 11.5 |
| 103 (comparative sample) | TAC | 122 | — | 11.97 | — | 11.5 |
| 104 (comparative sample) | TAC | 155 | — | — | 9 | 9 |
| 105 (comparative sample) | TAC | 155 | — | — | 7 | 7 |
| 106 (comparative sample) | PET | 90 | 80 | — | 9 | 11.5 |
| 107 (comparative sample) | PET | 90 | 80 | — | 7 | 11.5 |
| 108 (comparative sample) | PET | 90 | 80 | 13.02 | — | 11.5 |
| 109 (comparative sample) | PET | 90 | 80 | — | 9 | 9 |
| 110 (comparative sample) | PET | 90 | 80 | — | 7 | 7 |
| 111 (comparative sample) | PET | 90 | 80 | 13.02 | — | 7 |
| 112 (comparative sample) | PEN | 75 | 119 | — | 9 | 11.5 |

| Sample | Heat Treatment (°C./hrs) | Operation for Drawing out of Tongue of Film | ANSI value of Curling of Processed Film | Scratches | Unevenness of Development | Bending of Back End of Film |
|---|---|---|---|---|---|---|
| 101 (comparative sample) | No | Difficult | 140 | No | No | Yes |
| 102 (comparative sample) | No | Difficult | 163 | No | No | Yes |
| 103 (comparative sample) | No | Difficult | 132 | No | No | Yes |
| 104 (comparative sample) | No | Difficult | 176 | No | No | Yes |
| 105 (comparative sample) | No | Impossible | 194 | Yes | Yes | Yes |
| 106 (comparative sample) | No | Difficult | 135 | No | No | Yes |
| 107 (comparative sample) | No | Difficult | 176 | No | No | Yes |
| 108 (comparative sample) | No | Difficult | 159 | No | No | Yes |
| 109 (comparative sample) | No | Impossible | 186 | Yes | Yes | Yes |
| 110 (comparative sample) | No | Impossible | 201 | Yes | Yes | Yes |
| 111 (comparative sample) | No | Impossible | 186 | Yes | Yes | Yes |
| 112 (comparative sample) | No | Difficult | 94 | No | No | Yes |

TABLE 4

| Sample | Support Kind | Support Thickness (μm) | Support Tg (°C.) | Supply Room Diameter of Hollow Area in Center of Roll Film (mm) | Supply Room Diameter of Spool (mm) | Diameter of Spool in Patrone (mm) |
|---|---|---|---|---|---|---|
| 113 (comparative sample) | PEN | 75 | 119 | — | 7 | 11.5 |
| 114 (comparative sample) | PEN | 75 | 119 | 13.02 | — | 11.5 |
| 115 (comparative sample) | PEN | 75 | 119 | — | 9 | 9 |
| 116 (comparative sample) | PEN | 75 | 119 | — | 7 | 7 |
| 117 (comparative sample) | PEN | 75 | 119 | 13.02 | — | 7 |
| 118 (comparative sample) | PEN/PET = 4/1 | 75 | 104 | — | 9 | 9 |
| 119 (comparative sample) | PEN/PET = 4/1 | 75 | 104 | — | 7 | 7 |
| 120 (comparative sample) | PEN/PET = 4/1 | 75 | 104 | 13.02 | — | 7 |
| 121 (sample of the invention) | PET | 90 | 80 | — | 9 | 11.5 |
| 122 (sample of the invention) | PET | 90 | 80 | — | 7 | 11.5 |
| 123 (sample of the invention) | PET | 90 | 80 | 13.02 | — | 11.5 |
| 124 (sample of the invention) | PET | 90 | 80 | — | 9 | 9 |

TABLE 4-continued

| Sample | Heat Treatment (°C./hrs) | Operation for Drawing out of Tongue of Film | ANSI value of Curling of Processed Film | Scratches | Unevenness of Development | Bending of Back End of Film |
|---|---|---|---|---|---|---|
| 113 (comparative sample) | No | Difficult | 101 | No | No | Yes |
| 114 (comparative sample) | No | Difficult | 88 | No | No | Yes |
| 115 (comparative sample) | No | Difficult | 98 | No | No | Yes |
| 116 (comparative sample) | No | Difficult | 110 | No | No | Yes |
| 117 (comparative sample) | No | Difficult | 85 | No | No | Yes |
| 118 (comparative sample) | No | Difficult | 98 | No | No | Yes |
| 119 (comparative sample) | No | Difficult | 103 | No | No | Yes |
| 120 (comparative sample) | No | Difficult | 95 | No | No | Yes |
| 121 (sample of the invention) | 75/24 | Easy | 49 | No | No | No |
| 122 (sample of the invention) | 75/24 | Easy | 51 | No | No | No |
| 123 (sample of the invention) | 75/24 | Easy | 45 | No | No | No |
| 124 (sample of the invention) | 75/24 | Easy | 59 | No | No | No |

TABLE 5

| | Support | | | Supply Room | | Diameter |
|---|---|---|---|---|---|---|
| Sample | Kind | Thickness (μm) | Tg (°C.) | Diameter of Hollow Area in Center of Roll Film (mm) | Diameter of Spool (mm) | of Spool in Patrone (mm) |
| 125 (sample of the invention) | PET | 90 | 80 | — | 7 | 7 |
| 126 (sample of the invention) | PET | 90 | 80 | 13.02 | — | 7 |
| 127 (sample of the invention) | PEN | 75 | 119 | — | 9 | 11.5 |
| 128 (sample of the invention) | PEN | 75 | 119 | — | 7 | 11.5 |
| 129 (sample of the invention) | PEN | 75 | 119 | 13.02 | — | 11.5 |
| 130 (sample of the invention) | PEN | 75 | 119 | — | 9 | 9 |
| 131 (sample of the invention) | PEN | 75 | 119 | — | 7 | 7 |
| 132 (sample of the invention) | PEN | 75 | 119 | 13.02 | — | 7 |
| 133 (sample of the invention) | PEN/PET = 4/1 | 75 | 104 | — | 9 | 11.5 |
| 134 (sample of the invention) | PEN/PET = 4/1 | 75 | 104 | — | 7 | 11.5 |
| 135 (sample of the invention) | PEN/PET = 4/1 | 75 | 104 | 13.02 | — | 11.5 |
| 136 (sample of the invention) | PEN/PET = 4/1 | 75 | 104 | — | 9 | 9 |

| Sample | Heat Treatment (°C./hrs) | Operation for Drawing out of Tongue of Film | ANSI value of Curling of Processed Film | Scratches | Unevenness of Development | Bending of Back End of Film |
|---|---|---|---|---|---|---|
| 125 (sample of the invention) | 75/24 | Easy | 59 | No | No | No |
| 126 (sample of the invention) | 75/24 | Easy | 56 | No | No | No |
| 127 (sample of the invention) | 110/48 | Easy | 42 | No | No | No |
| 128 (sample of the invention) | 110/48 | Easy | 44 | No | No | No |
| 129 (sample of the invention) | 110/48 | Easy | 39 | No | No | No |
| 130 (sample of the invention) | 110/48 | Easy | 45 | No | No | No |
| 131 (sample of the invention) | 110/48 | Easy | 45 | No | No | No |

TABLE 5-continued

| | | | | | | |
|---|---|---|---|---|---|---|
| 132 (sample of the invention) | 110/48 | Easy | 48 | No | No | No |
| 133 (sample of the invention) | 95/48 | Easy | 42 | No | No | No |
| 134 (sample of the invention) | 95/48 | Easy | 44 | No | No | No |
| 135 (sample of the invention) | 95/48 | Easy | 38 | No | No | No |
| 136 (sample of the invention) | 95/48 | Easy | 47 | No | No | No |

TABLE 6

| | Support | | | Supply Room | | Diameter |
|---|---|---|---|---|---|---|
| Sample | Kind | Thickness (μm) | Tg (°C.) | Diameter of Hollow Area in Center of Roll Film (mm) | Diameter of Spool (mm) | of Spool in Patrone (mm) |
| 137 (sample of the invention) | PEN/ PET = 4/1 | 75 | 104 | — | 7 | 7 |
| 138 (sample of the invention) | PEN/ PET = 4/1 | 75 | 104 | 13.02 | — | 7 |
| 139 (comparative sample) | PEN | 75 | 119 | — | 9 | 2.8 |
| 140 (comparative sample) | PEN | 75 | 119 | 7 | — | 2.8 |
| 141 (comparative sample) | PEN | 75 | 119 | — | 9 | 7 |
| 142 (comparative sample) | PEN | 75 | 119 | 13.02 | — | 11.5 |

| Sample | Heat Treatment (°C./hrs) | Operation for Drawing out of Tongue of Film | ANSI value of Curling of Processed Film | Scratches | Unevenness of Development | Bending of Back End of Film |
|---|---|---|---|---|---|---|
| 137 (sample of the invention) | 95/48 | Easy | 50 | No | No | No |
| 138 (sample of the invention) | 95/48 | Easy | 52 | No | No | No |
| 139 (sample of the invention) | 35/240 | Difficult | 250 | Yes | Yes | Yes |
| 140 (sample of the invention) | 35/240 | Difficult | 245 | Yes | Yes | Yes |
| 141 (sample of the invention) | 35/240 | Difficult | 239 | Yes | Yes | Yes |
| 142 (sample of the invention) | 35/240 | Difficult | 283 | Yes | Yes | Yes |

In Table 3 to 6 above, the "ANSI value of curing of processed film" means the value of the degree of the curling of the processed film, which was measured in accordance with the Test Method A of ANSI/ASC, pH 1.29-1985. This was expressed by 1/R, where R is the radius of the curl (unit: $m^{-1}$).

The results of Tables 3 to 6 have revealed the following facts: In the film-combined camera samples of the present invention, which contained photographic films each having the previously heat-treated polyester support of the present invention, the value of the curling of the processed film was small even though the diameter of the spool was small. In addition, the operation of drawing out the tongue of the film from the patrone was easy. The processed films were free from the troubles of uneven development, scratches of the processed film and bending of the back end of the film. As opposed to these, however, the comparative samples having the TAC support or the non-heat-treated polyester support were not satisfactory with respect to all the tested matters. Some had difficulty in the operation of drawing out the tongue of the film from the patrone, and some were troubled by uneven development, scratches of the processed film and bending of the back end of the film.

Though not shown in Tables 3 to 6, even the supports of PET and PEN could not have a modulus of bending elasticity enough to be resistant to the shrinking stress of the light-sensitive layers coated thereon, when their thickness was less than 50 μm, with the result that the photographic films having the support became curled to a gutter-like shape and that they were scratched during their development. The same applied to the other polyesters. If the thickness of the support was more than 100 μm, it was difficult to wind up the photographic film having such a thick support around the spool and to load the wound-up film in the patrone or in the supply room. If so, therefore, the sizes of the camera and the patrone for the film cannot be made small.

Poly(oxyisophthaloxy-2,6-dimethyl-1,4-phenylene-isopropylidene-3,5-dimethyl-1,4-phenylene) having Tg of 225° C., which is one example of polymers having a glass transition point Tg of higher than 200° C., could not be formed into a transparent support, and it could not be used in producing photographic materials.

Other samples that had been prepared by using water in Composition A for the inner backing layer, in place of the dispersion of fine conductive grains, had static marks. Accordingly, the conductive layer is indispensable in the photographic material of the present invention so as to improve its commercial value.

EXAMPLE 2

Using four supports, or the same TAC support having a thickness of 122 μm as that used in preparing Sample No. 103 in Example, 1, the same heat-treated PET support having a thickness of 90 μm as that used in preparing Sample Nos. 121 to 126, the same heat-treated PEN support having a thickness of 75 μm as that used in preparing Sample Nos. 127 to 132, and the same heat-treated PEN/PET (4/1, by weight) sample having a thickness of 75 μm as that used in preparing Sample Nos. 133 to 137; other sample Nos. 201 to 228 were prepared in the same manner as in Example 1, except that the yellow couplers (Y-23) and YB-22 (falling within the ranges of yellow couplers represented by each of formulae (YI) and (2), respectively) and the yellow coupler ExY-1 in the eleventh and twelfth blue-sensitive emulsion layers were replaced by the same molar amounts of other couplers represented by each of formulae (YI), (1) and (2) as indicated in Tables 7 to 10 below.

In the same manner as in preparation of the PEN support in Example 1, the preferred polyesters of (P-4) to (P-7), (P-11), (P-12), (P-16) and (P-19) each were melted, after the ultraviolet absorbent had been added thereto, filmed by extrusion and stretched both in the machine direction and in the transverse direction to obtain supports each having a thickness of 85 μm. These were coated with the same subbing layer and backing layer as those in Example 1, then subjected to heat-treatment under the conditions as indicated in Tables 9 and 10 below, and thereafter coated with the same photographic layers as those in Example 1. Thus, sample Nos. 229 to 236 were prepared.

Using the TAC support and the PEN support, sample Nos. 237 to 240 were also prepared in the same manner as in Example 1, except that the couplers (Y-23) and YB-33 in the eleventh and twelfth blue-sensitive emulsion layers were replaced by the same molar amounts of the couplers (1) to (3) mentioned below.

Coupler (1):

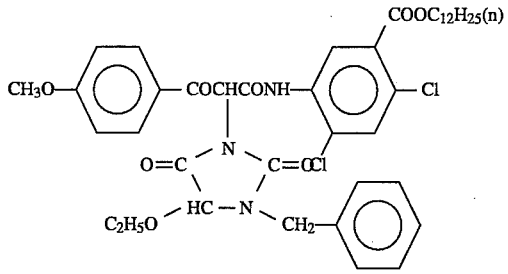

Coupler (2): (This is similar to Compound (30) described in U.S. Pat. No. 3,265,506.)

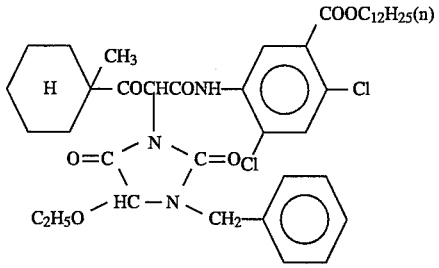

Coupler (3): (This is similar to the examples of the couplers described in JP-A-52-69624.)

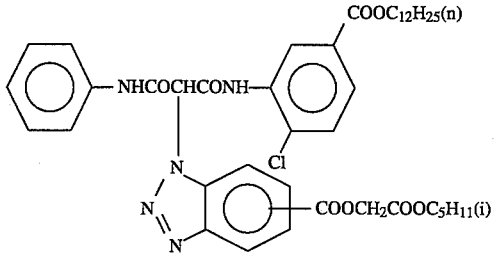

TABLE 7

| Sample | Support Kind | Support Thickness (μm) | Support Tg (°C.) | Heat Treatment (°C./hrs) | Couplers in Blue-sensitive Emulsion Layers: 11th Layer | | | 12th Layer | |
|---|---|---|---|---|---|---|---|---|---|
| 103 (comparative sample) | TAC | 122 | — | — | (Y-23) | YB-33 | ExY-1 | (Y-23) | YB-33 |
| 201 (comparative sample) | TAC | 122 | — | — | (Y-2) | YB-31 | ExY-1 | (Y-2) | YB-31 |
| 202 (comparative sample) | TAC | 122 | — | — | (Y-11) | YB-29 | ExY-1 | (Y-11) | YB-29 |
| 203 (comparative sample) | TAC | 122 | — | — | (Y-29)/(Y-35) = 1/1, by mol | YB-24 | ExY-1 | (Y-29) | YB-24 |
| 204 (comparative sample) | TAC | 122 | — | — | (Y-9)/YB-2 = 2/1, by mol | YB-33 | ExY-1 | (Y-9) | YB-27 |
| 205 (comparative sample) | TAC | 122 | — | — | (Y-39)/(Y-46) = 1/1, by mol | YB-31 | (Y-13) | (Y-46) | YB-33 |
| 206 (comparative | TAC | 122 | — | — | (Y-5)/YB-18 = 1/1, by mol | (Y-26) | ExY-1 | (Y-23) | YB-33 |

TABLE 7-continued

| Sample | Support Kind | Support Thickness (μm) | Support Tg (°C.) | Heat Treatment (°C./hrs) | Couplers in Blue-sensitive Emulsion Layers 11th Layer | | | 12th Layer | |
|---|---|---|---|---|---|---|---|---|---|
| sample) | | | | | | | | | |
| 207 (comparative sample) | TAC | 122 | — | — | YB-6/YB-1 = 3/1, by mol | YB-33 | YB-26 | (Y-11) | YB-31 |
| 123 (sample of the invention) | PET | 90 | 80 | 75/24 | (Y-23) | YB-33 | ExY-1 | (Y-23) | YB-33 |
| 208 (sample of the invention) | PET | 90 | — | — | (Y-2) | YB-31 | ExY-1 | (Y-2) | YB-31 |
| 209 (sample of the invention) | PET | 90 | — | — | (Y-11) | YB-29 | ExY-1 | (Y-11) | YB-29 |
| 210 (sample of the invention) | PET | 90 | — | — | (Y-29)/(Y-35) = 1/1, by mol | YB-24 | ExY-1 | (Y-29) | YB-24 |

TABLE 8

| Sample | Support Kind | Support Thickness (μm) | Support Tg (°C.) | Heat Treatment (°C./hrs) | Couplers in Blue-sensitive Emulsion Layers 11th Layer | | | 12th Layer | |
|---|---|---|---|---|---|---|---|---|---|
| 211 (sample of the invention) | PET | 90 | 80 | 75/24 | (Y-9)/YB-2 = 2/1, by mol | YB-33 | ExY-1 | (Y-9) | YB-27 |
| 212 (sample of the invention) | PET | 90 | 80 | 75/24 | (Y-40)/(Y-39) = 1/1, by mol | YB-31 | (Y-13) | (Y-40) | YB-33 |
| 213 (sample of the invention) | PET | 90 | 80 | 75/24 | (Y-5)/YB-18 = 1/1, by mol | (Y-6) | ExY-1 | (Y-23) | YB-33 |
| 214 (sample of the invention) | PET | 90 | 80 | 75/24 | YB-6/YB-1 = 3/1, by mol | YB-33 | YB-26 | (Y-11) | YB-31 |
| 129 (sample of the invention) | PEN | 75 | 119 | 110/48 | (Y-23) | YB-33 | ExY-1 | (Y-23) | YB-33 |
| 215 (sample of the invention) | PEN | 75 | 119 | 110/48 | (Y-2) | YB-31 | ExY-1 | (Y-2) | YB-31 |
| 216 (sample of the invention) | PEN | 75 | 119 | 110/48 | (Y-11) | YB-29 | ExY-1 | (Y-11) | YB-29 |
| 217 (sample of the invention) | PEN | 75 | 119 | 110/48 | (Y-29)/(Y-35) = 1/1, by mol | YB-24 | ExY-1 | (Y-29) | YB-24 |
| 218 (sample of the invention) | PEN | 75 | 119 | 110/48 | (Y-9)/YB-2 = 2/1, by mol | YB-33 | ExY-1 | (Y-9) | YB-27 |
| 219 (sample of the invention) | PEN | 75 | 119 | 110/48 | (Y-40)/(Y-39) = 1/1, by mol | YB-31 | (Y-13) | (Y-40) | YB-33 |
| 220 (sample of the invention) | PEN | 75 | 119 | 110/48 | (Y-5)/YB-18 = 1/1, by mol | (Y-26) | ExY-1 | (Y-23) | YB-33 |
| 221 (sample of the invention) | PEN | 75 | 119 | 110/48 | YB-6/YB-1 = 3/1, by mol | YB-33 | YB-26 | (Y-11) | YB-31 |

TABLE 9

| Sample | Support Kind | Support Thickness (μm) | Support Tg (°C.) | Heat Treatment (°C./hrs) | Couplers in Blue-sensitive Emulsion Layers 11th Layer | | | 12th Layer | |
|---|---|---|---|---|---|---|---|---|---|
| 135 (sample of the invention) | PEN/PET = 4/1 | 75 | 104 | 95/48 | (Y-23) | YB-33 | ExY-1 | (Y-23) | YB-33 |
| 222 (sample of the invention) | PEN/PET = 4/1 | 75 | 104 | 95/48 | (Y-2) | YB-31 | ExY-1 | (Y-2) | YB-31 |
| 223 (sample of the invention) | PEN/PET = 4/1 | 75 | 104 | 95/48 | (Y-11) | YB-29 | ExY-1 | (Y-11) | YB-29 |
| 224 (sample of the invention) | PEN/PET = 4/1 | 75 | 104 | 95/48 | (Y-25)/(Y-35) = 1/1, by mol | YB-24 | ExY-1 | (Y-29) | YB-24 |
| 225 (sample of the | PEN/PET = | 75 | 104 | 95/48 | (Y-9)/YB-2 = 2/1, by mol | YB-33 | ExY-1 | (Y-9) | YB-27 |

TABLE 9-continued

| Sample | Support Kind | Support Thickness (μm) | Support Tg (°C.) | Heat Treatment (°C./hrs) | Couplers in Blue-sensitive Emulsion Layers 11th Layer | | | 12th Layer | |
|---|---|---|---|---|---|---|---|---|---|
| invention) | 4/1 | | | | | | | | |
| 226 (sample of the invention) | PEN/PET = 4/1 | 75 | 104 | 95/48 | (Y-40)/(Y-39) = 1/1, by mol | YB-31 | (Y-13) | (Y-40) | YB-33 |
| 227 (sample of the invention) | PEN/PET = 4/1 | 75 | 104 | 95/48 | (Y-5)/YB-18 = 1/1, by mol | (Y-26) | ExY-1 | (Y-23) | YB-33 |
| 228 (sample of the invention) | PEN/PET = 4/1 | 75 | 104 | 95/48 | YB-6/YB-1 = 3/1, by mol | YB-33 | YB-26 | (Y-11) | YB-31 |
| 229 (sample of the invention) | P-4 | 85 | 92 | 85/24 | (Y-23) | YB-33 | ExY-1 | (Y-23) | YB-33 |
| 230 (sample of the invention) | P-5 | 85 | 102 | 95/36 | (Y-23) | YB-33 | ExY-1 | (Y-23) | YB-33 |
| 231 (sample of the invention) | P-6 | 85 | 112 | 100/48 | (Y-23) | YB-33 | ExY-1 | (Y-23) | YB-33 |
| 232 (sample of the invention) | P-7 | 85 | 105 | 95/36 | (Y-23) | YB-33 | ExY-1 | (Y-23) | YB-33 |

TABLE 10

| Sample | Support Kind | Support Thickness (μm) | Support Tg (°C.) | Heat Treatment (°C./hrs) | Couplers in Blue-sensitive Emulsion Layers 11th Layer | | | 12th Layer | |
|---|---|---|---|---|---|---|---|---|---|
| 233 (sample of the invention) | P-11 | 85 | 105 | 95/36 | (Y-23) | YB-33 | ExY-1 | (Y-23) | YB-33 |
| 234 (sample of the invention) | P-12 | 85 | 115 | 105/48 | (Y-23) | YB-33 | ExY-1 | (Y-23) | YB-33 |
| 235 (sample of the invention) | P-16 | 85 | 142 | 130/72 | (Y-23) | YB-33 | ExY-1 | (Y-23) | YB-33 |
| 236 (sample of the invention) | P-19 | 85 | 108 | 100/48 | (Y-23) | YB-33 | ExY-1 | (Y-23) | YB-33 |
| 237 (comparative sample) | TAC | 122 | — | — | Coupler (1) | ExY-1 | ExY-1 | Coupler (1) | ExY-1 |
| 238 (comparative sample) | TAC | 122 | — | — | Coupler (2) | Coupler (3) | Coupler (3) | Coupler (2) | Coupler (3) |
| 239 (comparative sample) | PEN | 75 | 119 | 110/48 | Coupler (1) | ExY-1 | ExY-1 | Coupler (1) | ExY-1 |
| 240 (comparative sample) | PEN | 75 | 119 | 110/48 | Coupler (2) | Coupler (3) | Coupler (3) | Coupler (2) | Coupler (3) |

Each of the thus-prepared Sample Nos. 201 to 240 and Samples Nos. 103, 123, 129 and 135 was loaded in the supply room in the form of a roll having a hollow area diameter of 13.02 mm in the center thereof in accordance with the process of (6) (for formation of film-combined camera samples) in Example 1 and then subjected to the core-setting treatment of (7) in Example 1 so that the film in the room was curled. These film-combined camera samples were then cooled in a room at 25° C. overnight. The film samples were taken out from the cameras and then tested by the following tests.

First, in order to test the storage stability of the raw film samples, two groups each comprising the film samples to be tested were prepared. The samples of one group were stored at 5° C. and 35% RH for 2 months; while those of the other group at 40° C. and 80% RH also for 2 months. The thus-stored samples were all wedgewise exposed to a white light (from a light source having a color temperature of 4800° K.) and then processed for color development in the same manner as in Example 1. The characteristic curves of the processed samples were obtained.

From the characteristic curves, the density ($D_1$) at the point of the exposure shifted from the point of the exposure of giving the density of (minimum density +0.2) to the higher exposure range by 1.5 (as LogE) was read out, for the samples stored at 5° C. and 35% RH; while the density ($D_2$) of the same meaning was read out therefrom for the samples stored at 40° C. and 80% RH. The ratio of the color densities $D_2/D_1$ was obtained, and the storage stability of each samples was evaluated on the basis of the variation of the color densities of the samples stored under different conditions.

For testing the color image stability in the processed samples, the samples of another group were wedgewise exposed to a white light and processed for color development. The density (fresh density) of each of the thus-processed samples was measured. Then, the samples were stored at 60° C. and 70% RH for 2 months, and the density of each of the thus-stored samples was again measured. From the characteristic curves of the samples, the amount of exposure for giving the density of (minimum density +1.5) was obtained for the samples (fresh samples) before having been stored under the high-temperature and high-humidity condition; while the density at the thus-obtained exposure amount was read out for the samples stored under the high-temperature and high-humidity condition. The difference in the density (ΔD) between the fresh sample and the stored sample was obtained.

The raw film storage stability and the color image stability were tested with respect to the yellow density in each sample.

Next, the samples were wedgewise exposed through a blue filter and then processed in the same manner as above. The yellow density of each of the thus-processed samples was measured to obtain the characteristic curve. The magenta density of these samples was also measured in the same manner, except that a polarizing filter for a transmission wavelength of 510 nm (half-value width: 10 nm) was used. From these two characteristic curves, the magenta density at the point of the exposure giving the yellow density of (minimum density +2.0) on the yellow density characteristic curve was read out from the magenta density characteristic curve. The difference ($\Delta D_G$) between the two densities was obtained on the basis of the standard sample of Sample No. 237. The smaller the value, the smaller the absorption in the green range. That is to say, the smaller value indicates the better color reproducibility and also the improved image quality.

The results obtained are shown in Tables 11 and 12 below.

TABLE 11

| Sample | Support | Raw Film Storage Stability ($D_2/D_1$) | Color Image Storage Stability (ΔD) | Color Reproducibility ($\Delta D_G$) |
|---|---|---|---|---|
| 103 (comparative sample) | TAC | 0.96 | 0.15 | −0.04 |
| 201 (comparative sample) | TAC | 0.96 | 0.15 | −0.04 |
| 202 (comparative sample) | TAC | 0.96 | 0.15 | −0.04 |
| 203 (comparative sample) | TAC | 0.96 | 0.15 | −0.04 |
| 204 (comparative sample) | TAC | 0.95 | 0.16 | −0.04 |
| 205 (comparative sample) | TAC | 0.96 | 0.15 | −0.04 |
| 206 (comparative sample) | TAC | 0.96 | 0.15 | −0.04 |
| 207 (comparative sample) | TAC | 0.94 | 0.17 | −0.04 |
| 123 (sample of the invention) | PET | 1.00 | 0.08 | −0.05 |
| 208 (sample of the invention) | PET | 1.00 | 0.08 | −0.05 |
| 209 (sample of the invention) | PET | 1.00 | 0.08 | −0.05 |
| 210 (sample of the invention) | PET | 1.00 | 0.08 | −0.05 |
| 211 (sample of the invention) | PET | 0.99 | 0.09 | −0.05 |
| 212 (sample of the invention) | PET | 1.00 | 0.08 | −0.05 |
| 213 (sample of the invention) | PET | 1.00 | 0.08 | −0.05 |
| 214 (sample of the invention) | PET | 0.99 | 0.09 | −0.05 |
| 129 (sample of the invention) | PEN | 1.00 | 0.07 | −0.05 |
| 215 (sample of the invention) | PEN | 1.00 | 0.07 | −0.05 |
| 216 (sample of the invention) | PEN | 1.00 | 0.07 | −0.05 |
| 217 (sample of the invention) | PEN | 1.00 | 0.07 | −0.05 |
| 218 (sample of the invention) | PEN | 1.00 | 0.08 | −0.05 |
| 219 (sample of the invention) | PEN | 1.00 | 0.07 | −0.05 |

TABLE 12

| Sample | Support | Raw Film Storage Stability ($D_2/D_1$) | Color Image Storage Stability (ΔD) | Color Reproducibility ($\Delta D_G$) |
|---|---|---|---|---|
| 220 (sample of the invention) | PEN | 1.00 | 0.07 | −0.05 |
| 221 (sample of the invention) | PEN | 1.00 | 0.08 | −0.05 |
| 135 (sample of the | PEN/PET = 4/1 | 1.00 | 0.07 | −0.05 |

TABLE 12-continued

| Sample | Support | Raw Film Storage Stability ($D_2/D_1$) | Color Image Storage Stability ($\Delta D$) | Color Reproducibility ($\Delta D_G$) |
|---|---|---|---|---|
| invention) | | | | |
| 222 (sample of the invention) | PEN/PET = 4/1 | 1.00 | 0.07 | −0.05 |
| 223 (sample of the invention) | PEN/PET = 4/1 | 1.00 | 0.07 | −0.05 |
| 224 (sample of the invention) | PEN/PET = 4/1 | 1.00 | 0.07 | −0.05 |
| 225 (sample of the invention) | PEN/PET = 4/1 | 1.00 | 0.08 | −0.05 |
| 226 (sample of the invention) | PEN/PET = 4/1 | 1.00 | 0.07 | −0.05 |
| 227 (sample of the invention) | PEN/PET = 4/1 | 1.00 | 0.07 | −0.05 |
| 228 (sample of the invention) | PEN/PET = 4/1 | 1.00 | 0.08 | −0.05 |
| 229 (sample of the invention) | P-4 | 1.00 | 0.07 | −0.05 |
| 230 (sample of the invention) | P-5 | 1.00 | 0.07 | −0.05 |
| 231 (sample of the invention) | P-6 | 1.00 | 0.07 | −0.05 |
| 232 (sample of the invention) | P-7 | 0.99 | 0.07 | −0.05 |
| 233 (sample of the invention) | P-11 | 1.00 | 0.07 | −0.05 |
| 234 (sample of the invention) | P-12 | 0.99 | 0.07 | −0.05 |
| 235 (sample of the invention) | P-16 | 1.00 | 0.07 | −0.05 |
| 236 (sample of the invention) | P-19 | 1.00 | 0.07 | −0.05 |
| 237 (comparative sample) | TAC | 0.93 | 0.07 | 0.00 (standard sample) |
| 238 (comparative sample) | TAC | 0.85 | 0.28 | +0.02 |
| 239 (comparative sample) | PEN | 0.95 | 0.13 | 0.00 |
| 240 (comparative sample) | PEN | 0.86 | 0.25 | +0.02 |

From the results in Tables 11 and 12, it is obvious that the yellow-coloring property of the photographic materials having the heat-treated polyester support of the present invention was not worsened even though the photographic materials were stored under the high-temperature and high-humidity condition for a long period of time and therefore the heat-treated polyester supports of the present invention are favorable as the supports of photographic materials to improve the storage stability of raw films, as compared with the comparative samples. In addition, regarding the storage stability of yellow color images, it is also obvious therefrom that the densities of the yellow colon images of the photographic materials having the heat-treated polyester support of the present invention lowered little after the storage of the images and therefore the supports of the present invention are good.

Comparing Sample Nos. 208 to 236, 123, 129 and 135 of the present invention with Comparative Sample Nos. 239 and 240 with respect to the yellow couplers therein, it is noted that the use of the coupler represented by formula (YI) and/or the coupler represented by formula (1) or (2) in the present invention improves the storage stability of the raw photographic films and the storage stability of the photographic color images to be formed and is advantageous for improving the color reproducibility of the photographic materials containing them to give good photographic images.

The samples in this example were exposed through an MTF pattern to measure the MTF values of the formed yellow images at the density of 1.0, according to the ordinary method for determining the image quality of photographic materials. The samples of the present invention having the coupler represented by formula (YI) or (2) where the split-off group was a residue of a so-called DIR compound of releasing a development inhibitor or its precursor had a high MTF value and therefore the sharpness of the samples was good. Comparing the measured values between Sample Nos. 219 and 221 of the present invention and Comparative Sample Nos. 239 and 240, the superiority of the former to the latter was numerically verified in this respect.

EXAMPLE 3

PET, PEN, PEN/PET (4/1, by weight) and TAC supports were prepared in the same manner as in Example 1, except that the thickness of them was changed to 180 μm by varying the liquid-spreading method and the film-stretching method.

Using these four supports, Sample Nos. 301 to 340 shown in Tables 13 and 14 below were prepared in the same manner as in preparation of Sample No. 101 in Example 1 and Sample Nos. 201 to 207, 237 and 238 in Example 2 .

Sample Nos. 301 to 340 thus prepared were examined with respect to the raw film stability, the image stability and the color reproducibility according to the same methods employed in Example 2. Regarding the color reproducibility, the difference of each sample from Sample No. 333 as the standard was obtained.

The test results obtained are shown in Tables 13 and 14.

TABLE 13

| Basic Sample | Sample | Support | Raw Film Storage Stability ($D_2/D_1$) | Color Image Storage Stability ($\Delta D$) | Color Reproducibility ($\Delta D_G$) |
|---|---|---|---|---|---|
| 101 | 301 (comparative sample) | TAC | 0.94 | 0.17 | −0.04 |
| | 302 (sample of the invention) | PET | 1.00 | 0.08 | −0.05 |
| | 303 (sample of the invention) | PEN | 1.00 | 0.07 | −0.05 |
| | 304 (sample of the invention) | PEN/PET = 4/1 | 1.00 | 0.07 | −0.05 |
| 201 | 305 (comparative sample) | TAC | 0.94 | 0.17 | −0.04 |
| | 306 (sample of the invention) | PET | 1.00 | 0.08 | −0.05 |
| | 307 (sample of the invention) | PEN | 1.00 | 0.07 | −0.05 |
| | 308 (sample of the invention) | PEN/PET = 4/1 | 1.00 | 0.07 | −0.05 |
| 202 | 309 (comparative sample) | TAC | 0.94 | 0.17 | −0.04 |
| | 310 (sample of the invention) | PET | 1.00 | 0.08 | −0.05 |
| | 311 (sample of the invention) | PEN | 1.00 | 0.07 | −0.05 |
| | 312 (sample of the invention) | PEN/PET = 4/1 | 1.00 | 0.07 | −0.05 |
| 203 | 313 (comparative sample) | TAC | 0.94 | 0.17 | −0.04 |
| | 314 (sample of the invention) | PET | 0.99 | 0.08 | −0.05 |
| | 315 (sample of the invention) | PEN | 1.00 | 0.07 | −0.05 |
| | 316 (sample of the invention) | PEN/PET = 4/1 | 0.99 | 0.07 | −0.05 |
| 204 | 317 (comparative sample) | TAC | 0.93 | 0.18 | −0.04 |
| | 318 (sample of the invention) | PET | 0.99 | 0.09 | −0.05 |
| | 319 (sample of the invention) | PEN | 1.00 | 0.08 | −0.05 |
| | 320 (sample of the invention) | PEN/PET = 4/1 | 1.00 | 0.08 | −0.05 |

TABLE 14

| Basic Sample | Sample | Support | Raw Film Storage Stability ($D_2/D_1$) | Color Image Storage Stability ($\Delta D$) | Color Reproducibility ($\Delta D_G$) |
|---|---|---|---|---|---|
| 205 | 321 (comparative sample) | TAC | 0.94 | 0.17 | −0.04 |
| | 322 (sample of the invention) | PET | 1.00 | 0.08 | −0.05 |
| | 323 (sample of the invention) | PEN | 1.00 | 0.07 | −0.05 |
| | 324 (sample of the invention) | PEN/PET = 4/1 | 1.00 | 0.07 | −0.05 |
| 206 | 325 (comparative sample) | TAC | 0.94 | 0.17 | −0.04 |
| | 326 (sample of the invention) | PET | 1.00 | 0.08 | −0.05 |
| | 327 (sample of the invention) | PEN | 1.00 | 0.07 | −0.05 |
| | 328 (sample of the invention) | PEN/PET = 4/1 | 1.00 | 0.07 | −0.05 |
| 207 | 329 (comparative sample) | TAC | 0.92 | 0.19 | −0.04 |

TABLE 14-continued

| Basic Sample | Sample | Support | Raw Film Storage Stability ($D_2/D_1$) | Color Image Storage Stability ($\Delta D$) | Color Reproducibility ($\Delta D_G$) |
|---|---|---|---|---|---|
| | 330 (sample of the invention) | PET | 0.99 | 0.09 | −0.05 |
| | 331 (sample of the invention) | PEN | 1.00 | 0.08 | −0.05 |
| | 332 (sample of the invention) | PEN/PET = 4/1 | 1.00 | 0.08 | −0.05 |
| 237 | 333 (comparative sample) | TAC | 0.91 | 0.19 | 0.00 (standard) |
| | 334 (comparative sample) | PET | 0.95 | 0.13 | 0.00 |
| | 335 (comparative sample) | PEN | 0.95 | 0.12 | 0.00 |
| | 336 (comparative sample) | PEN/PET = 4/1 | 0.95 | 0.12 | 0.00 |
| 238 | 337 (comparative sample) | TAC | 0.81 | 0.31 | +0.02 |
| | 338 (comparative sample) | PET | 0.84 | 0.27 | +0.02 |
| | 339 (comparative sample) | PEN | 0.84 | 0.26 | +0.02 |
| | 340 (comparative sample) | PEN/PET = 4/1 | 0.84 | 0.26 | +0.02 |

The results in Tables 13 and 14 have revealed the following facts: The color reproducibility of the samples of this example having a thicker support (thickness: 180 μm) than those in Example 2 was comparable to that of the samples in Example 2, from which it is noted that the thickness of the support has no influence on the color reproducibility of the samples. However, it is noted that the raw film stability and the color image stability of the comparative samples having the thick TAC support were much inferior to those of the corresponding comparative samples (in Example 2) having the thin TAC support, while both the raw film stability and the color image stability of the samples of the present invention having the thin heat-treated polyester support were still good and were comparable to those of the corresponding samples (in Example 2) having the thin support. From this, it is noted that the thickness of the supports of the present invention has no influence on the raw film stability and the color image stability of the samples, while that of the comparative TAC support does not.

As mentioned above, the increase in the thickness of the TAC support resulted in the worsening of the raw film stability and the color image stability of the samples having such thick TAC support. This is considered because the amount of the acid (acetic acid) to be formed by decomposition of TAC increases when a thick TAC support is used and the increased amount of the generated acetic acid will worsen the photographic properties.

EXAMPLE 4

Five supports of PEN of 75 μm thick, PET of 90 μm thick, PEN/PET (4/1, by weight) of 75 μm thick, TAC of 115 μm thick and TAC of 122 μm thick were prepared in accordance with the steps (1) to (4) employed in Example 1, all of which were ready to be coated with photographic layers. Each of the supports was wound around a hollow core having an outer diameter of 9 cm and stored under a high-temperature and high-humidity condition of 60° C. and 70% RH for one month. After the storage, the supports were coated with the same photographic layers as those in Example 1 to prepare Sample Nos. 401 to 442 corresponding to Sample Nos. 101 to 142 in Example 1, respectively.

The samples were processed in accordance with the process of Example 1. One group of the samples were curled in the same manner as in Example 1. After cooled, the curled samples were examined with respect to the operation for drawing the tongue from the patrone, the developability and the degree of the curling. The other group of them were examined with respect to the raw film storage stability and the color image storage stability in accordance with the methods of Example 2.

The test results have revealed the following facts: The samples having the polyester support that had been heat-treated within the temperature range defined by the present invention were still comparable to the samples of Example 1, with respect to the easiness of the operation of drawing out the tongue of the film from the patrone, the small curling value, the uniform developability, the resistance to scratching and the resistance to bending at the back end of the film, even though the supports were stored under the high-temperature and high-humidity condition prior to the coating of the photographic layers thereon; while the comparative samples having the TAC support or the non-heat-treated polyester support were not in that the operation of drawing out the tongue of the film from the patrone became more difficult, the curling value became larger, the developed samples became more uneven, the scratches of the developed samples became increased and the bending of the back end of the film became increased.

Regarding the raw film storage stability and the color image storage stability, the samples of the present invention having the polyester support in this example were comparable to Sample Nos. 123, 129 and 135 in Tables 11 and 12 in Example 2, while the comparative sample having the TAC support was much poorer than Sample No. 103 in Table 11. The values of the raw film storage stability and the color image stability of the comparative sample in this example were 0.94 and 0.17, respectively.

From these test results, it is understood that, even though the supports of the present invention are stored under a high-temperature and high-humidity condition prior to coating photographic layers thereon, the coated photographic materials still have the good handlability, the good color developability, the good raw film stability and the good color image stability.

The silver halide photographic material of the present invention, which is generally used in the form of a roll film and which is characterized in that it has a layer containing the coupler represented by formula (YI) and/or the coupler represented by formula (1) or (2) on the support, that the support is a polyester support having a glass transition point of from 50° C. to 200° C. and that the support is heat-treated at a temperature falling within the range from 40° C. to lower than the glass transition point before or after having been coated with a subbing layer and before being coated with silver halide light-sensitive layers, is easily handled and processed, since the operation of drawing out the tongue of the film from the patrone is easy and the curling of the roll film is small after its development while the curled film may easily be smoothed. In addition, the photographic material of the present invention may be developed evenly, without being scratched on it surface or being bent at its back end. As having the polyester support, the raw film stability and the color image stability of the photographic material of the present invention are good.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon a layer containing an acylacetamide coupler having an acyl group represented by the following formula (YI) and/or a coupler represented by the following formula (1) or (2), wherein the support is made of a poly(alkylene aromatic dicarboxylate) and has a glass transition point of from 50° C. to 200° C. and is heat-treated at a temperature of from 40° C. to lower than the glass transition point before or after having been coated with a subbing layer and before being coated with silver halide light-sensitive layers,

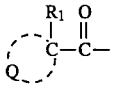

(YI)

wherein $R_1$ represents a substituent; and Q represents a non-metallic atomic group necessary for forming, along with C in the formula, a 3-membered to 5-membered hydrocarbon ring or a 3-membered to 6-membered hetero ring having in the ring structure at least one hetero atom selected from among N, O, S and P,

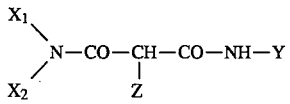

(1)

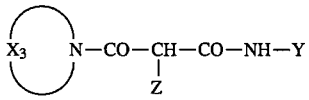

(2)

wherein $X_1$ and $X_2$ each represents an alkyl group, an aryl group or a heterocyclic group; $X_3$ represents an organic residue for forming a nitrogen-containing heterocyclic group along with >N— in the formula; Y represents an aryl group or a heterocyclic group; and Z represents a group which splits off from the formula when the coupler represented by the formula reacts with an oxidation product of a developing agent.

2. The silver halide color photographic material as claimed in claim 1, wherein the poly(alkylene aromatic dicarboxylate) support is made of a polyester consisting essentially of a benzene dicarboxylic acid or naphthalene dicarboxylic acid component and a diol component.

3. The silver halide color photographic material as claimed in claim 2, wherein the polyester is a poly(ethylene terephthalate) or a poly(ethylene naphthalate).

4. The silver halide color photographic material as claimed in claim 1, wherein the thickness of the poly(alkylene aromatic dicarboxylate) support is from 50 μm to 100 μm.

5. The silver halide color photographic material as claimed in claim 1, which is used in the form of a roll wound around a spool or vacant core having a core diameter of from 3 mm to 10 mm.

6. The silver halide color photographic material as claimed in claim 1, wherein the poly(alkylene aromatic dicarboxylate) support has a glass transition point of 55° C. or higher.

7. The silver halide color photographic material as claimed in claim 1, wherein the poly(alkylene aromatic dicarboxylate) support is heat-treated within the range of from a temperature lower than the glass transition point by 30° C. up to a temperature lower than the glass transition point.

* * * * *